US012239874B2

(12) United States Patent
McNally et al.

(10) Patent No.: US 12,239,874 B2
(45) Date of Patent: Mar. 4, 2025

(54) EXERCISE MACHINE ARM WITH SINGLE-HANDED ADJUSTMENT

(71) Applicant: Tonal Systems, Inc., San Francisco, CA (US)

(72) Inventors: Mark Peter McNally, San Francisco, CA (US); Michael Valente, San Francisco, CA (US); Anya Richardson Quenon, San Francisco, CA (US); Patricia Holloway Howes, San Francisco, CA (US); Scott Thomas Rider, Pleasant Hill, CA (US); Daniel Jordan Kayser, Mill Valley, CA (US); David Mallard, Mill Valley, CA (US); David Jonathan Zimmer, Exeter, CA (US); Maxwell Walter Davis, Oakland, CA (US)

(73) Assignee: Tonal Systems, Inc., San Francisco, CA (US)

( * ) Notice: Subject to any disclaimer, the term of this patent is extended or adjusted under 35 U.S.C. 154(b) by 0 days.

(21) Appl. No.: 18/595,123

(22) Filed: Mar. 4, 2024

(65) Prior Publication Data

US 2024/0307730 A1 Sep. 19, 2024

Related U.S. Application Data

(63) Continuation of application No. 17/504,022, filed on Oct. 18, 2021, now Pat. No. 12,005,295.
(Continued)

(51) Int. Cl.
*A63B 21/00* (2006.01)

(52) U.S. Cl.
CPC ..... *A63B 21/153* (2013.01); *A63B 21/159* (2013.01); *A63B 21/4035* (2015.10); *A63B 21/4047* (2015.10)

(58) Field of Classification Search
CPC ..... A63B 21/00069; A63B 21/00072; A63B 21/008; A63B 21/0083; A63B 21/0088; A63B 21/15; A63B 21/151; A63B 21/152; A63B 21/153; A63B 21/154; A63B 21/155; A63B 21/156; A63B 21/169; A63B 21/4033; A63B 21/4035; A63B 22/06; A63B 22/0605
See application file for complete search history.

(56) References Cited

U.S. PATENT DOCUMENTS 6,457,378 B2 * 10/2002 Hatakoshi ..... B62L 3/023 74/489
6,508,748 B1 1/2003 Ish, III
(Continued)

*Primary Examiner* — Zachary T Moore
(74) *Attorney, Agent, or Firm* — Van Pelt, Yi & James LLP

(57) ABSTRACT

An exercise device includes a resistance unit having a connecting gear. It further includes a cable. It further includes an arm that routes the cable to an actuator. The arm is rotatable relative to the resistance unit about the connecting gear, the arm having a central axis. The arm includes a control that mechanically disengages a locking mechanism from the connecting gear. The control is activated by an activation force substantially directed either toward the central axis of the arm, along a length of the arm, or about the central axis. The activation force is mechanically converted into linear force along the arm that disengages the locking mechanism from the connecting gear.

3 Claims, 73 Drawing Sheets

Related U.S. Application Data

(60) Provisional application No. 63/093,654, filed on Oct. 19, 2020.

(56) References Cited

U.S. PATENT DOCUMENTS

| | | | | |
|---|---|---|---|---|
| 7,628,095 | B2 * | 12/2009 | Funai | B62K 23/06 74/489 |
| 8,833,199 | B2 * | 9/2014 | Dal Pra' | B62L 3/02 188/24.11 |
| 9,901,768 | B1 * | 2/2018 | Wu | A63B 21/0058 |
| 2002/0193214 | A1 * | 12/2002 | Ish, III | A63B 21/078 482/92 |
| 2006/0130602 | A1 * | 6/2006 | Kawakami | B62M 25/04 74/505 |
| 2007/0184944 | A1 * | 8/2007 | Huang | A63B 21/06 482/99 |
| 2008/0051263 | A1 * | 2/2008 | Rasmussen | A63B 21/0628 482/94 |
| 2008/0051267 | A1 | 2/2008 | Ish, III | |
| 2009/0036277 | A1 * | 2/2009 | Ish, III | A63B 21/153 482/94 |
| 2011/0294630 | A1 * | 12/2011 | Reyes | A63B 23/0405 482/121 |
| 2012/0111136 | A1 * | 5/2012 | Kawakami | B62M 25/04 74/502.2 |
| 2019/0099637 | A1 * | 4/2019 | Valente | A63B 21/159 |
| 2020/0139187 | A1 | 5/2020 | Kennington | |

* cited by examiner

ONE-HANDED Embodiment

EXERCISE MACHINE ARM WITH SINGLE-HANDED ADJUSTMENT

CROSS REFERENCE TO OTHER APPLICATIONS

This application is a continuation of U.S. patent application Ser. No. 17/504,022, entitled EXERCISE MACHINE ARM WITH SINGLE-HANDED ADJUSTMENT filed Oct. 18, 2021 which is incorporated herein by reference for all purposes, which claims priority to U.S. Provisional Patent Application No. 63/093,654 entitled EXERCISE MACHINE ARM WITH SINGLE-HANDED ADJUSTMENT filed Oct. 19, 2020 which is incorporated herein by reference for all purposes.

BACKGROUND OF THE INVENTION

Strength training, also referred to as resistance training or weight lifting, is an important part of any exercise routine. It promotes the building of muscle, the burning of fat, and improvement of a number of metabolic factors including insulin sensitivity and lipid levels. It would be beneficial to have a strength training machine that is able to be easily configured in a variety of ways to perform various strength training exercises.

BRIEF DESCRIPTION OF THE DRA WINGS

Various embodiments of the invention are disclosed in the following detailed description and the accompanying drawings.

Figure 10C:
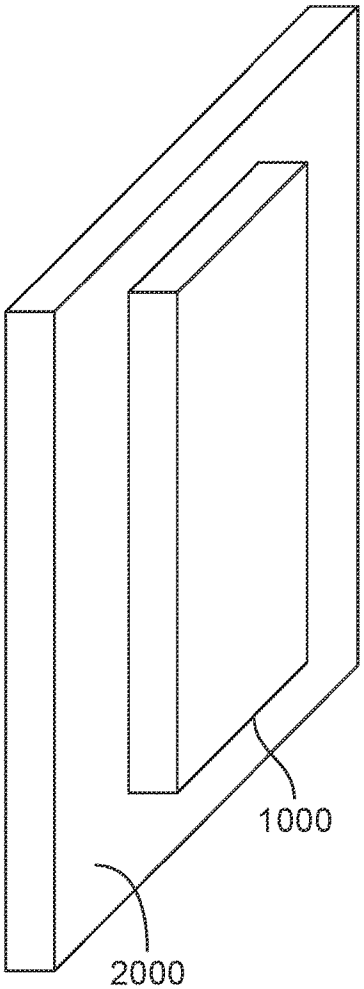
Figure 10B:
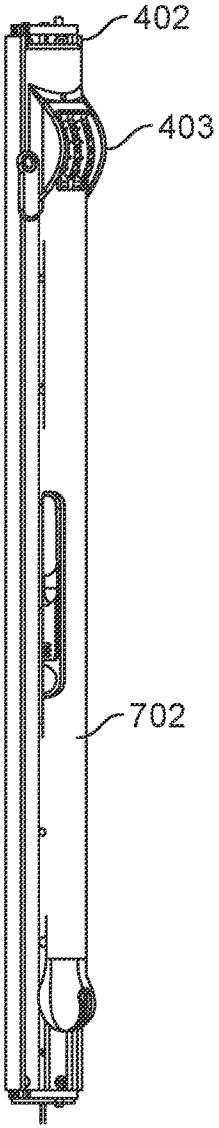
Figure 10A:
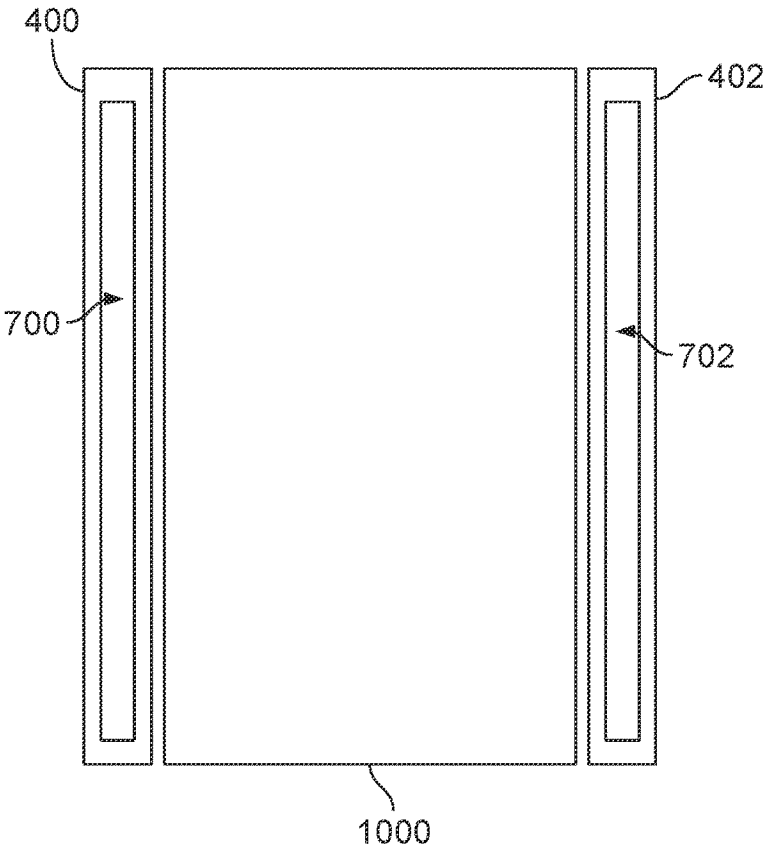

FIGS. 10A, 10B, and 10C illustrate a stowed configuration.

Figure 11:
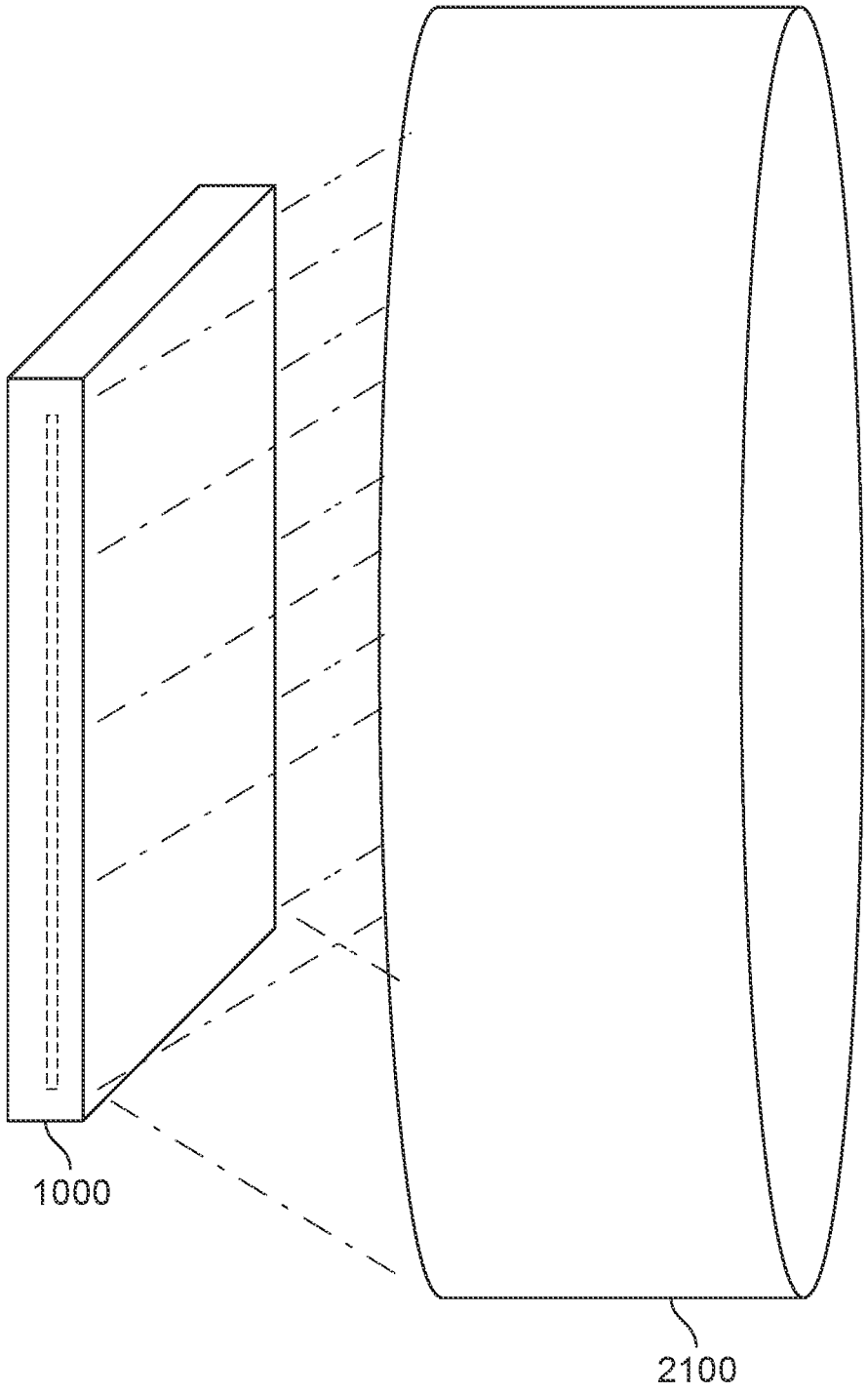

FIG. 11 illustrates the footprint of the dynamic arm placement.

FIGS. 12A, 12B, 12C, and 12D illustrate a differential for an exercise machine.

Figure 12A:
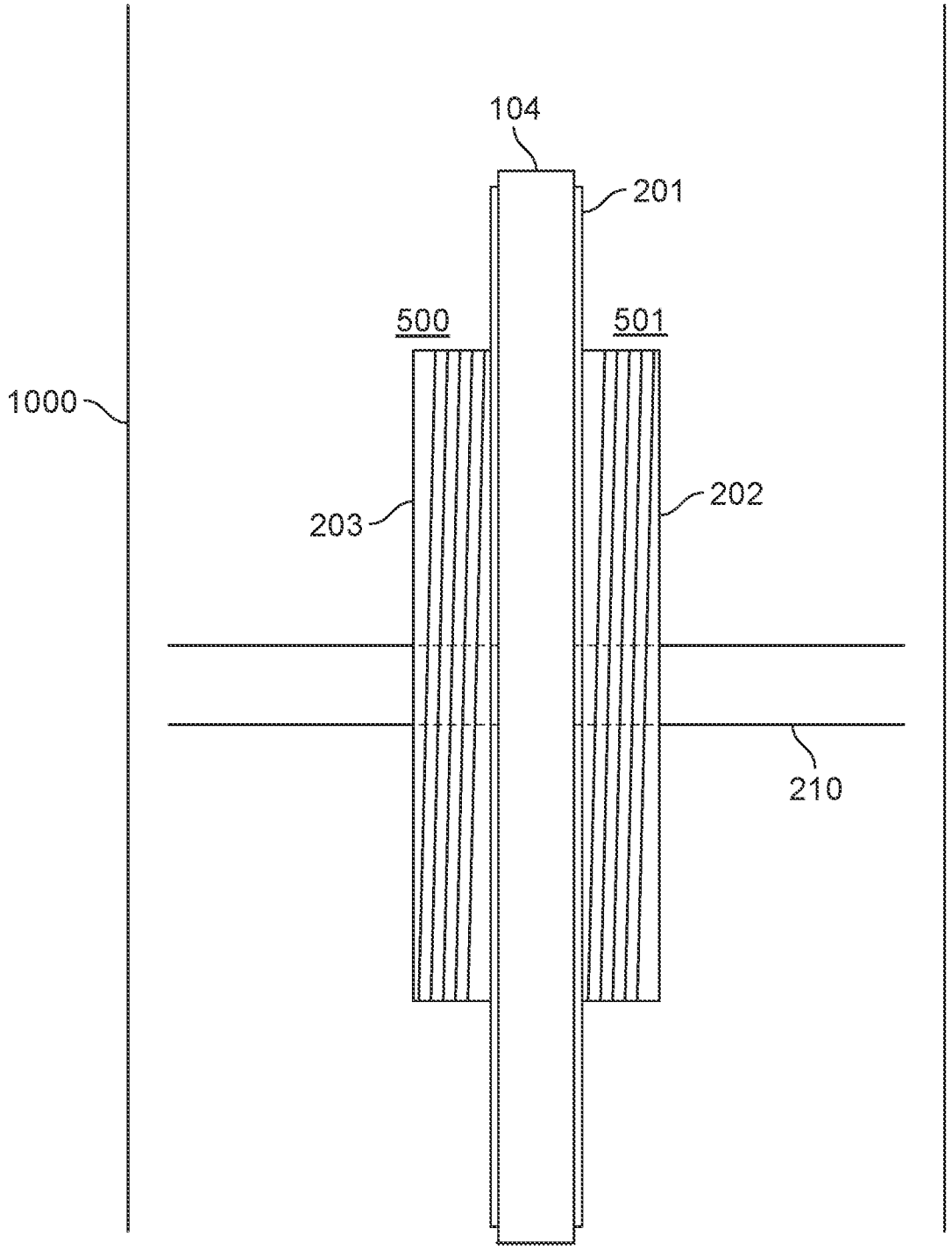
Figure 12B:
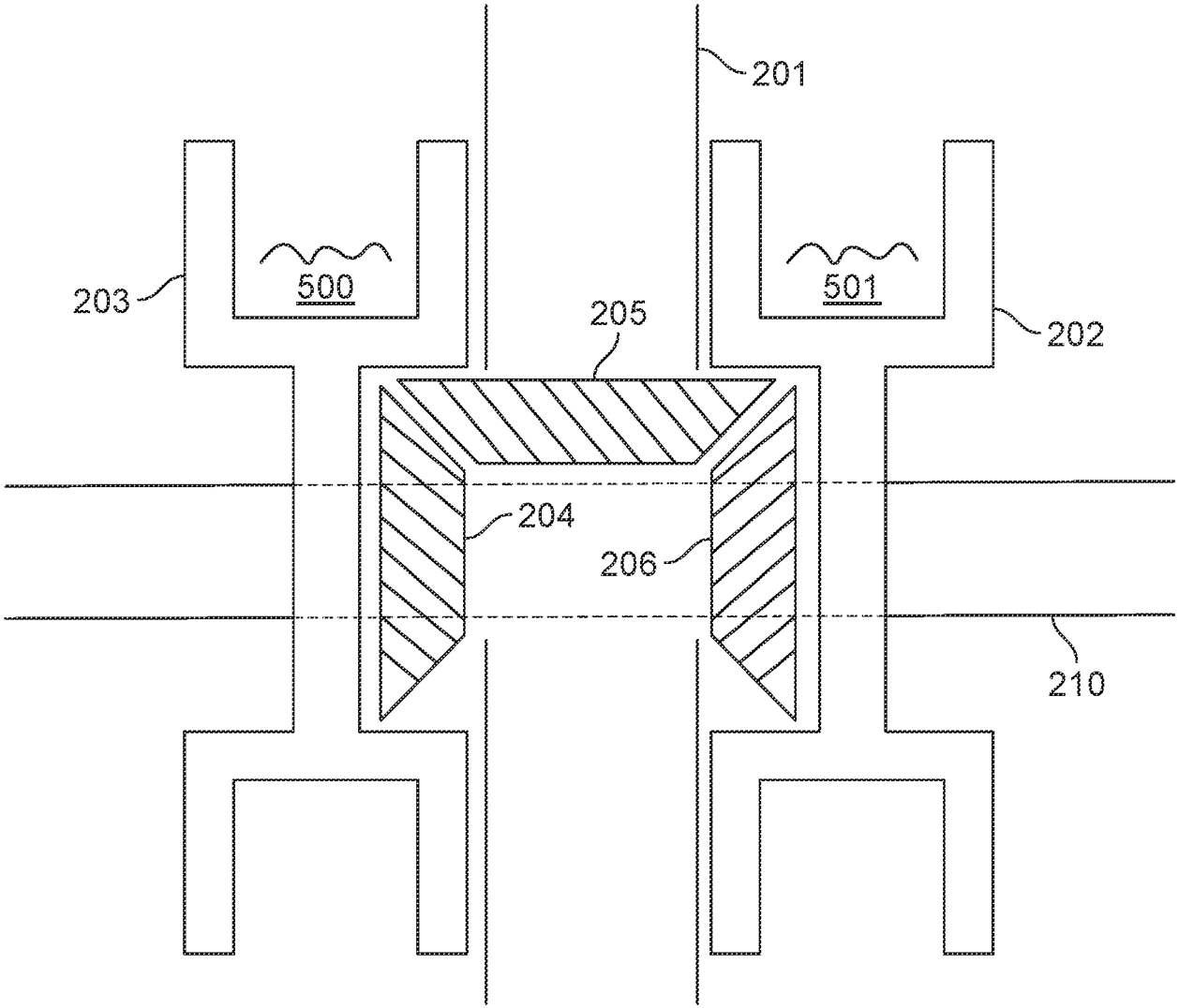
Figure 12C:
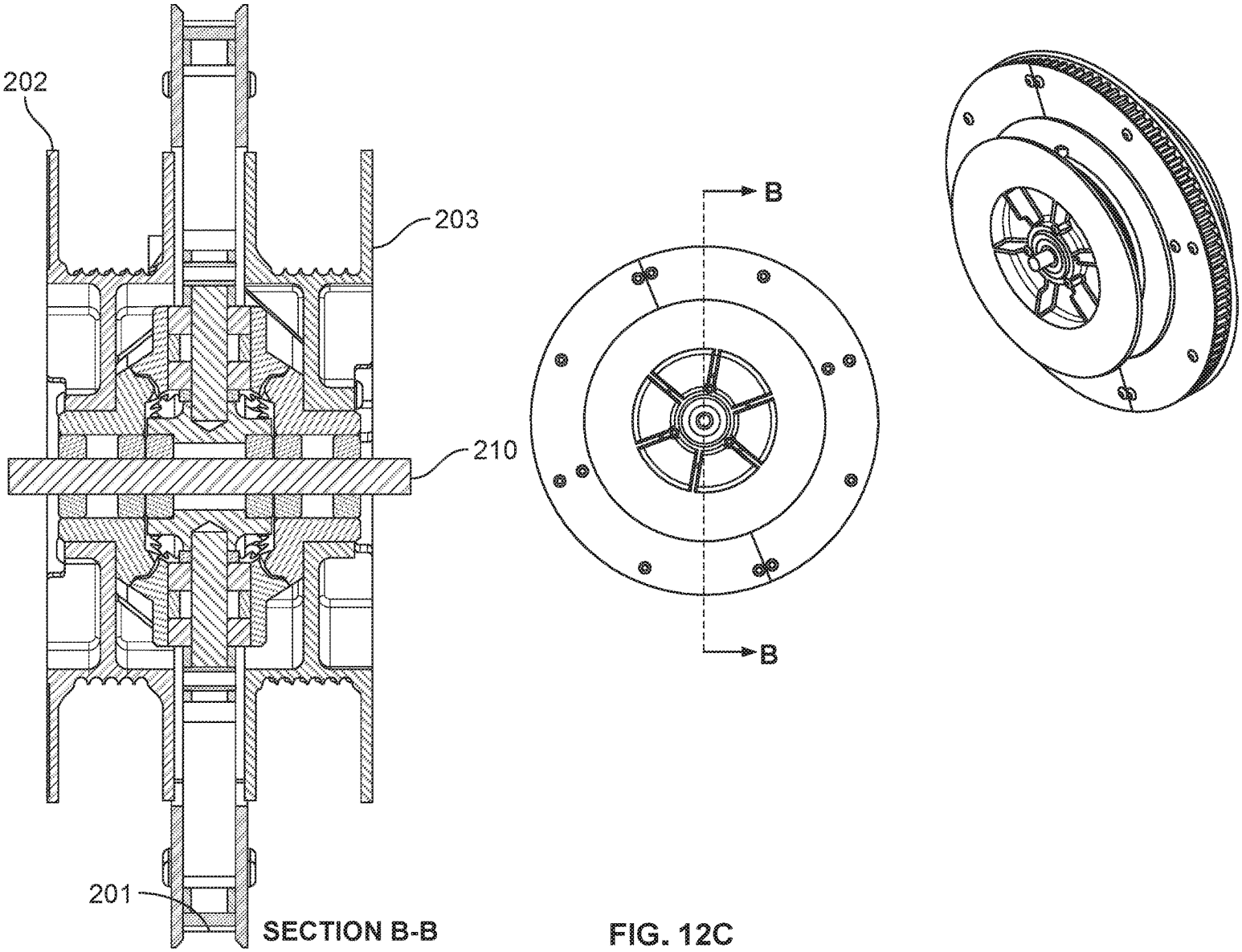
Figure 12D:
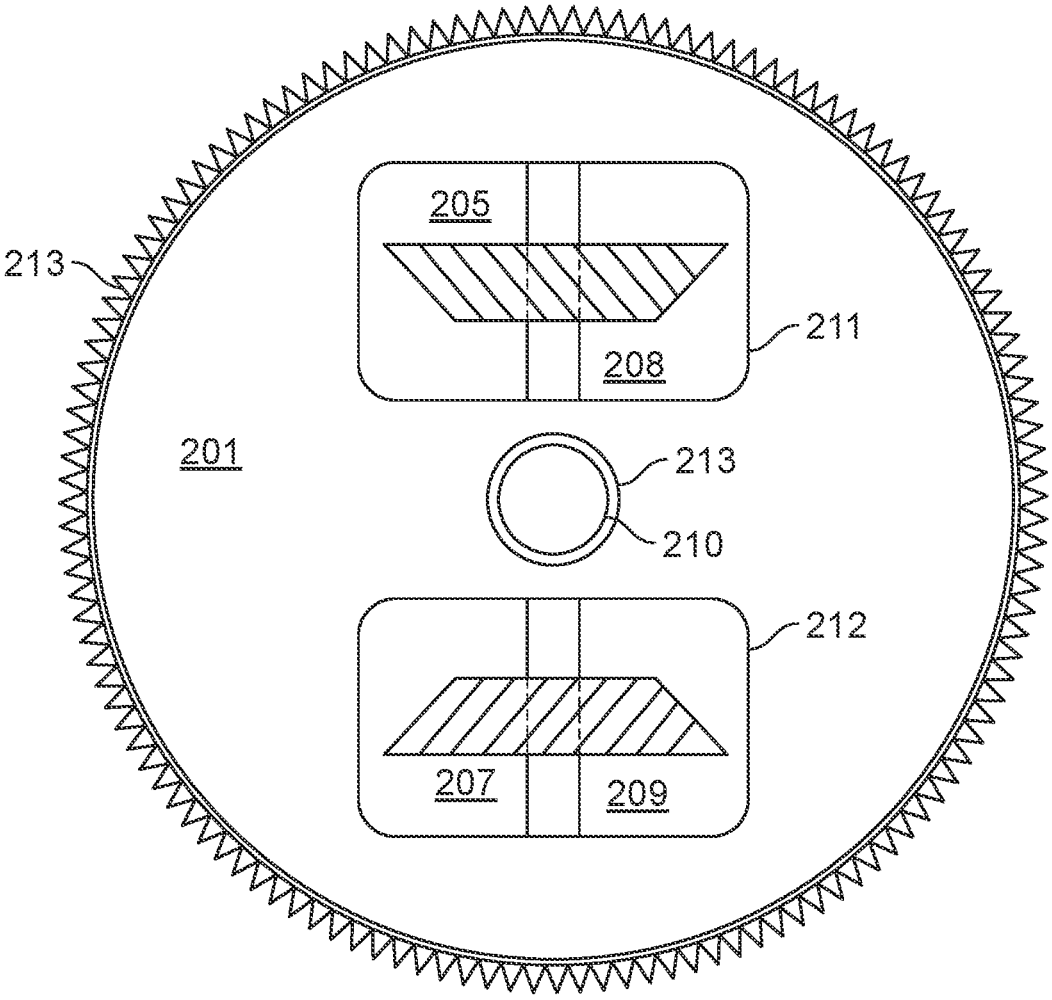
Figure 12E:
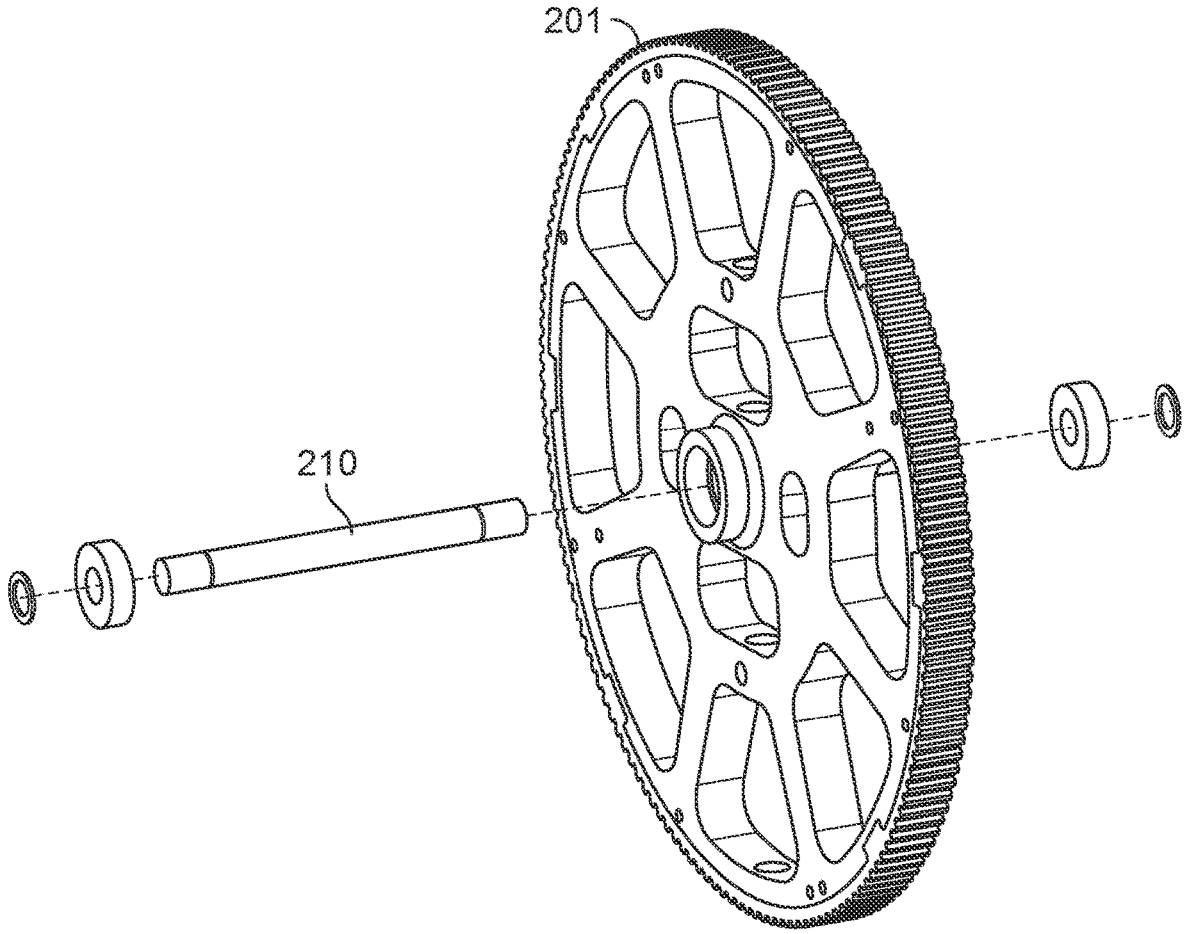

FIG. 12E illustrates an exploded perspective view drawing of sprocket (201) and shaft (210).

Figure 12F:
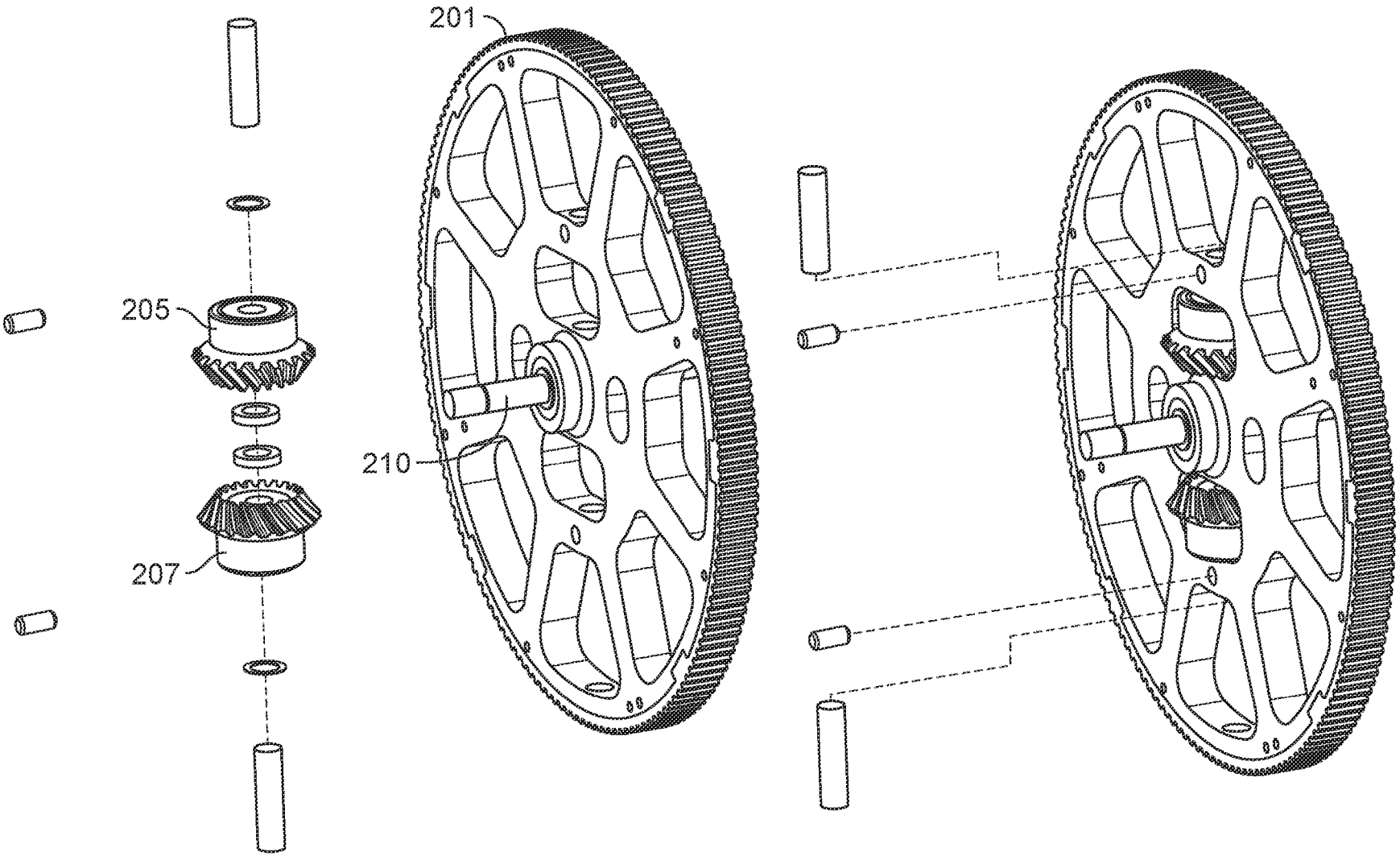

FIG. 12F illustrates an exploded perspective view drawing of planet gears (205, 207), sprocket (201) and shaft (210).

Figure 12G:
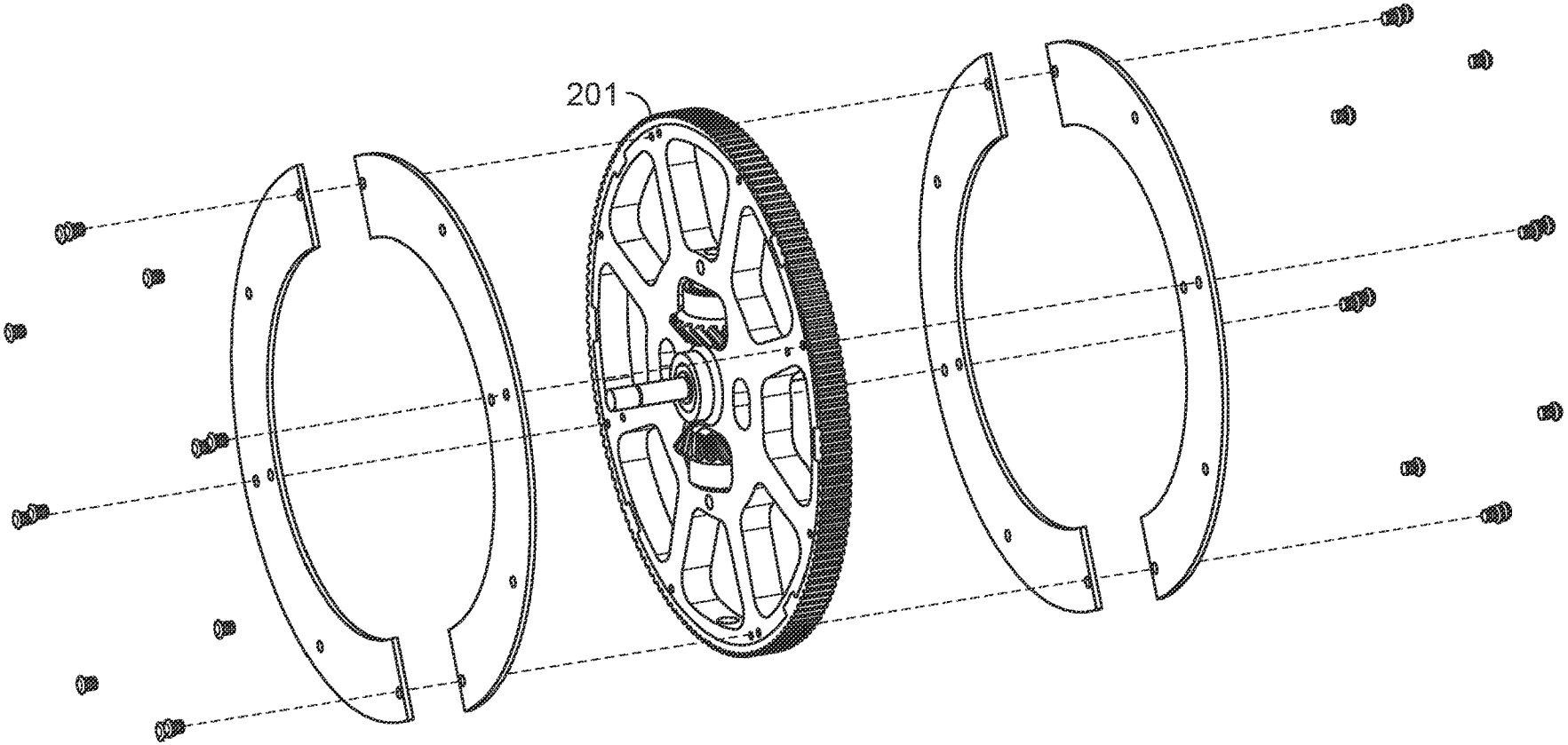

FIG. 12G illustrates an exploded perspective view drawing of a cover for sprocket (201).

Figure 12H:
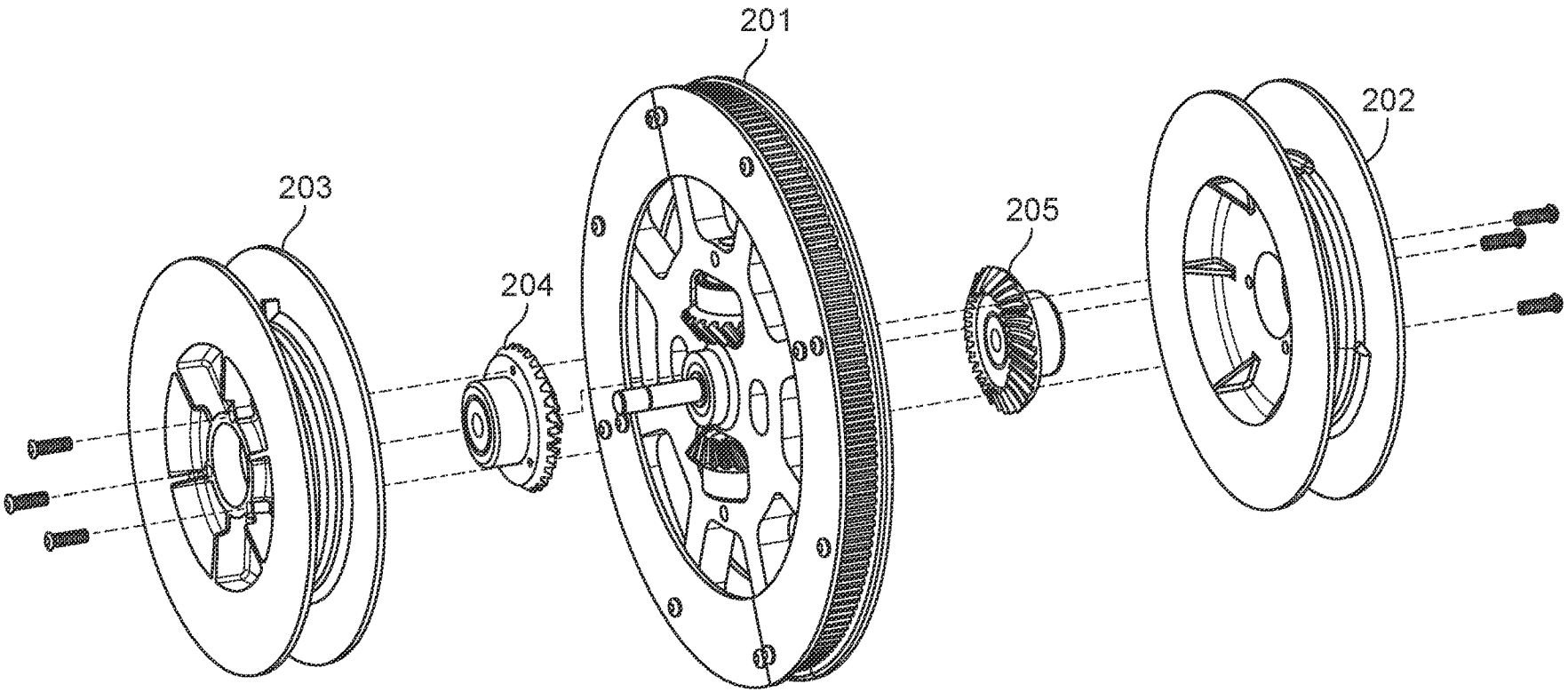

FIG. 12H illustrates an exploded perspective view drawing of the sun gears (204, 205) respectively bonded to spools (202, 203) and assembled with sprocket (201).

Figure 12I:
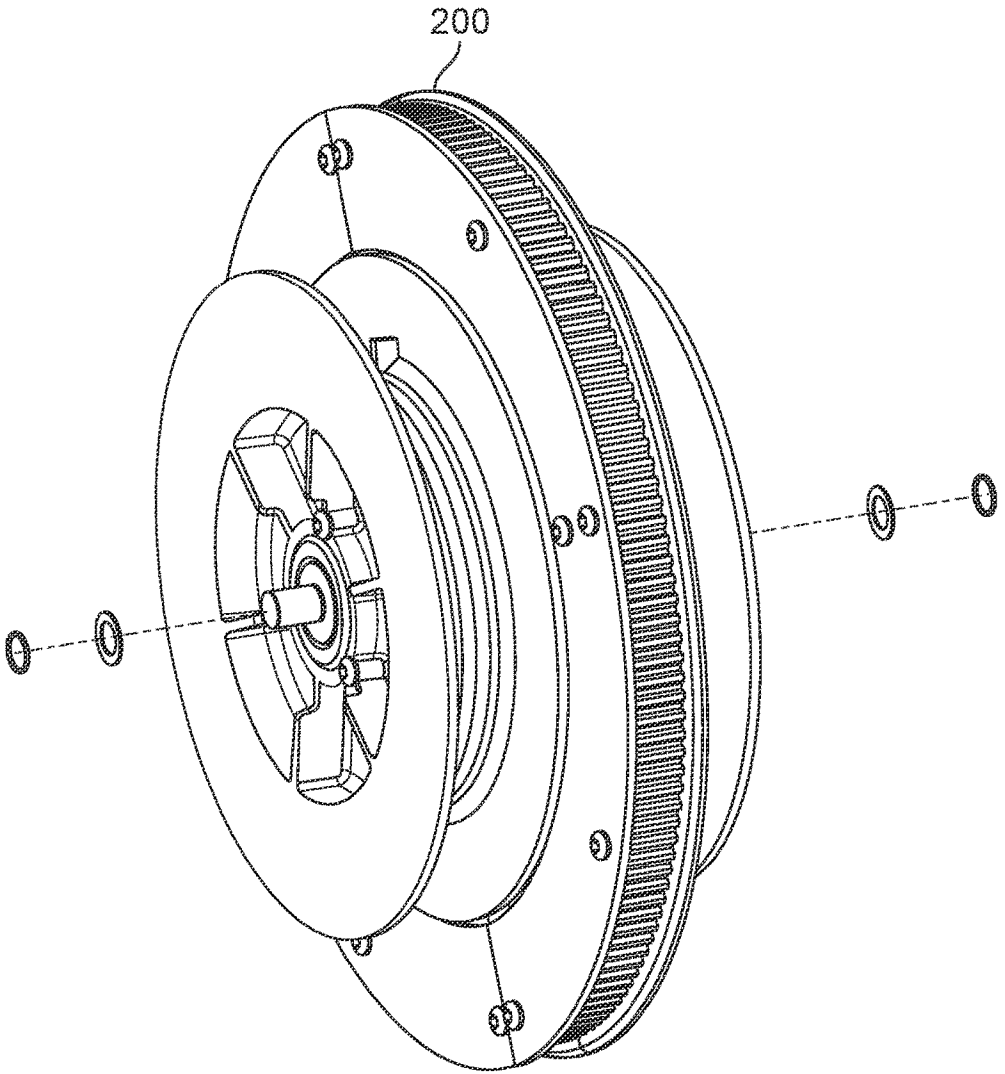

FIG. 12I illustrates an exploded perspective view drawing of the assembled differential (200) with finishing features.

Figure 13A:
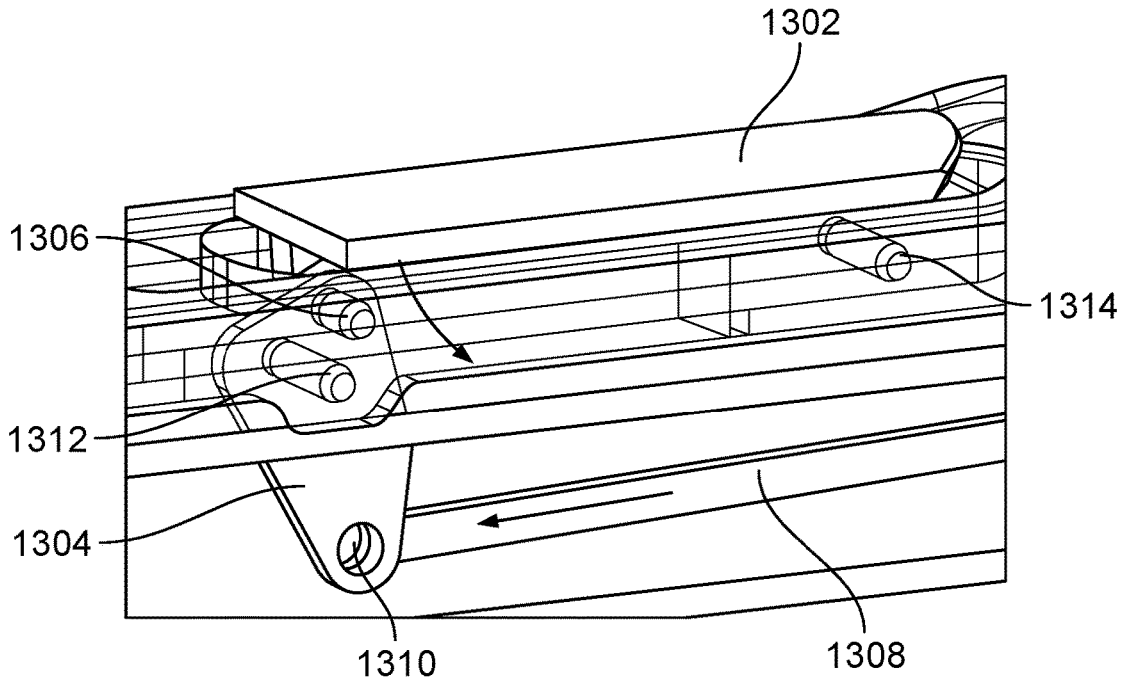
Figure 13B:
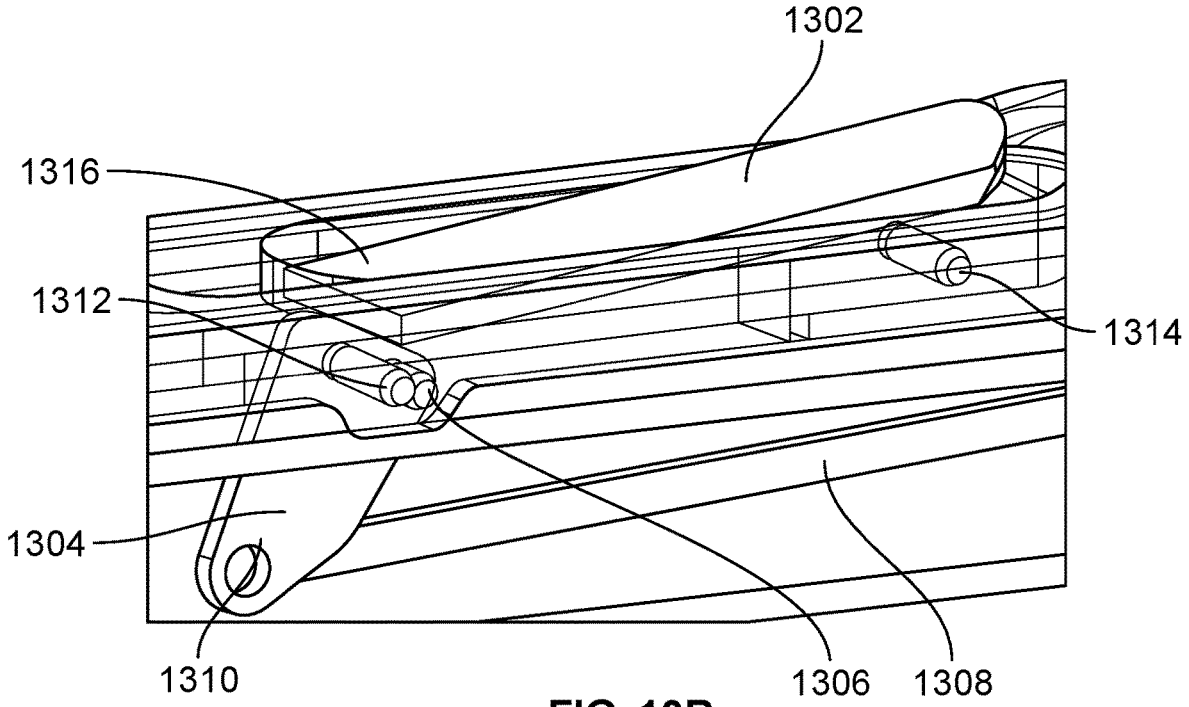
Figure 13C:
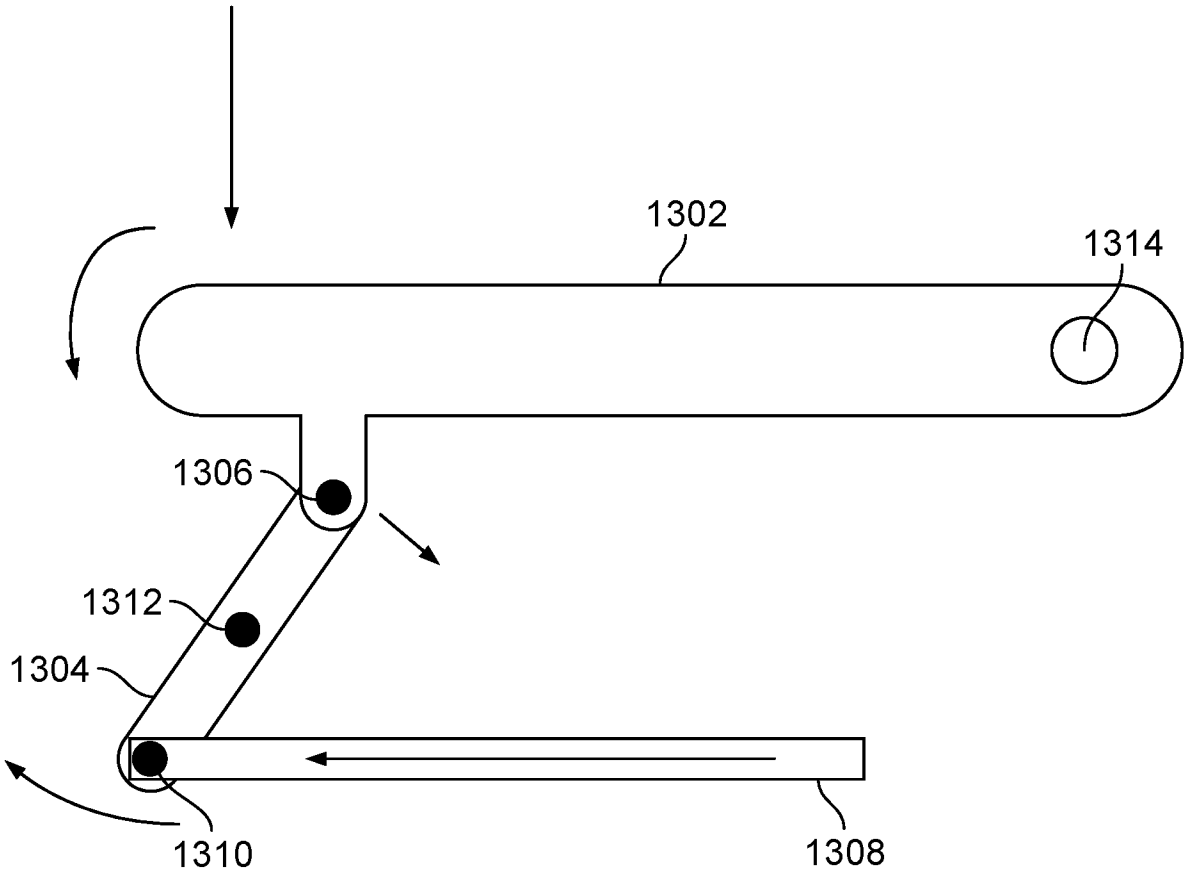

FIGS. 13A-13C illustrate embodiments of controls for unlocking adjustment of an arm.

Figure 14A:
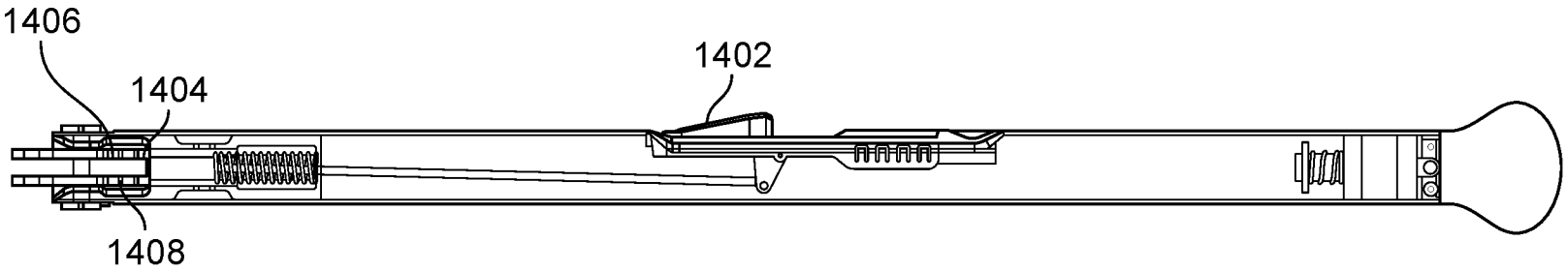

FIG. 14A illustrates an embodiment of an adjustable arm.

Figure 14B:
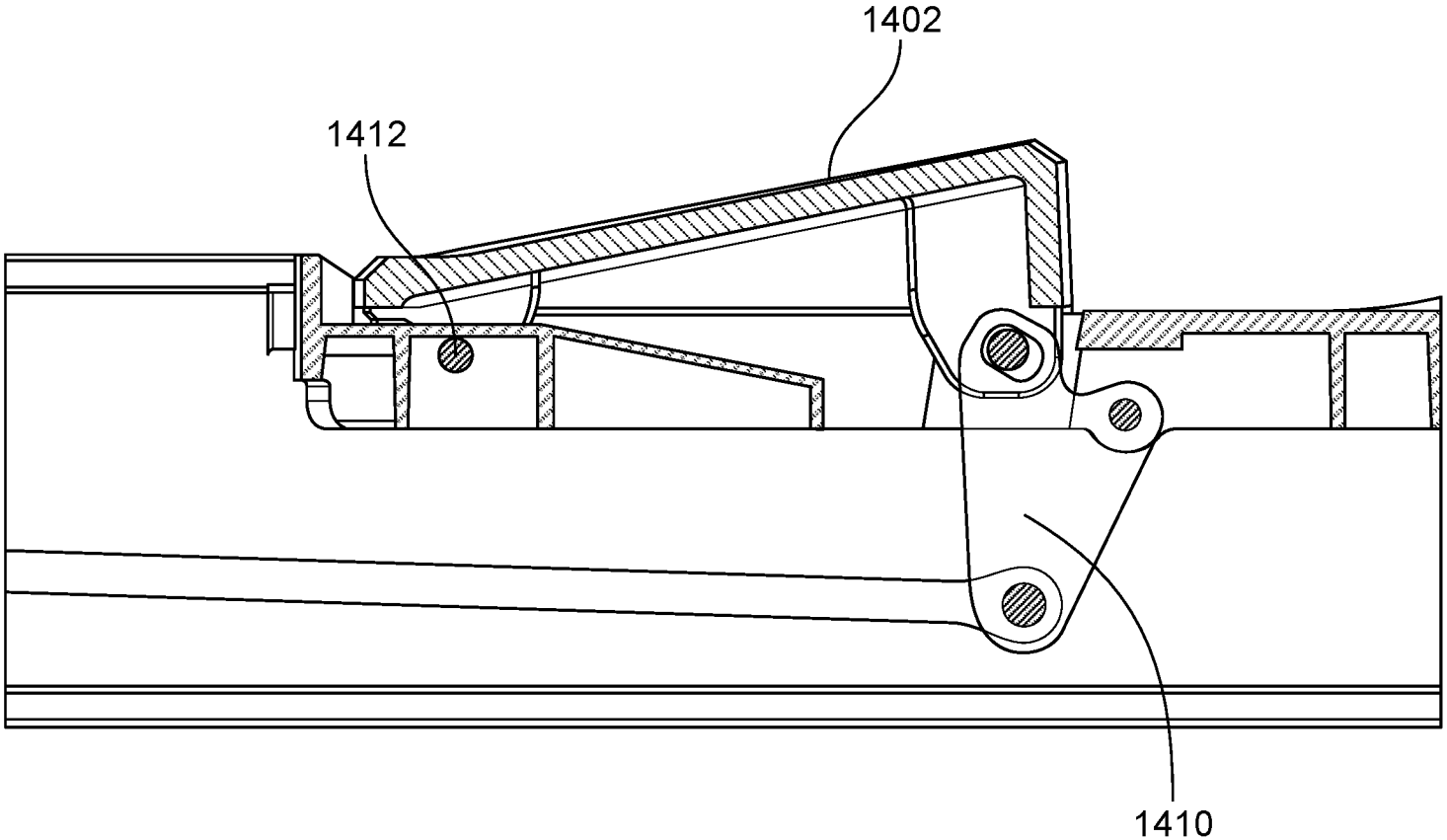

FIG. 14B illustrates an embodiment of a user control.

Figure 14C:
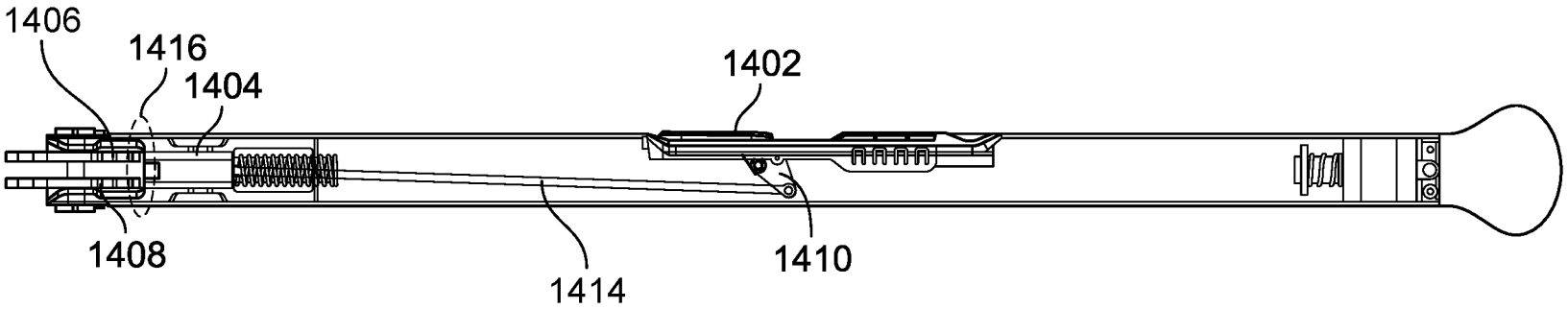

FIG. 14C illustrates an embodiment of an adjustable arm.

Figure 14D:
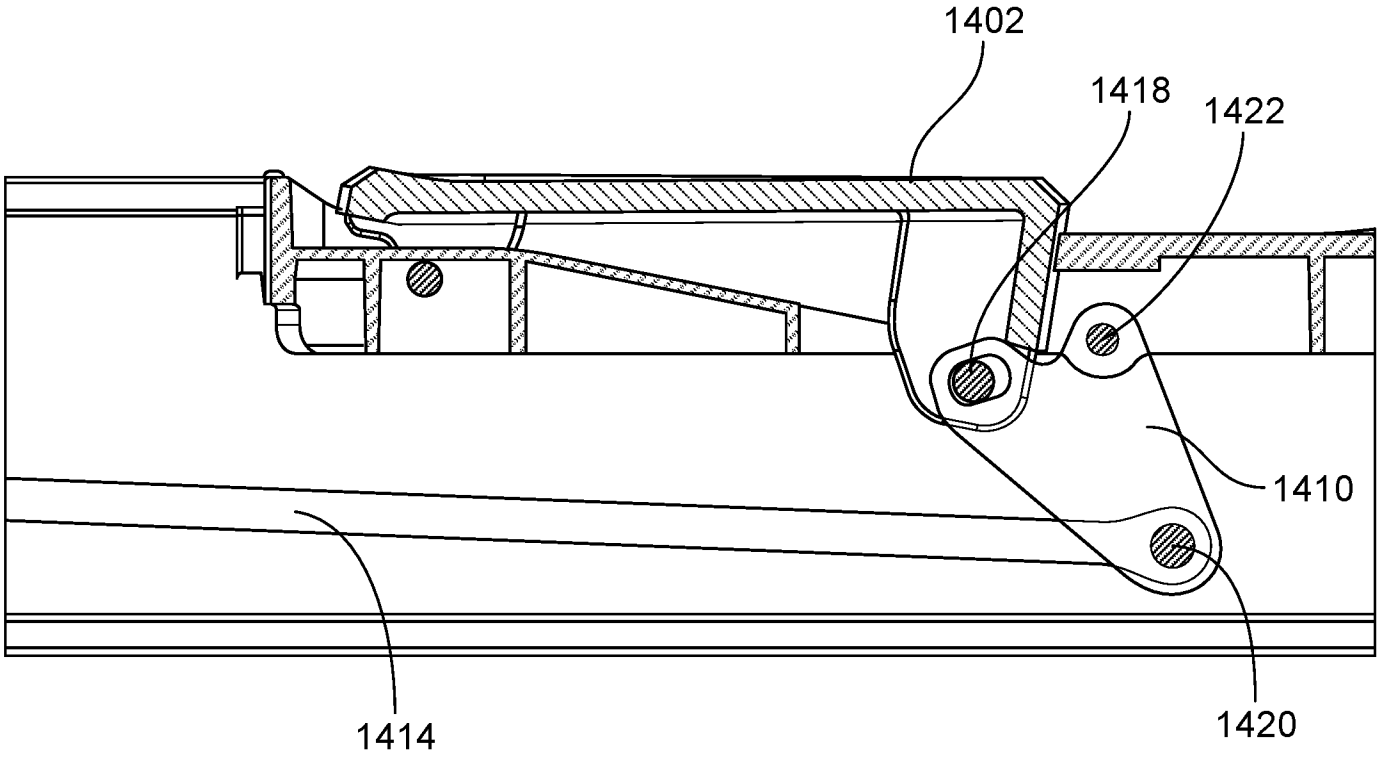

FIG. 14D illustrates an embodiment of a user control.

Figure 14E:
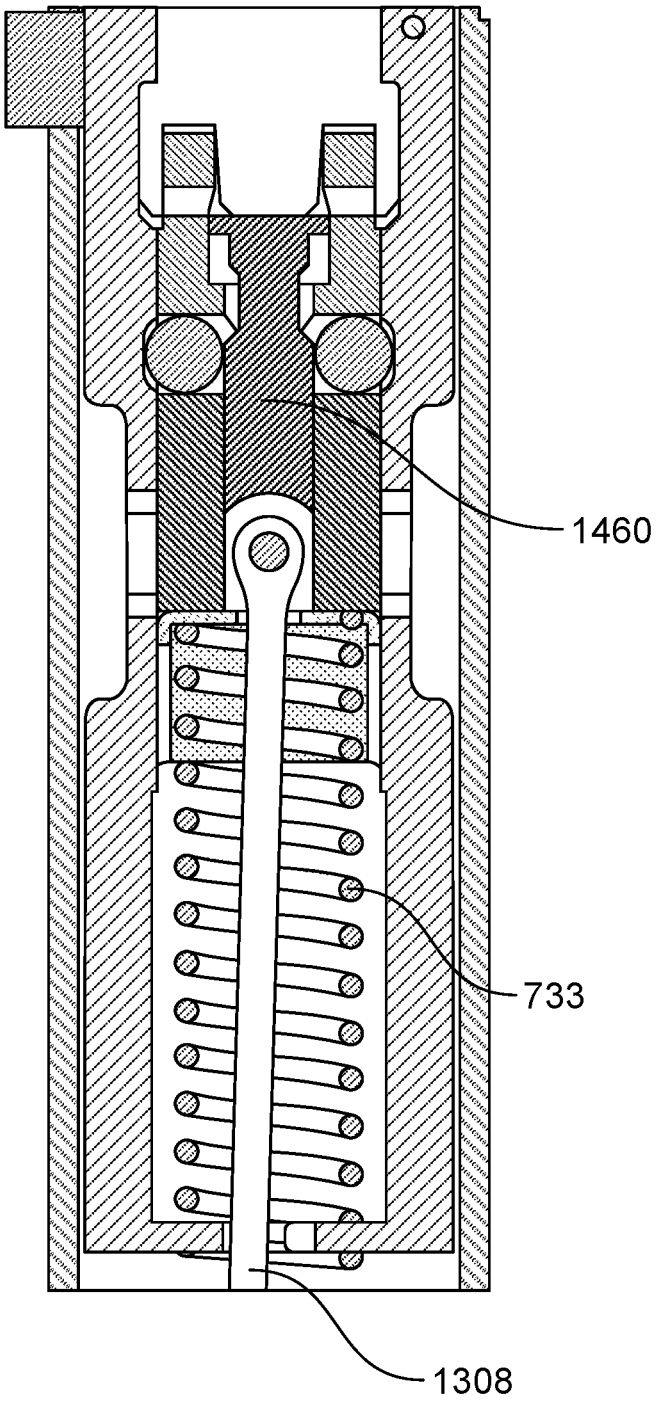

FIG. 14E illustrates an embodiment of an arm vertical pivoting locking mechanism.

Figure 15A:
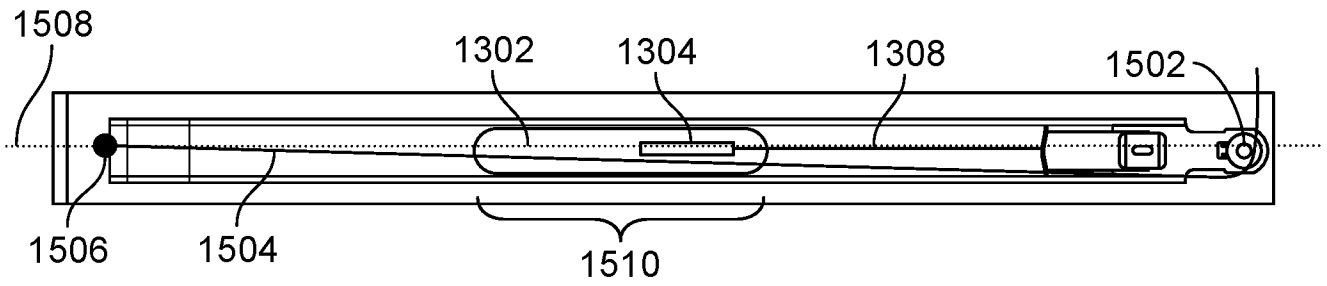

FIG. 15A illustrates an embodiment of a control on the arm for unlocking vertical rotation.

Figure 15B:
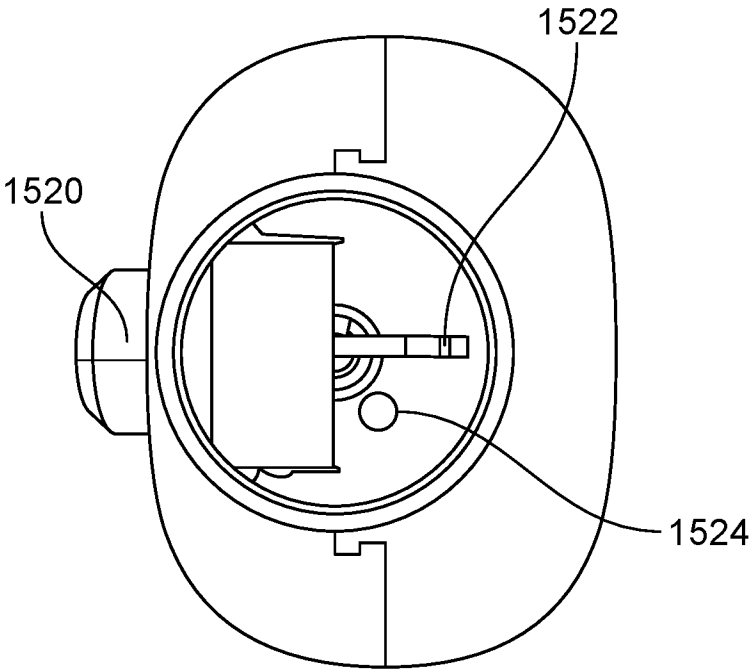

FIG. 15B illustrates an embodiment of an interior view of an arm.

Figure 16A:
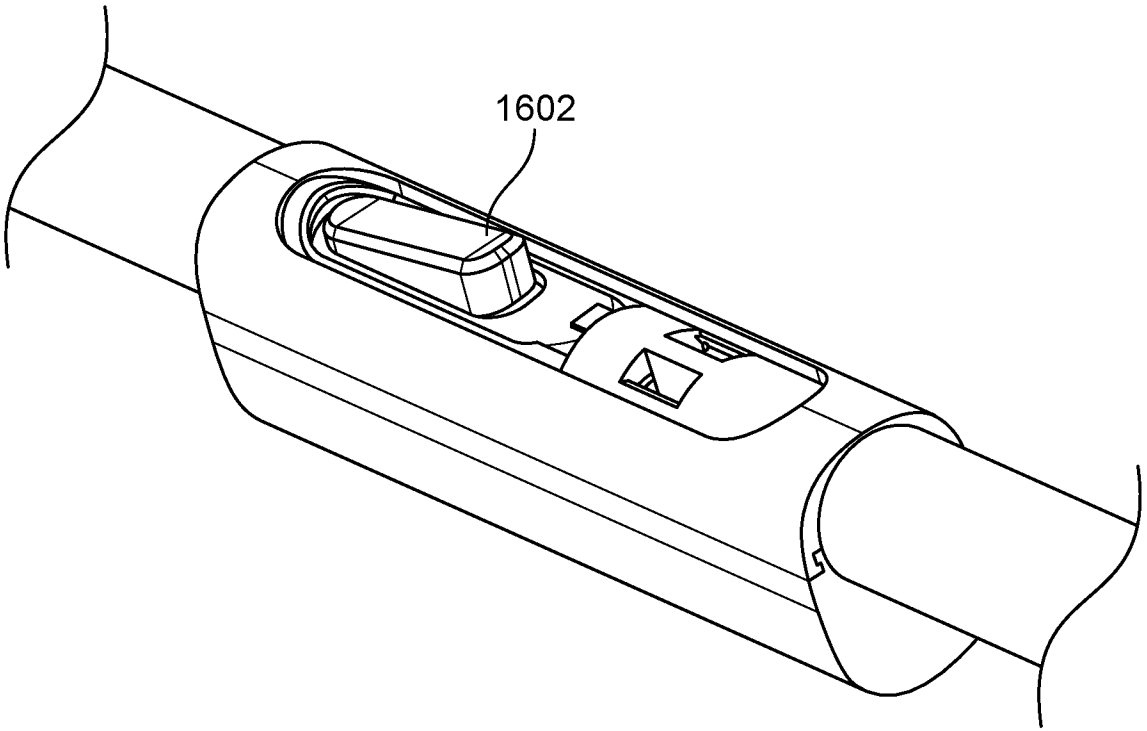

FIG. 16A illustrates an embodiment of a control on the top of the arm.

Figure 16C:
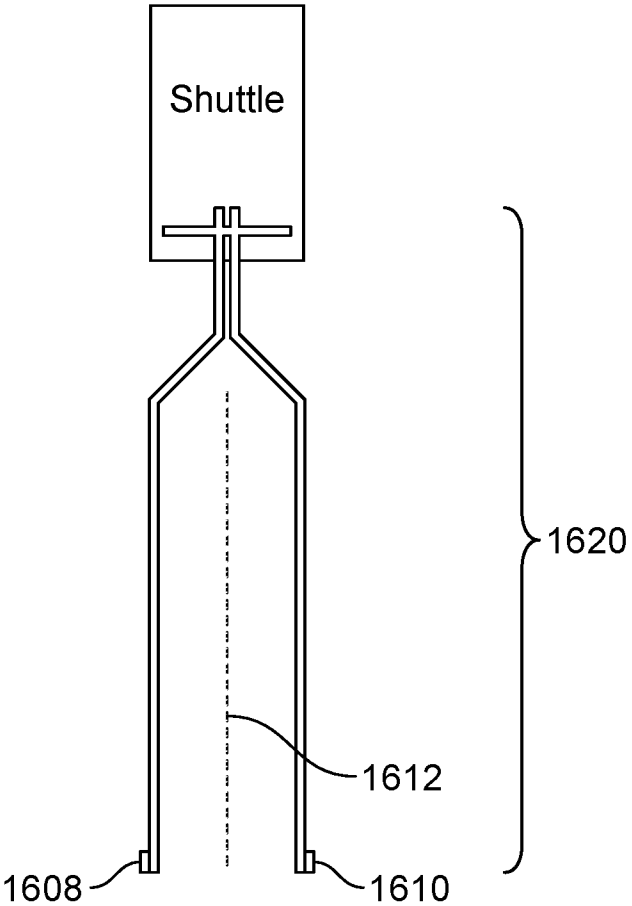
Figure 16B:
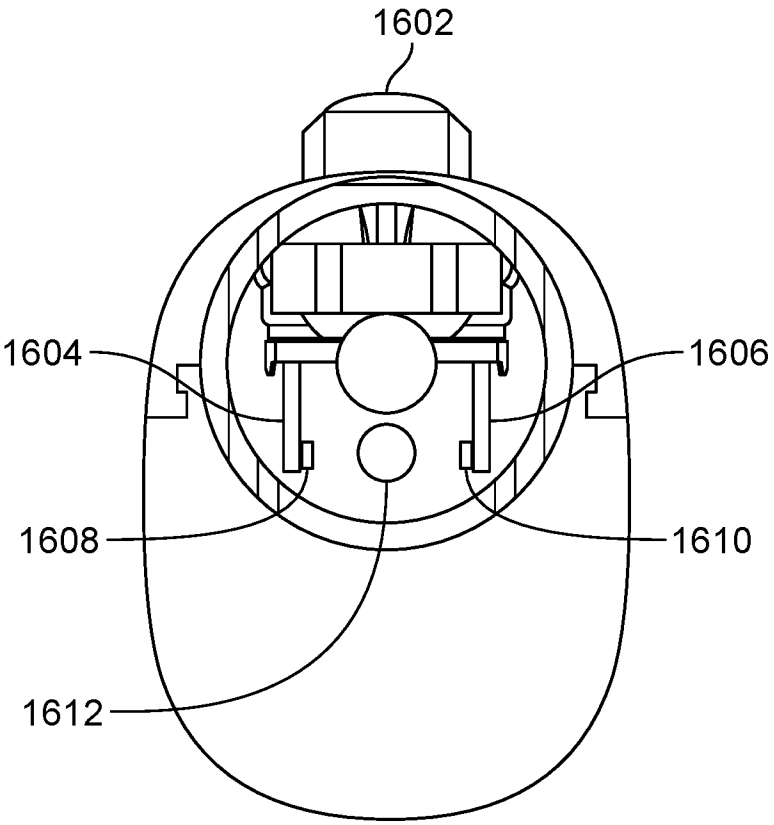

FIGS. 16B and 16C illustrate embodiments of components for a control on the top of an arm for translating activation force to linear force.

Figure 17A:
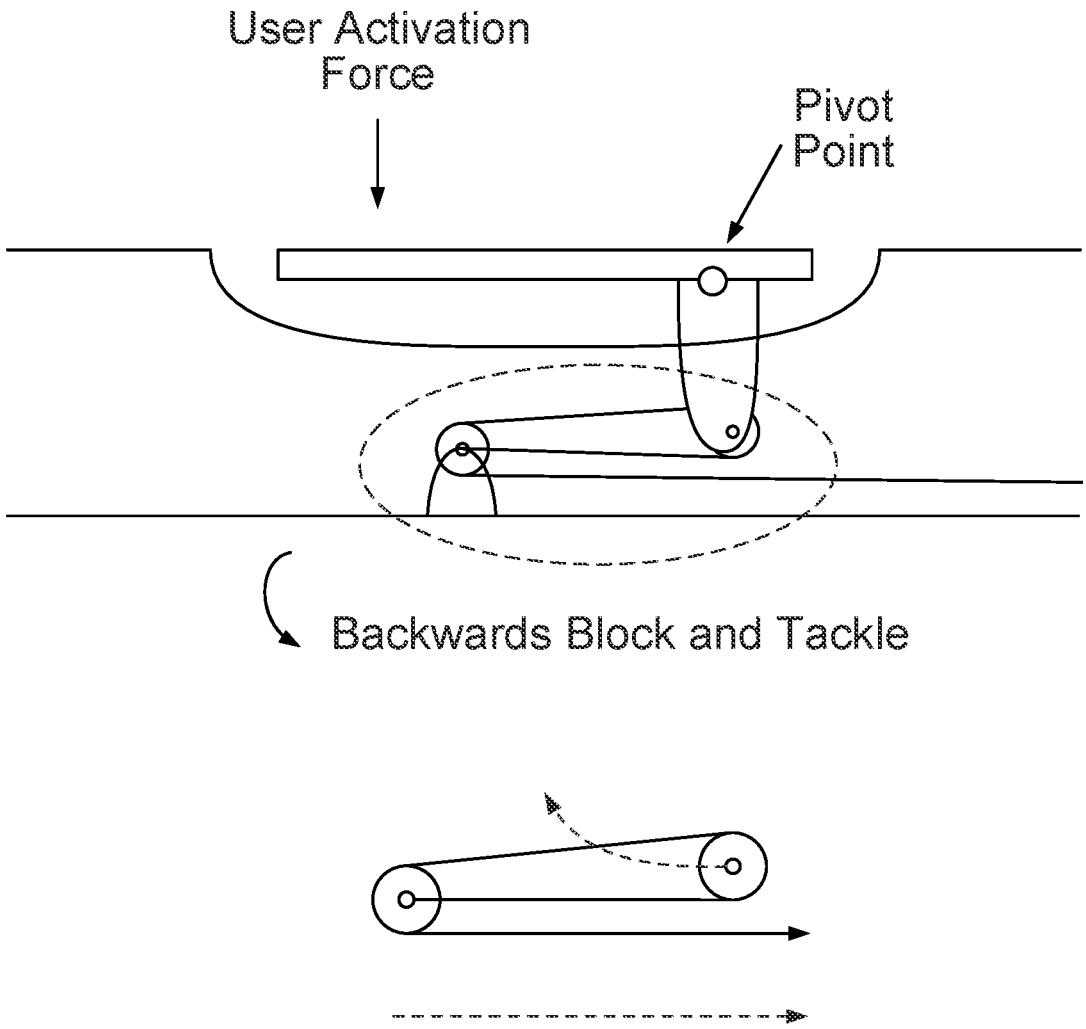
Figure 17B:
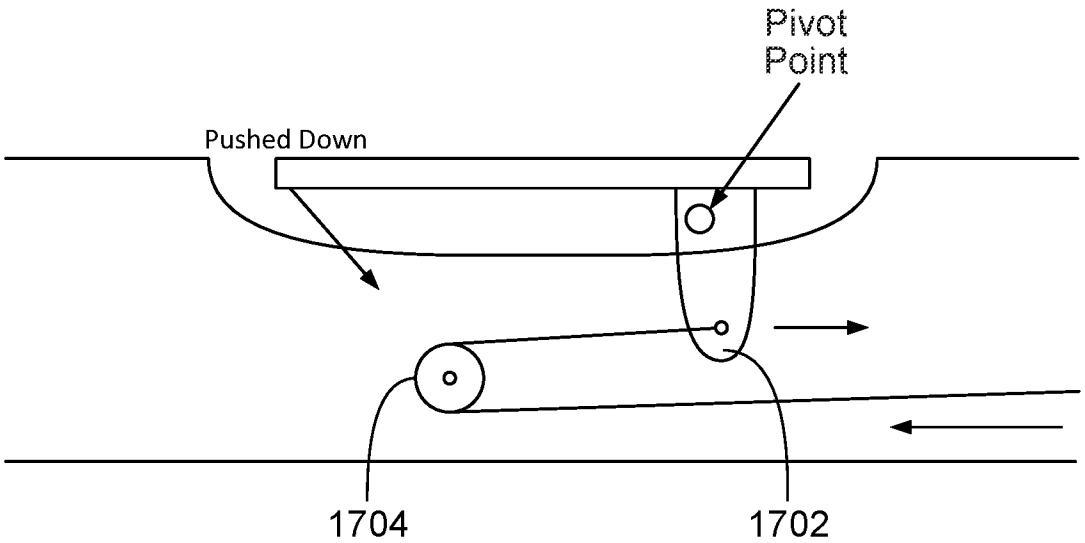

FIGS. 17A and 17B illustrate embodiments of cable over bearing mechanisms for mechanical conversion of lever rotation to linear travel of a locking mechanism.

Figure 17C:
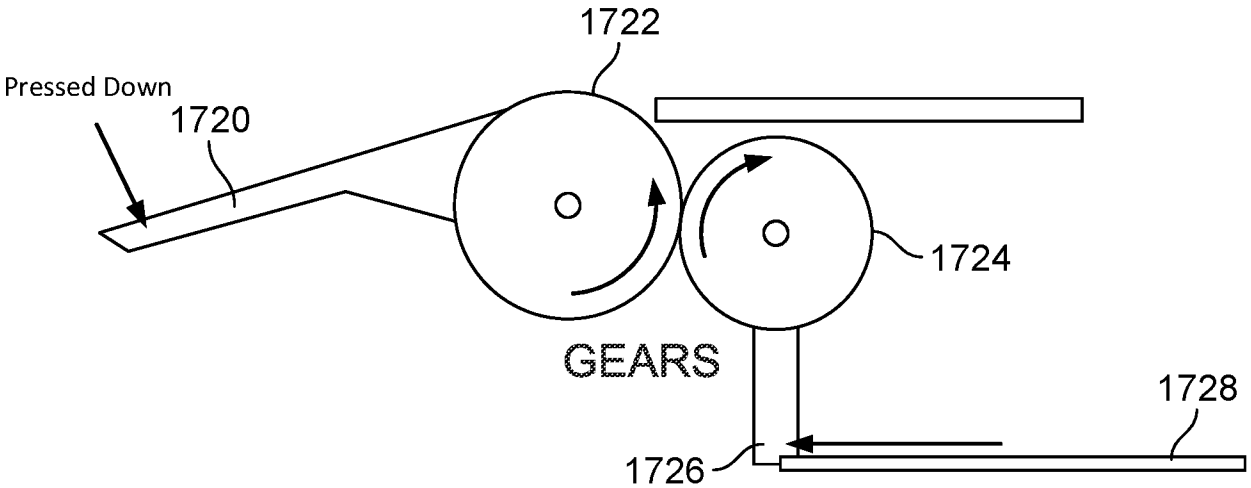

FIG. 17C illustrates an embodiment of a gear-based mechanism for mechanical conversion of lever rotation to linear travel of a locking mechanism.

Figure 17D:
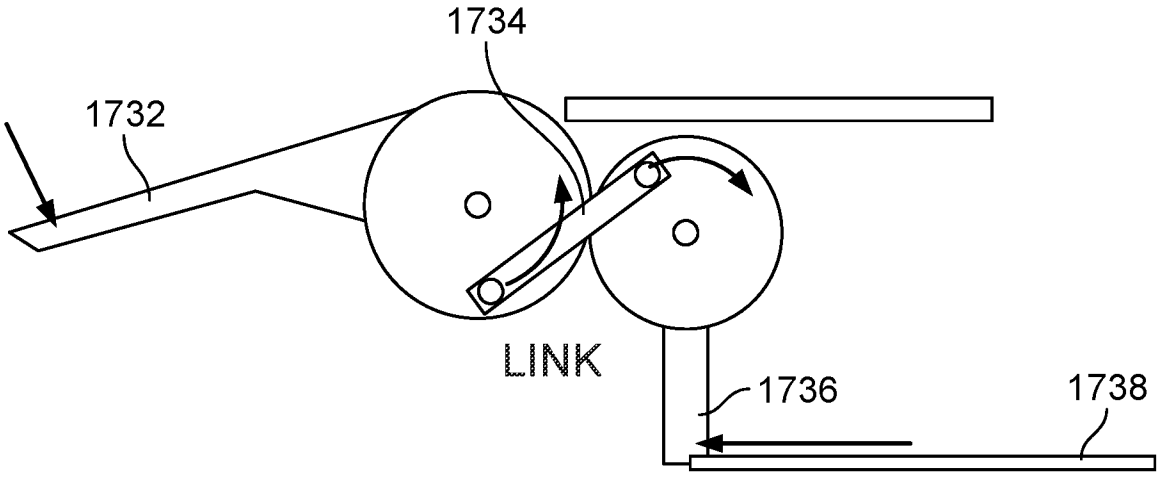

FIG. 17D illustrate an embodiment of a rotating linkage mechanism for mechanical conversion of lever rotation to linear travel of a locking mechanism.

Figure 18:
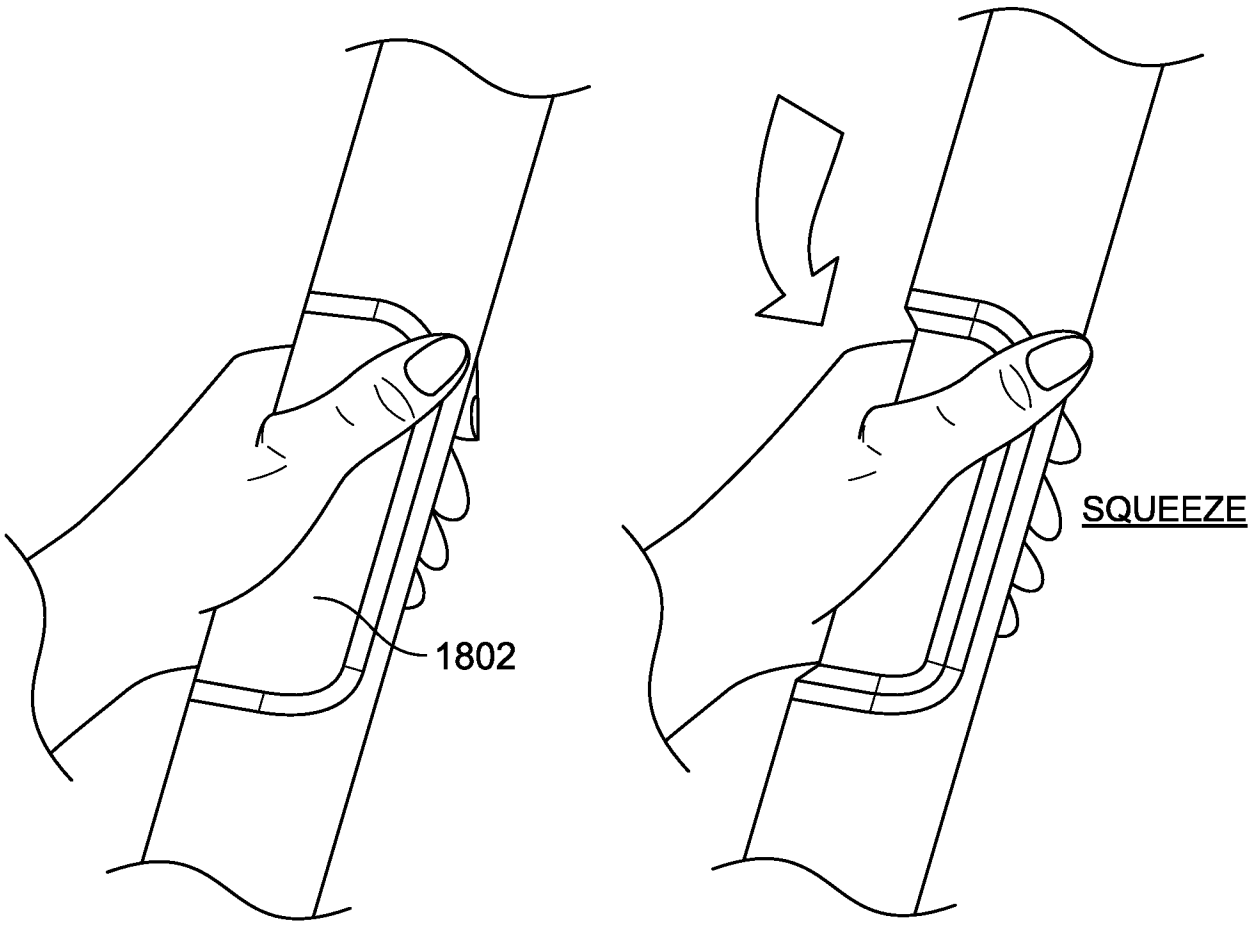

FIG. 18 illustrates an embodiment of a squeeze control button.

Figure 19A:
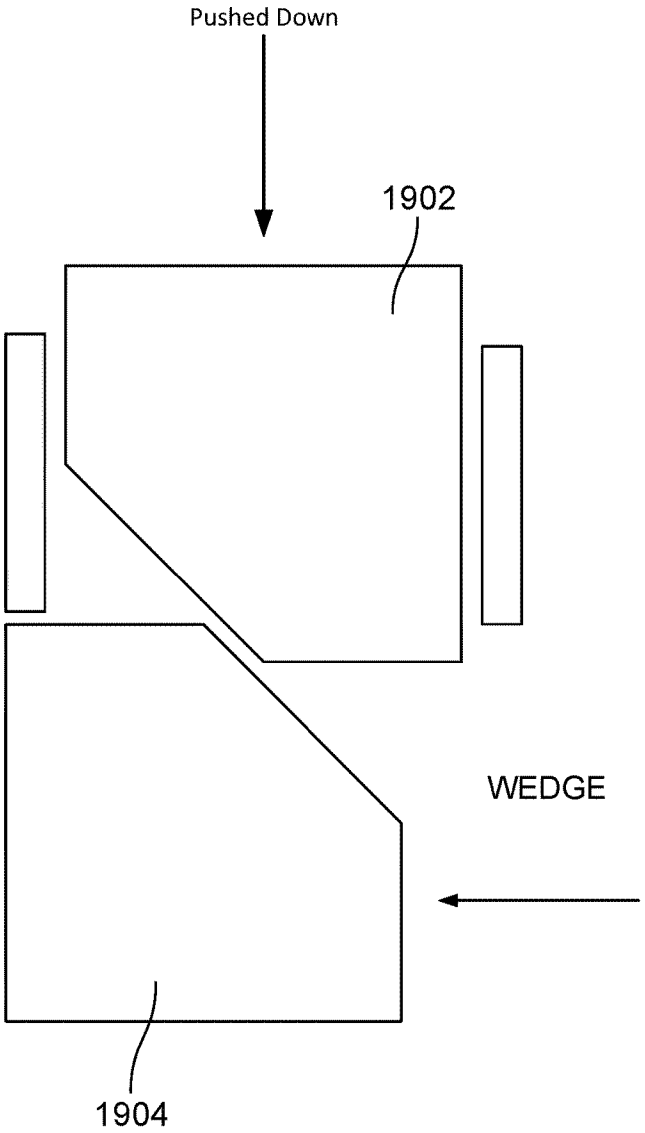

FIG. 19A illustrates an embodiment of a wedge mechanism for force translation.

Figure 19B:
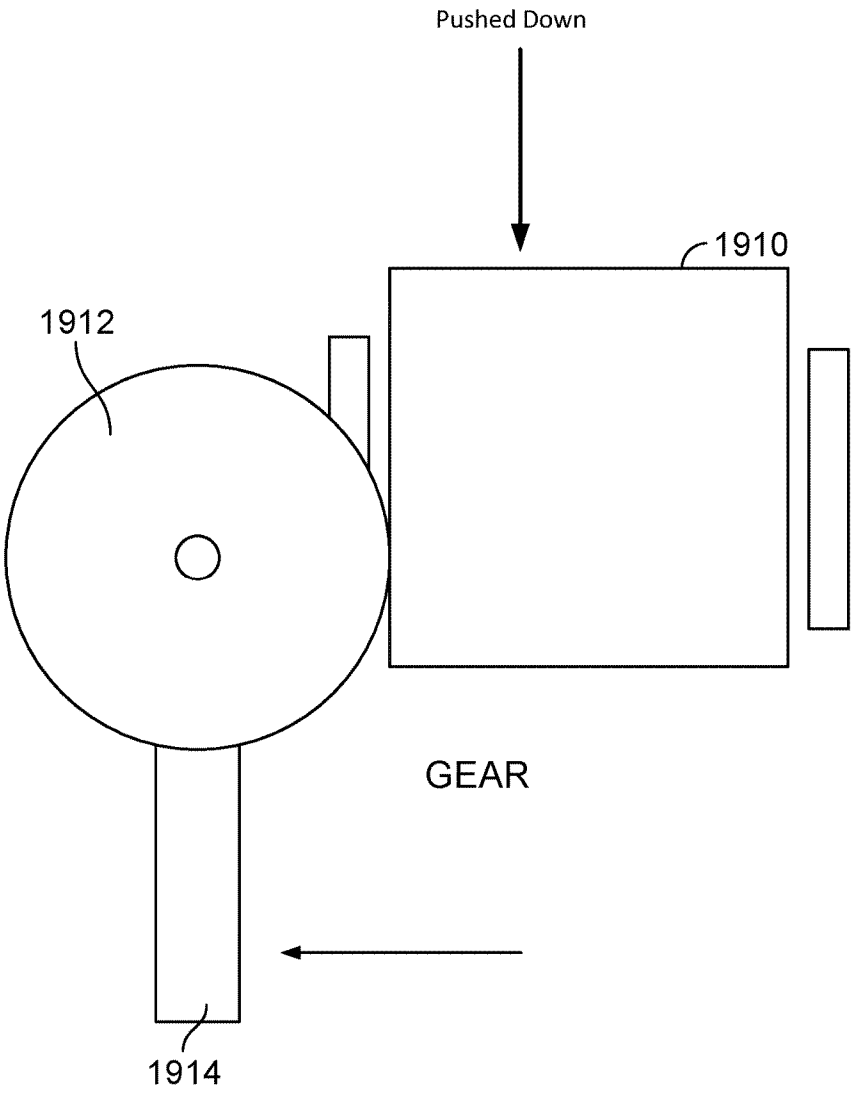

FIG. 19B illustrates an embodiment of a gear-based mechanism for force translation.

Figure 19C:
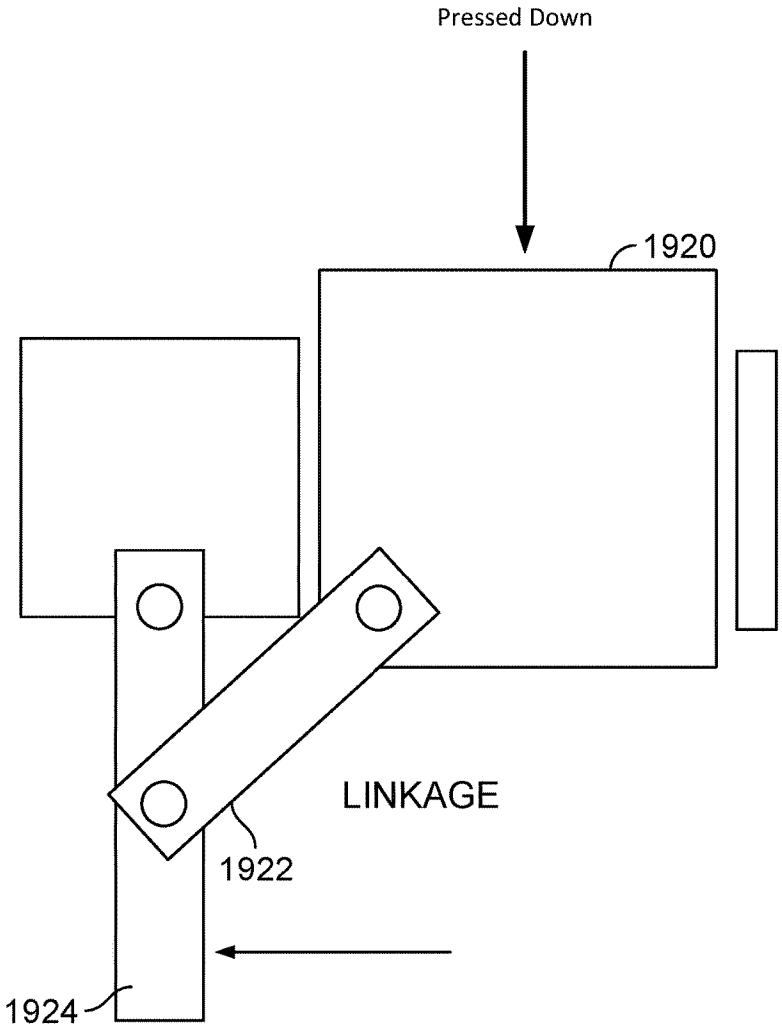

FIG. 19C illustrates an embodiment of a linkage-based mechanism for force translation.

Figure 19D:
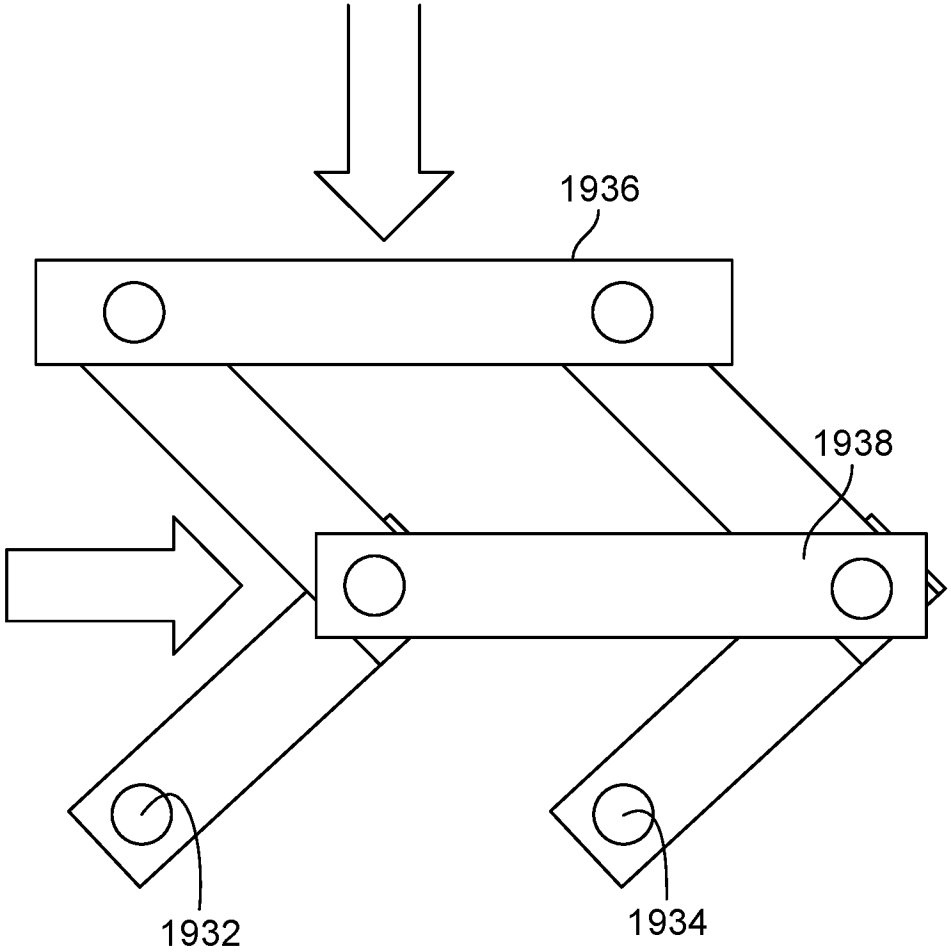

FIG. 19D illustrates an embodiment of a scissor mechanism for force translation.

Figure 19E:
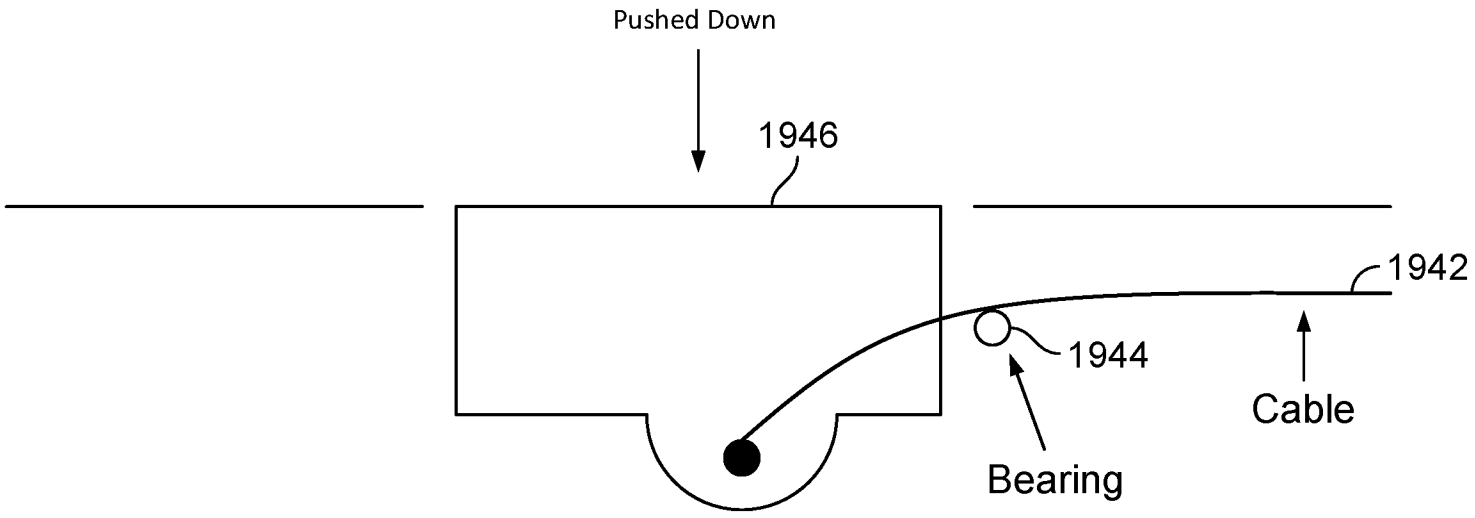

FIG. 19E illustrates an embodiment of a cable-based mechanism for force translation.

Figures 19F, 19G:
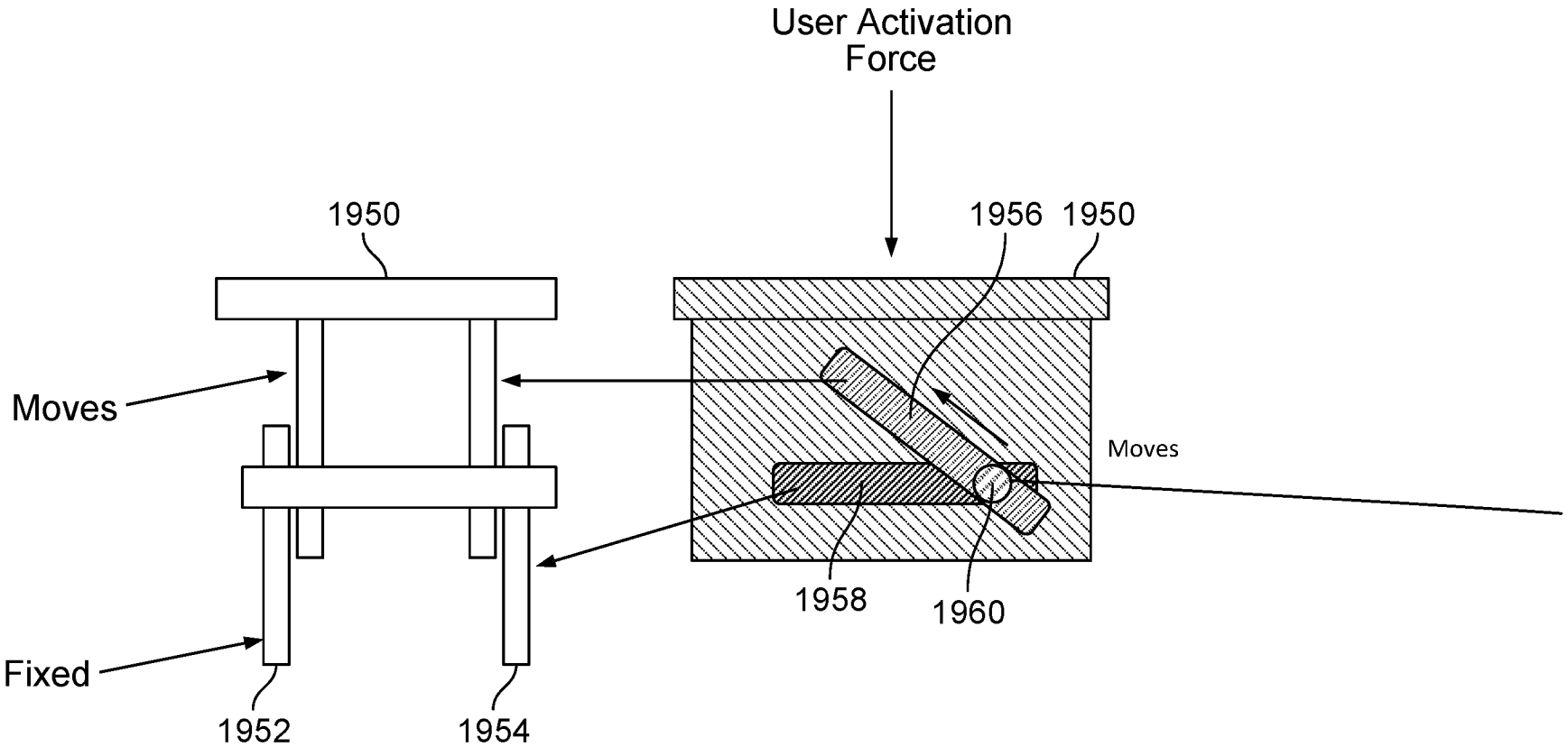

FIGS. 19F and 19G illustrate embodiments of a cam follower-based mechanism for force translation.

Figure 20B:
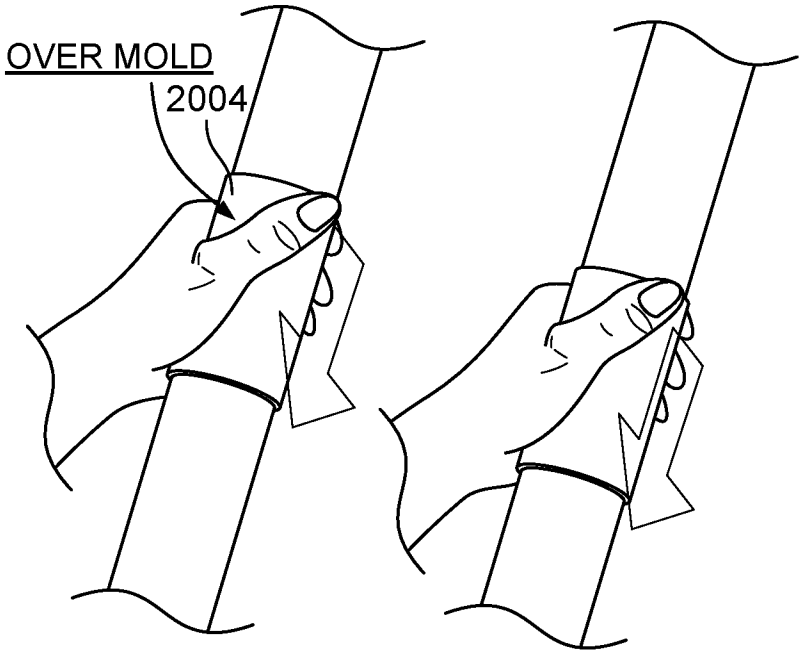
Figure 20A:
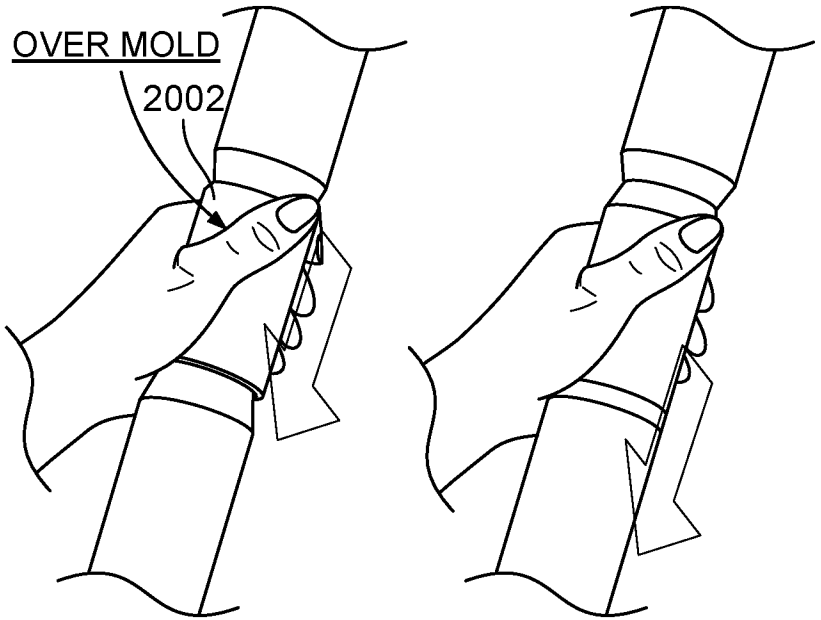

FIGS. 20A and 20B illustrate embodiments of sleeve-based controls for arm adjustment.

Figure 20C:
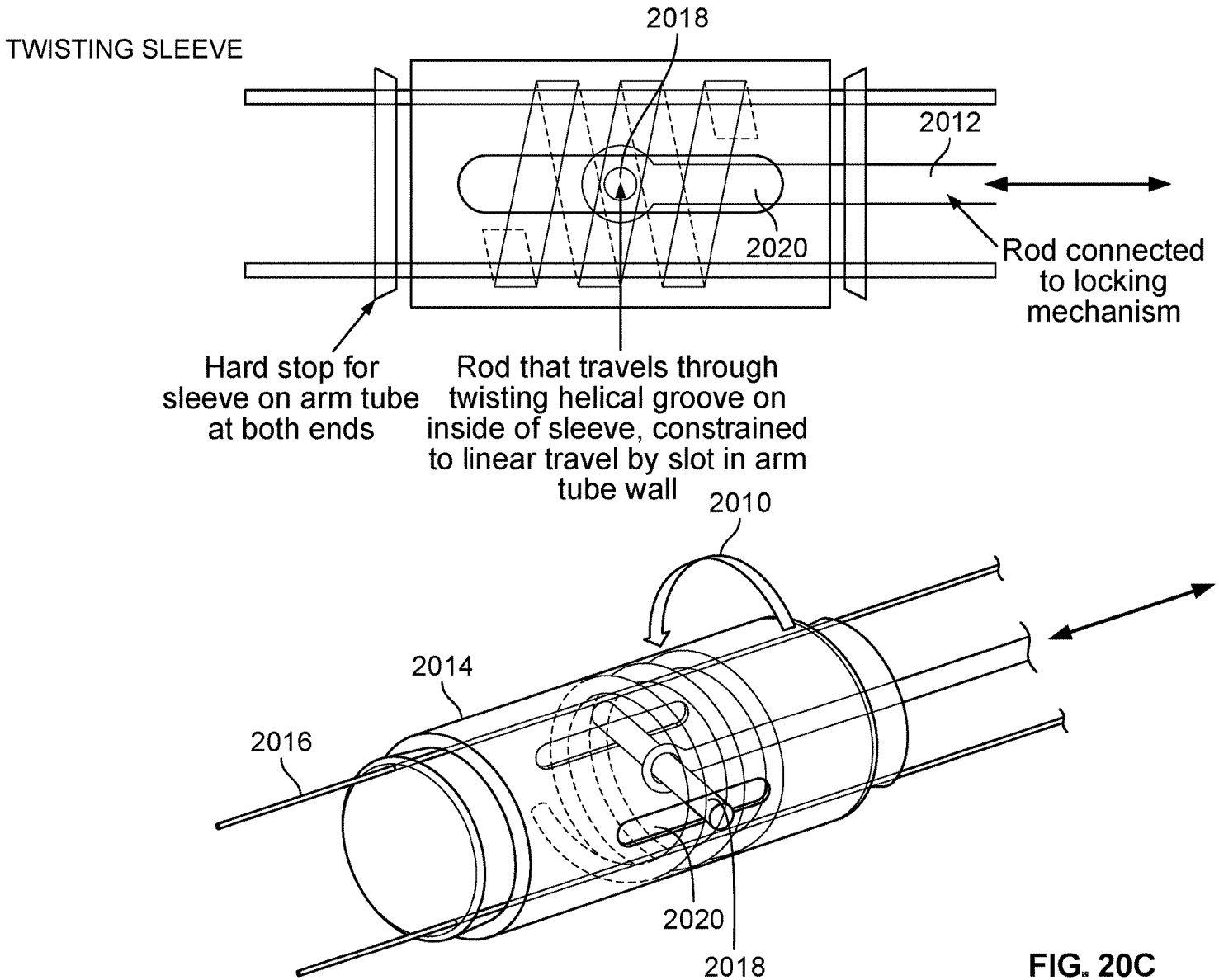

FIG. 20C illustrates an embodiment of a rotating sleeve-based control.

Figure 21:
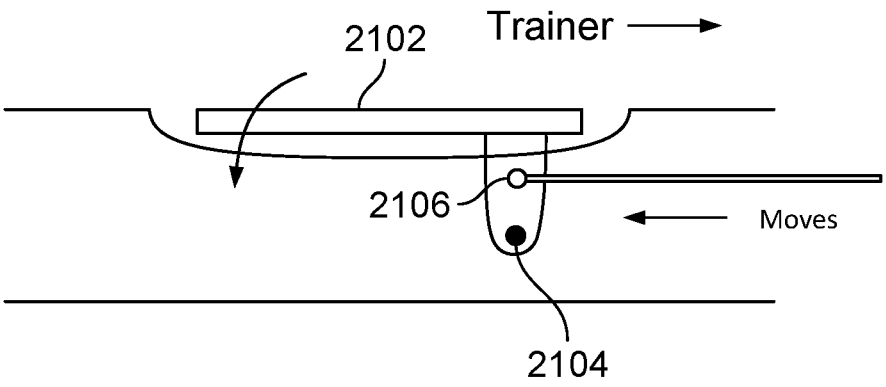

FIG. 21 illustrates an embodiment of a control.

Figure 22A:
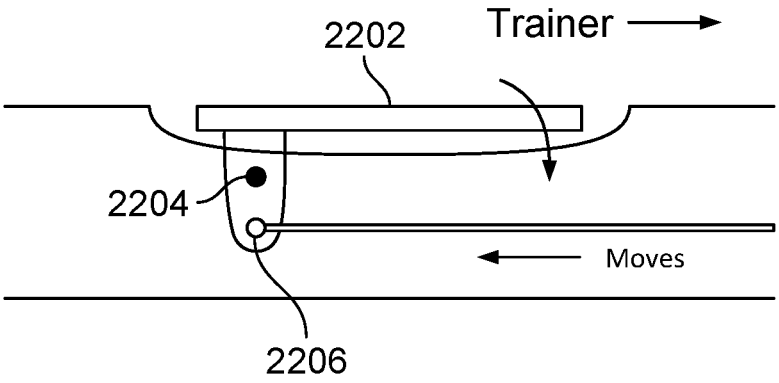

FIG. 22A illustrates an embodiment of a control.

Figure 22B:
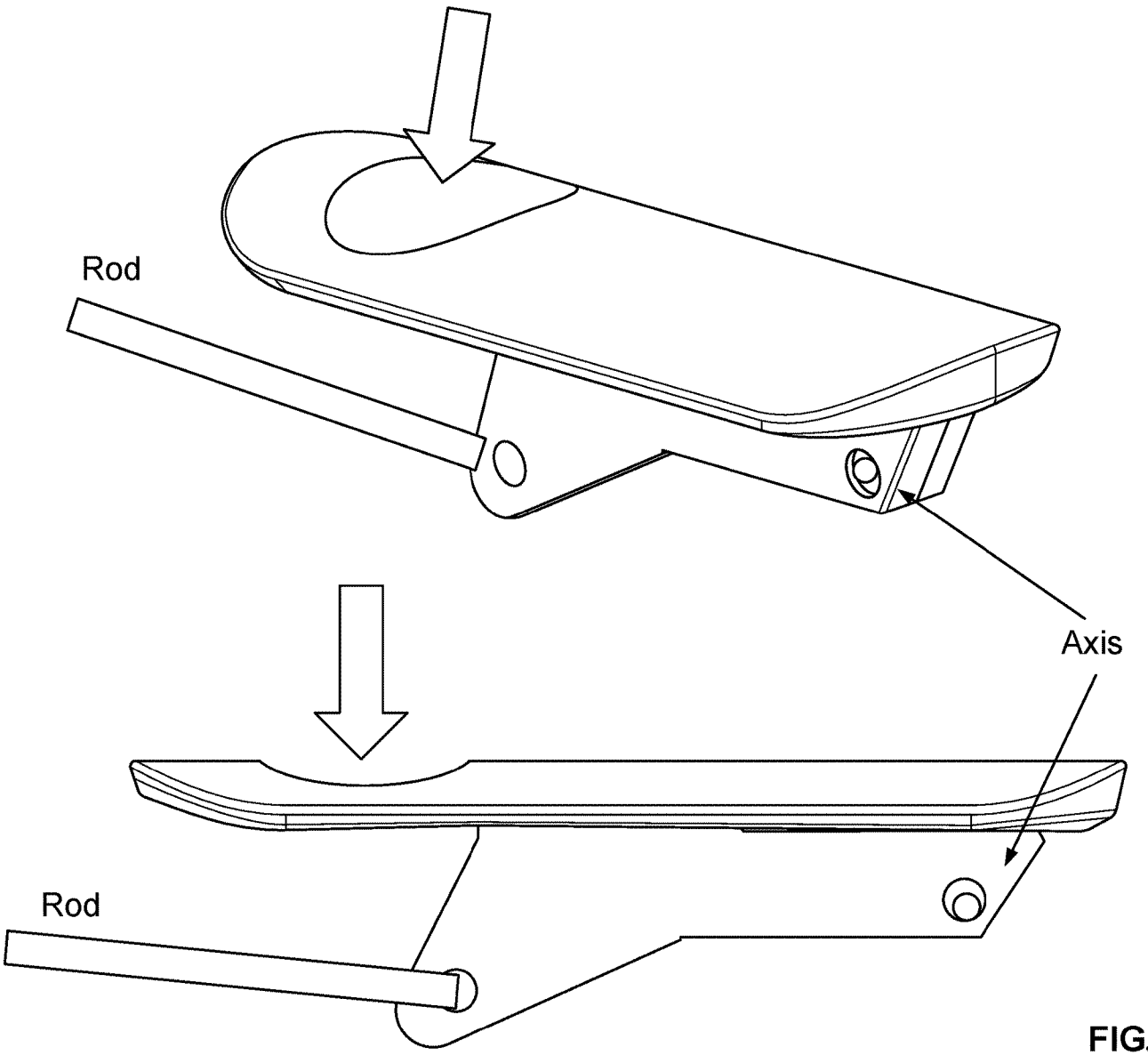

FIG. 22B illustrates embodiments of a control.

Figure 22C:
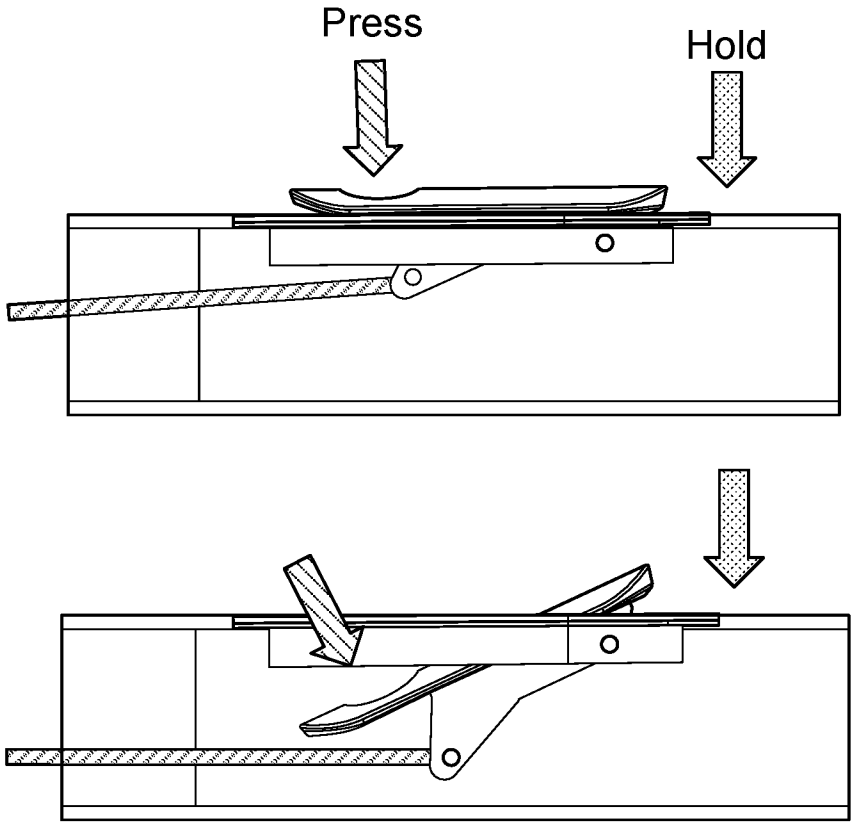
Figure 22C:
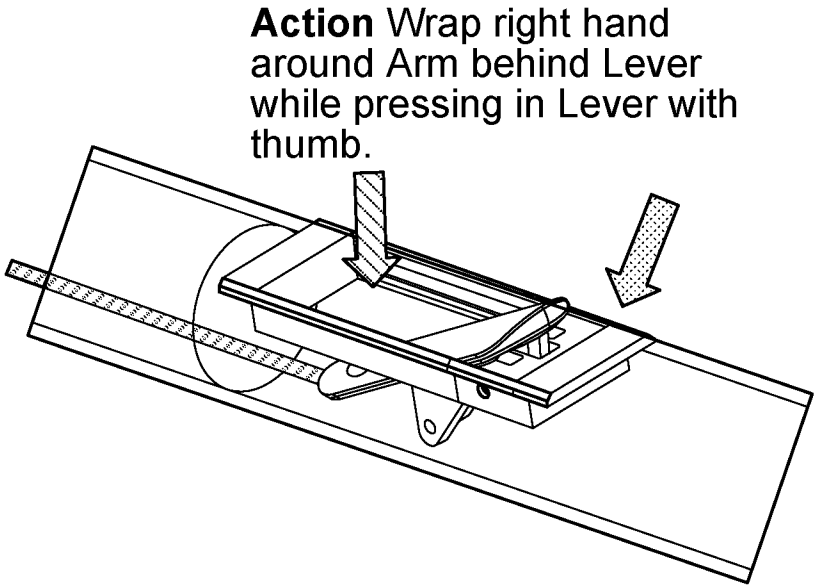

FIG. 22C illustrates embodiments of a control.

Figure 23:
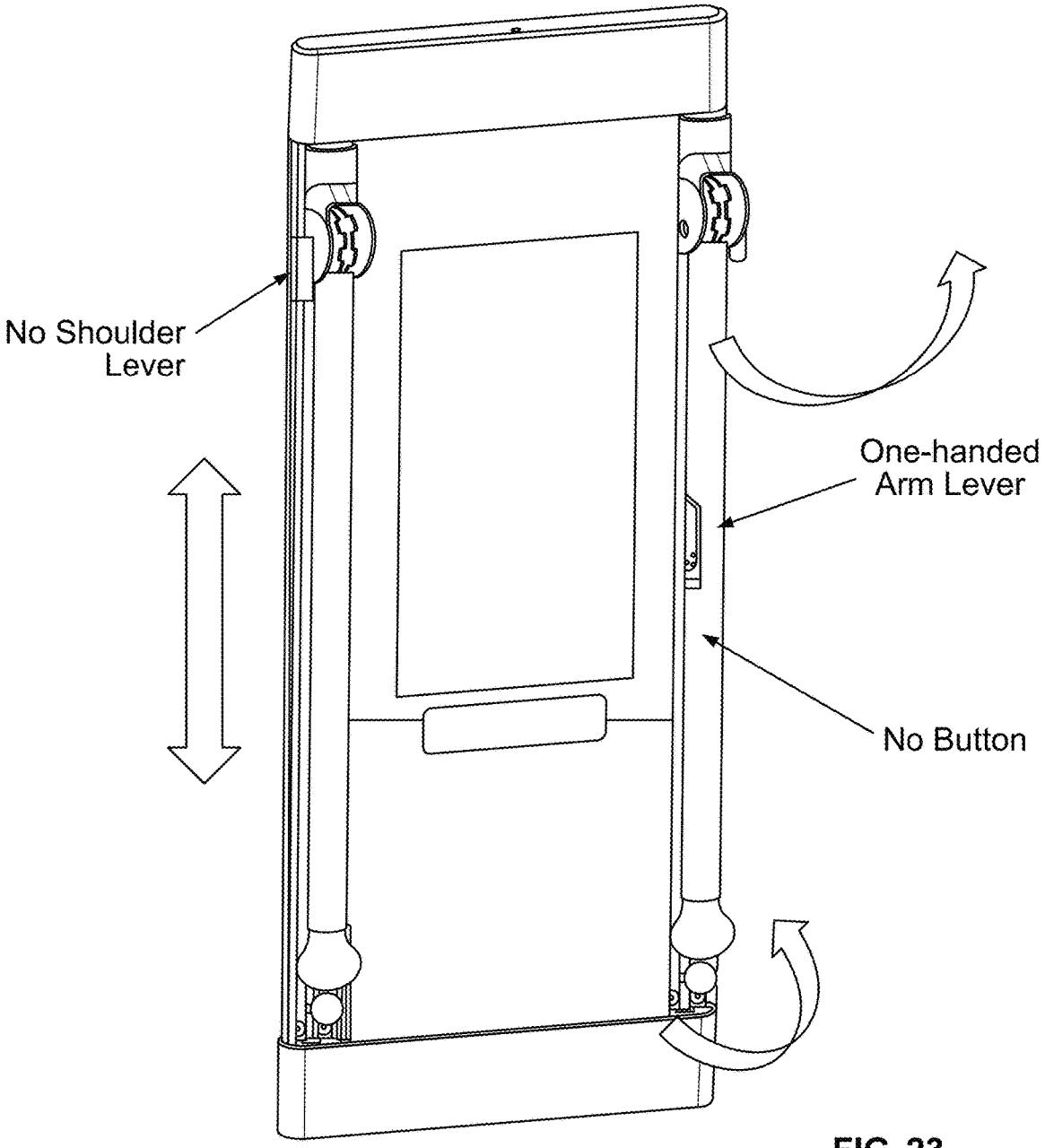

FIG. 23 illustrates an embodiment of an exercise machine with one-handed arm adjustment.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Traditionally, the majority of strength training methods and/or apparatuses fall into the following categories:

- Body Weight: Nothing in addition to the gravitational force of body weight is used to achieve resistance training. Pull-ups are a good example of this. Some systems such as TRX provide props that may help one better achieve this;
- Free weights: A traditional example are dumbbells, which also operate using gravity as a force. The tension experienced by a user throughout a range of motion, termed throughout this specification as an "applied tension curve", varies depending on the angle of movement and/or the direction of gravity. For some motion, such as a bicep curl, the applied tension curve is particularly variable: for a bicep curl it starts at near zero when the arm is at full extension, peaks at 90 degrees, and reduces until the arm reaches full curl at near zero again;
- Fixed-track machine: Machines that use weights, for example plates of metal comprising a weight stack, coupled by a cable attached to a cam joined to a mechanism running on a pivot and/or track. These often have a fixed applied tension curve, though some systems such as Nautilus have used oddly shaped cams in order to achieve non-linear applied tension curves. Often a weight setting is selected for a weight stack by using a pin inserted associated with a desired plate; and
- Cable-machines: Also known as gravity-and-metal based cable-machines, these are a cross between free weights and fixed track machines. They comprise a weight stack attached to a cable, often via a pulley system which may be adjustable in height or direction. Fixed-track machines have historically been criticized by some for overly isolating a single muscle. Free weights on the other hand have historically been criticized by some for activating too many small stabilizer muscles, meaning that a user's workout may be limited by these small muscles before the large ones have even gotten a good workout. Cables do not run on a track, and thus still require some use of stabilizer muscles, but not as much as free weights because the direction of pull is strictly down the cable. The effective applied tension curves varies if the angle of attack between a user's hand and the cable changes throughout the range of motion.

While gravity is the primary source of tension and/or resistance in all of the above, tension has also been achieved using springs and/or flexing nylon rods as with Bowflex, elastics comprising rubber bands/resistance bands as with TheraBand, pneumatics, and hydraulics. These systems have various characteristics with their own applied tension curve.

Electronic Resistance. Using electricity to generate tension/resistance may also be used, for example, as described in U.S. patent application Ser. No. 15/655,682, entitled DIGITAL STRENGTH TRAINING filed Jul. 20, 2017, now U.S. Pat. No. 10,661,112, which is incorporated herein by reference for all purposes. Examples of electronic resistance include using an electromagnetic field to generate tension/resistance, using an electronic motor to generate tension/resistance, and using a three-phase brushless direct-current (BLDC) motor to generate tension/resistance. The techniques discussed within the instant application are applicable to other traditional exercise machines without limitation, for example exercise machines based on pneumatic cylinders, springs, weights, flexing nylon rods, elastics, pneumatics, hydraulics, and/or friction.

Low Profile. A strength trainer using electricity to generate tension/resistance may be smaller and lighter than traditional strength training systems such as a weight stack, and thus may be placed, installed, or mounted in more places for example the wall of a small room of a residential home. Thus, low profile systems and components are preferred for such a strength trainer. A strength trainer using electricity to generate tension/resistance may also be versatile by way of electronic and/or digital control. Electronic control enables the use of software to control and direct tension. By contrast, traditional systems require tension to be changed physically/manually; in the case of a weight stack, a pin has to be moved by a user from one metal plate to another.

Such a digital strength trainer using electricity to generate tension/resistance is also versatile by way of using dynamic resistance, such that tension/resistance may be changed nearly instantaneously. When tension is coupled to position of a user against their range of motion, the digital strength trainer may apply arbitrary applied tension curves, both in terms of position and in terms of phase of the movement: concentric, eccentric, and/or isometric. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

Figure 1A:
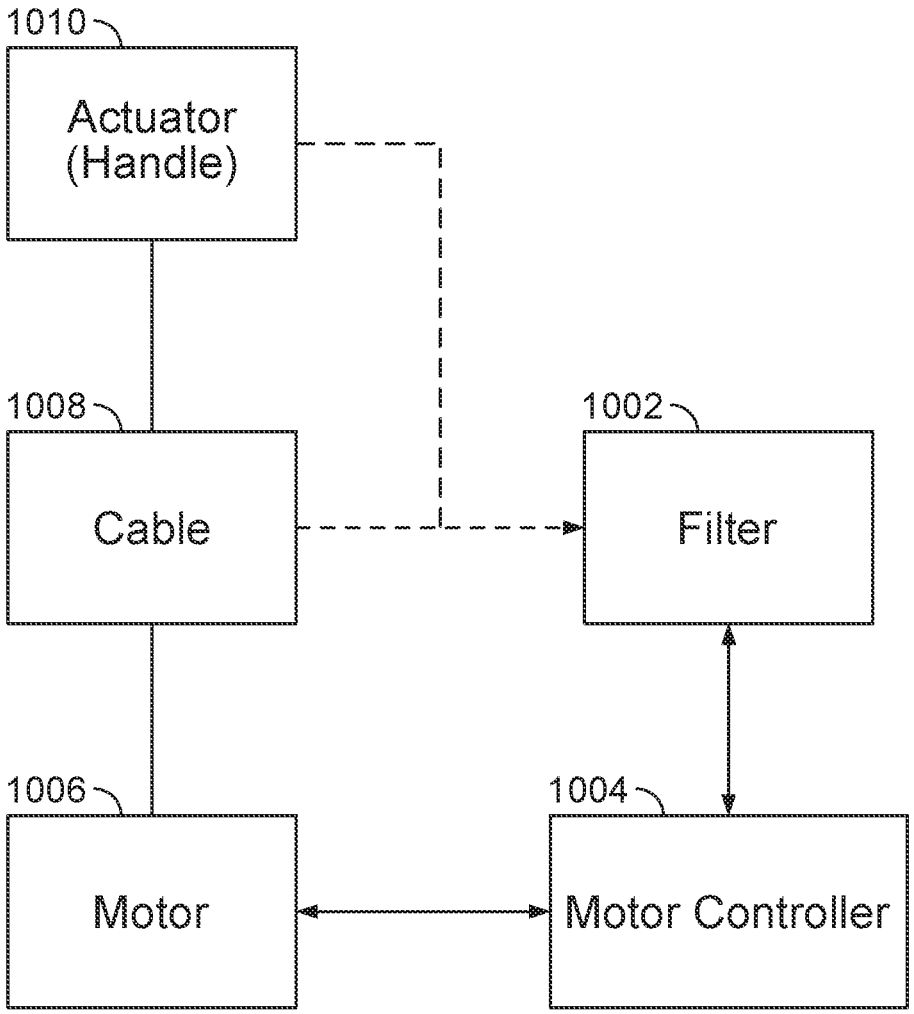
FIG. 1A is a block diagram illustrating an embodiment of an exercise machine.

FIG. 1A is a block diagram illustrating an embodiment of an exercise machine. The exercise machine includes the following:

- a controller circuit (1004), which may include a processor, inverter, pulse-width-modulator, and/or a Variable Frequency Drive (VFD);
- a motor (1006), for example a three-phase brushless DC driven by the controller circuit;
- a spool with a cable (1008) wrapped around the spool and coupled to the spool. On the other end of the cable an actuator/handle (1010) is coupled in order for a user to grip and pull on. The spool is coupled to the motor (1006) either directly or via a shaft/belt/chain/gear mechanism. Throughout this specification, a spool may be also referred to as a "hub";
- a filter (1002), to digitally control the controller circuit (1004) based on receiving information from the cable (1008) and/or actuator (1010);
- optionally (not shown in FIG. 1A) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;
- one or more of the following sensors (not shown in FIG. 1A):
- a position encoder; a sensor to measure position of the actuator (1010) or motor (100). Examples of position encoders include a hall effect shaft encoder, grey-code encoder on the motor/spool/cable (1008), an accelerometer in the actuator/handle (1010), optical sensors, position measurement sensors/methods built directly into the motor (1006), and/or optical encoders. In one embodiment, an optical encoder is used with an encoding pattern that uses phase to determine direction associated with the low resolution encoder. Other options that measure back-EMF (back electromagnetic force) from the motor (1006) in order to calculate position also exist;
- a motor power sensor; a sensor to measure voltage and/or current being consumed by the motor (1006);
- a user tension sensor; a torque/tension/strain sensor and/or gauge to measure how much tension/force is being applied to the actuator (1010) by the user. In one embodiment, a tension sensor is built into the cable (1008). Alternatively, a strain gauge is built into the motor mount holding the motor (1006). As the user pulls on the actuator (1010), this translates into strain on the motor mount which is measured using a strain gauge in a Wheatstone bridge configuration. In another embodiment, the cable (1008) is guided through a pulley coupled to a load cell. In another embodiment, a belt coupling the motor (1006) and cable spool or gearbox (1008) is guided through a pulley coupled to a load cell. In another embodiment, the resistance generated by the motor (1006) is characterized based on the voltage, current, or frequency input to the motor.

In one embodiment, a three-phase brushless DC motor (1006) is used with the following:

- a controller circuit (1004) combined with filter (1002) comprising:
  - a processor that runs software instructions;
  - three pulse width modulators (PWMs), each with two channels, modulated at 20 kHz;
  - six transistors in an H-Bridge configuration coupled to the three PWMs;
  - optionally, two or three ADCs (Analog to Digital Converters) monitoring current on the H-Bridge; and/or
  - optionally, two or three ADCs monitoring back-EMF voltage;
- the three-phase brushless DC motor (1006), which may include a synchronous-type and/or asynchronous-type permanent magnet motor, such that:
  - the motor (1006) may be in an "out-runner configuration" as described below;
  - the motor (1006) may have a maximum torque output of at least 60 Nm and a maximum speed of at least 300 RPMs;

optionally, with an encoder or other method to measure motor position;

a cable (1008) wrapped around the body of the motor (1006) such that entire motor (1006) rotates, so the body of the motor is being used as a cable spool in one case. Thus, the motor (1006) is directly coupled to a cable (1008) spool. In one embodiment, the motor (1006) is coupled to a cable spool via a shaft, gearbox, belt, and/or chain, allowing the diameter of the motor (1006) and the diameter of the spool to be independent, as well as introducing a stage to add a set-up or step-down ratio if desired. Alternatively, the motor (1006) is coupled to two spools with an apparatus in between to split or share the power between those two spools. Such an apparatus could include a differential gearbox, or a pulley configuration; and/or an actuator (1010) such as a handle, a bar, a strap, or other accessory connected directly, indirectly, or via a connector such as a carabiner to the cable (1008).

In some embodiments, the controller circuit (1002, 1004) is programmed to drive the motor in a direction such that it draws the cable (1008) towards the motor (1006). The user pulls on the actuator (1010) coupled to cable (1008) against the direction of pull of the motor (1006).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (1006).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

rotates in the opposite direction. Note that the motor (1006) is pulling towards the cable (1008) onto the spool. If the cable (1008) is unspooling, it is because a user has overpowered the motor (1006). Thus, note a distinction between the direction the motor (1006) is pulling, and the direction the motor (1006) is actually turning.

If the controller circuit (1002, 1004) is set to drive the motor (1006) with, for example, a constant torque in the direction that spools the cable, corresponding to the same direction as a weight stack being pulled towards the ground, then this translates to a specific force/tension on the cable (1008) and actuator (1010). Calling this force "Target Tension", this force may be calculated as a function of torque multiplied by the radius of the spool that the cable (1008) is wrapped around, accounting for any additional stages such as gear boxes or belts that may affect the relationship between cable tension and torque. If a user pulls on the actuator (1010) with more force than the Target Tension, then that user overcomes the motor (1006) and the cable (1008) unspools moving towards that user, being the virtual equivalent of the weight stack rising. However, if that user applies less tension than the Target Tension, then the motor (1006) overcomes the user and the cable (1008) spools onto and moves towards the motor (1006), being the virtual equivalent of the weight stack returning.

BLDC Motor. While many motors exist that run in thousands of revolutions per second, an application such as fitness equipment designed for strength training has different requirements and is by comparison a low speed, high torque type application suitable for certain kinds of BLDC motors configured for lower speed and higher torque.

In one embodiment, a requirement of such a motor (1006) is that a cable (1008) wrapped around a spool of a given diameter, directly coupled to a motor (1006), behaves like a 200 lbs weight stack, with the user pulling the cable at a maximum linear speed of 62 inches per second. A number of motor parameters may be calculated based on the diameter of the spool.

| User Requirements | | | | | | |
|---|---|---|---|---|---|---|
| Target Weight | 200 | lbs | | | | |
| Target Speed | 62 | inches/sec = | 1.5748 meters/sec | | | |
| **Requirements by Spool Size** | | | | | | |
| Diameter (inches) | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

By contrast in a digital strength trainer, there is no actual weight stack. The notion of the weight stack is one modeled by the system. The physical embodiment is an actuator (1010) coupled to a cable (1008) coupled to a motor (1006). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (1006) may be converted into linear force by multiplying it by radius r.

If the virtual/perceived "weight stack" is moving away from the ground, motor (1006) rotates in one direction. If the "weight stack" is moving towards the ground, motor (1006)

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor torque is more appropriate for fitness equipment/strength training systems. This would normally lead to the selection of an induction type motor for which direct control of torque is simple. Although BLDC motors are more directly able to control speed and/or motor position rather than torque, torque control of BLDC motors can be made possible with the appropriate methods when used in combination with an appropriate encoder.

Figure 1B:
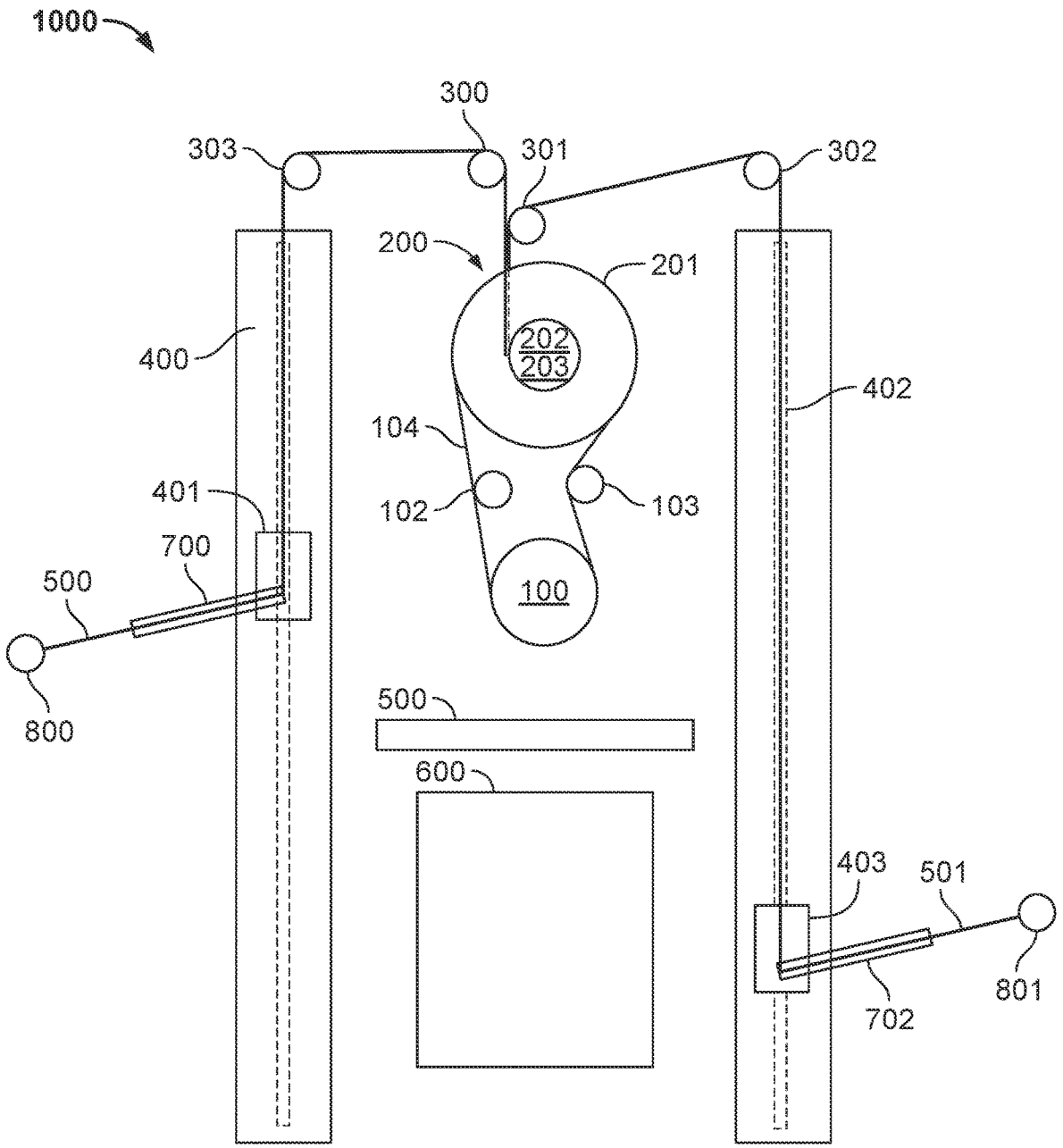
FIG. 1B illustrates a front view of one embodiment of an exercise machine.

Reference Design. FIG. 1B illustrates a front view of one embodiment of an exercise machine. An exercise machine (1000) comprising a pancake motor (100), a torque controller (600) coupled to the pancake motor, and a high resolution encoder coupled to the pancake motor (102) is disclosed. As described herein, a "high resolution" encoder is any encoder with 30 degrees or greater of electrical angle. Two cables (500) and (501) are coupled respectively to actuators (800) and (801) on one end of the cables. The two cables (500) and (501) are coupled directly or indirectly on the opposite end to the motor (100). While an induction motor may be used for motor (100), a BLDC motor is a preferred embodiment for its cost, size, weight, and performance. A BLDC motor is more challenging than an induction motor to control torque and so a high resolution encoder assists the system to determine position of the BLDC motor.

Sliders (401) and (403) may be respectively used to guide the cable (500) and (501) respectively along rails (400) and (402). The exercise machine in FIG. 1B translates motor torque into cable tension. As a user pulls on actuators (800) and/or (801), the machine creates/maintains tension on cable (500) and/or (501). The actuators (800, 801) and/or cables (500, 501) may be actuated in tandem or independently of one another.

In one embodiment, electronics bay (600) is included and has the necessary electronics to drive the system. In one embodiment, fan tray (500) is included and has fans that cool the electronics bay (600) and/or motor (100).

Motor (100) is coupled by belt (104) to an encoder (102), an optional belt tensioner (103), and a spool assembly (200). Motor (100) is preferably an out-runner, such that the shaft is fixed and the motor body rotates around that shaft. In one embodiment, motor (100) generates torque in the counter-clockwise direction facing the machine, as in the example in FIG. 1B. Motor (100) has teeth compatible with the belt integrated into the body of the motor along the outer circumference. Referencing an orientation viewing the front of the system, the left side of the belt (104) is under tension, while the right side of the belt is slack. The belt tensioner (103) takes up any slack in the belt. An optical rotary encoder (102) coupled to the tensioned side of the belt (104) captures all motor movement, with significant accuracy because of the belt tension. In one embodiment, the optical rotary encoder (102) is a high resolution encoder. In one embodiment, a toothed belt (104) is used to reduce belt slip. The spools rotate counter-clockwise as they are spooling cable/taking cable in, and clockwise as they are unspooling/releasing cable out.

Spool assembly (200) comprises a front spool (203), rear spool (202), and belt sprocket (201). The spool assembly (200) couples the belt (104) to the belt sprocket (201), and couples the two cables (500) and (501) respectively with front spool (203) and rear spool (202). Each of these components is part of a low profile design. In one embodiment, a dual motor configuration not shown in FIG. 1B is used to drive each cable (500) and (501). In the example shown in FIG. 1B, a single motor (100) is used as a single source of tension, with a plurality of gears configured as a differential are used to allow the two cables/actuators to be operated independently or in tandem. In one embodiment, spools (202) and (203) are directly adjacent to sprocket (201), thereby minimizing the profile of the machine in FIG. 1B.

As shown in FIG. 1B, two arms (700, 702), two cables (500, 501) and two spools (202, 203) are useful for users with two hands, and the principles disclosed without limitation may be extended to three, four, or more arms (700) for quadrupeds and/or group exercise. In one embodiment, the plurality of cables (500, 501) and spools (202, 203) are driven by one sprocket (201), one belt (104), and one motor (100), and so the machine (1000) combines the pairs of devices associated with each user hand into a single device.

In one embodiment, motor (100) should provide constant tension on cables (500) and (501) despite the fact that each of cables (500) and (501) may move at different speeds. For example, some physical exercises may require use of only one cable at a time. For another example, a user may be stronger on one side of their body than another side, causing differential speed of movement between cables (500) and (501). In one embodiment, a device combining dual cables (500) and (501) for single belt (104) and sprocket (201), should retain a low profile, in order to maintain the compact nature of the machine, which can be mounted on a wall.

In one embodiment, pancake style motor(s) (100), sprocket(s) (201) and spools (202, 203) are manufactured and arranged in such a way that they physically fit together within the same space, thereby maximizing functionality while maintaining a low profile.

As shown in FIG. 1B, spools (202) and (203) are respectively coupled to cables (500) and (501) that are wrapped around the spools. The cables (500) and (501) route through the system to actuators (800) and (801), respectively.

The cables (500) and (501) are respectively positioned in part by the use of "arms" (700) and (702). The arms (700) and (702) provide a framework for which pulleys and/or pivot points may be positioned. The base of arm (700) is at arm slider (401) and the base of arm (702) is at arm slider (403).

The cable (500) for a left arm (700) is attached at one end to actuator (800). The cable routes via arm slider (401) where it engages a pulley as it changes direction, then routes along the axis of rotation of track (400). At the top of track (400), fixed to the frame rather than the track is pulley (303) that orients the cable in the direction of pulley (300), that further orients the cable (500) in the direction of spool (202), wherein the cable (500) is wound around spool (202) and attached to spool (202) at the other end.

Similarly, the cable (501) for a right arm (702) is attached at one end to actuator (601). The cable (501) routes via slider (403) where it engages a pulley as it changes direction, then routes along the axis of rotation of track (402). At the top of the track (402), fixed to the frame rather than the track is pulley (302) that orients the cable in the direction of pulley (301), that further orients the cable in the direction of spool (203), wherein the cable (501) is wound around spool (203) and attached to spool (203) at the other end.

One important use of pulleys (300, 301) is that they permit the respective cables (500, 501) to engage respective spools (202, 203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

Figure 1C:
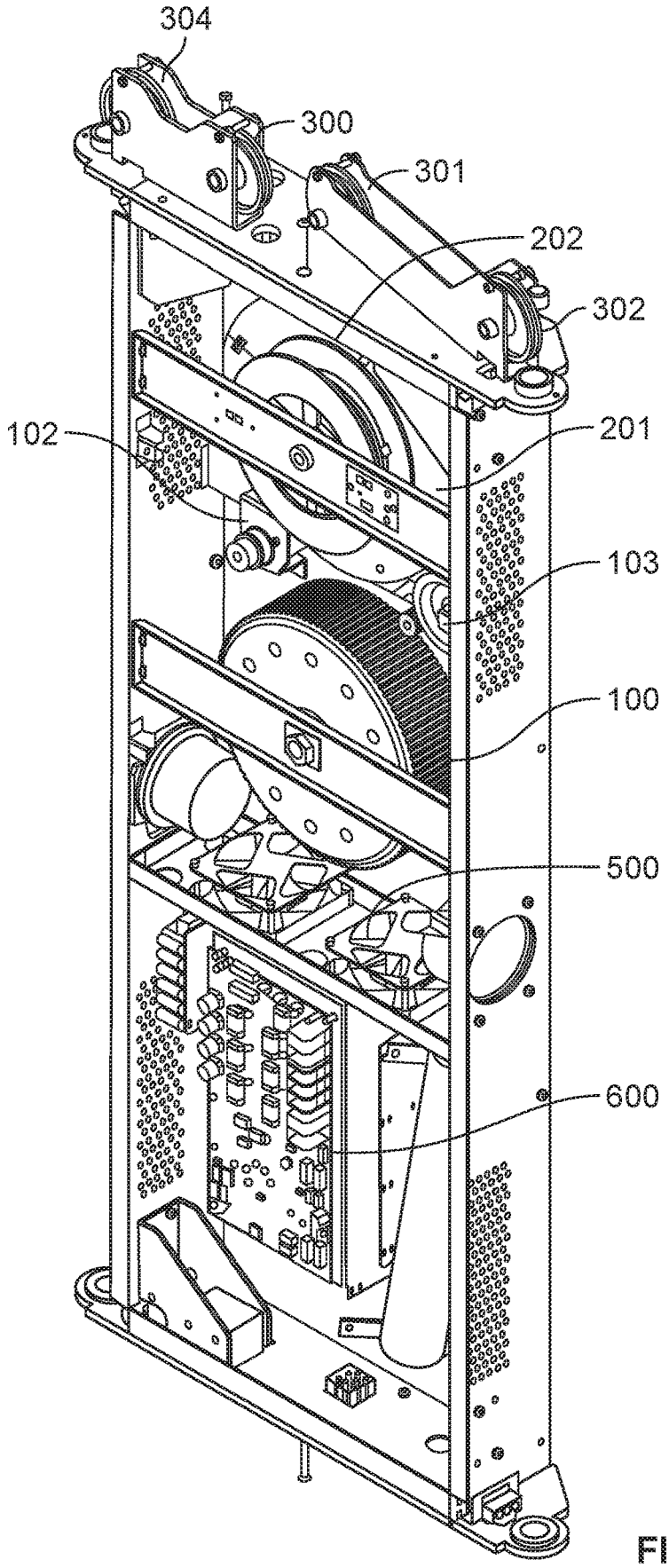
FIG. 1C illustrates a perspective view of the system of FIG. 1B wherein for clarity arms, cables, and belts are omitted.
Figure 1D:
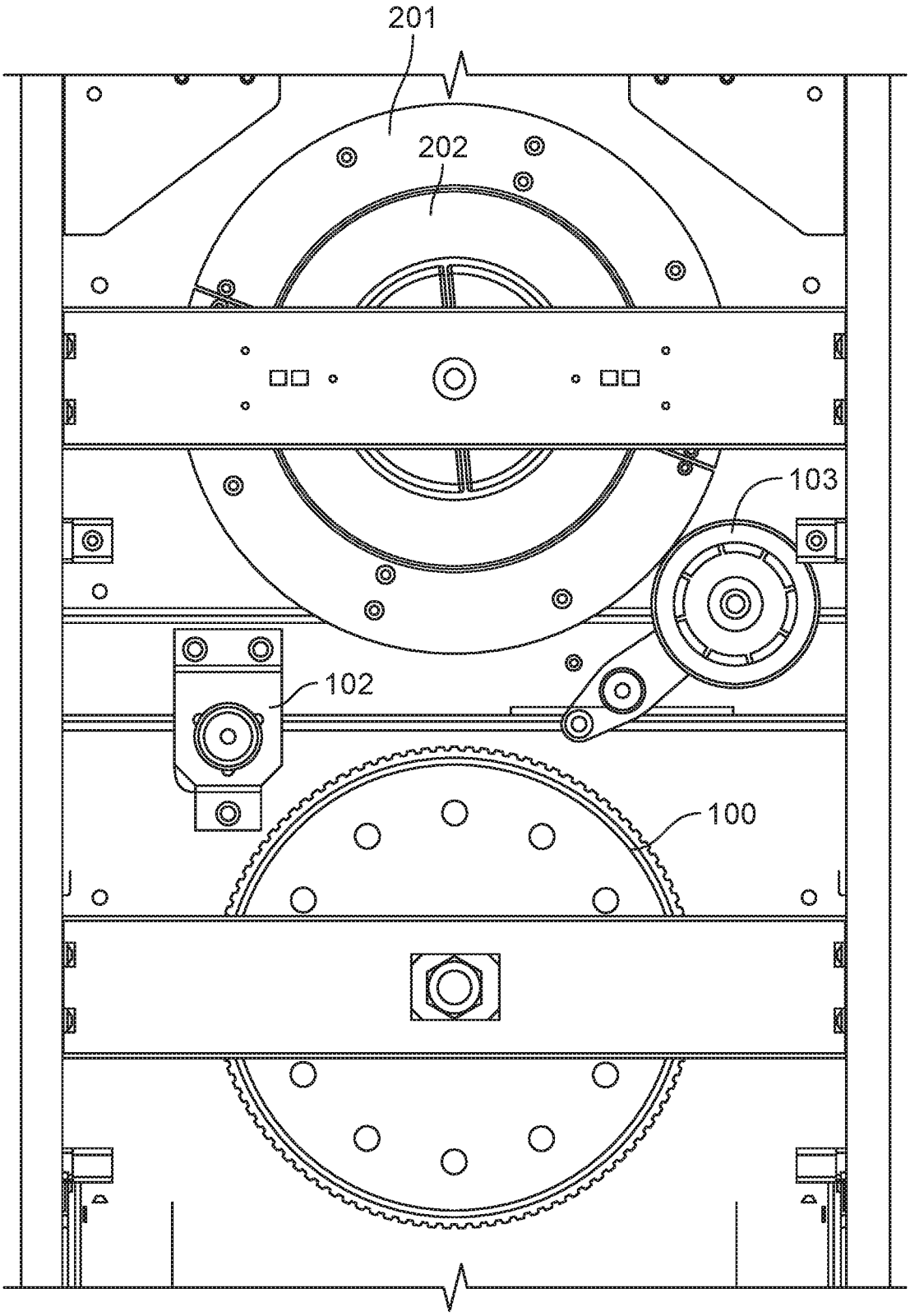
FIG. 1D illustrates a front view of the system of FIG. 1B.
Figure 1E:
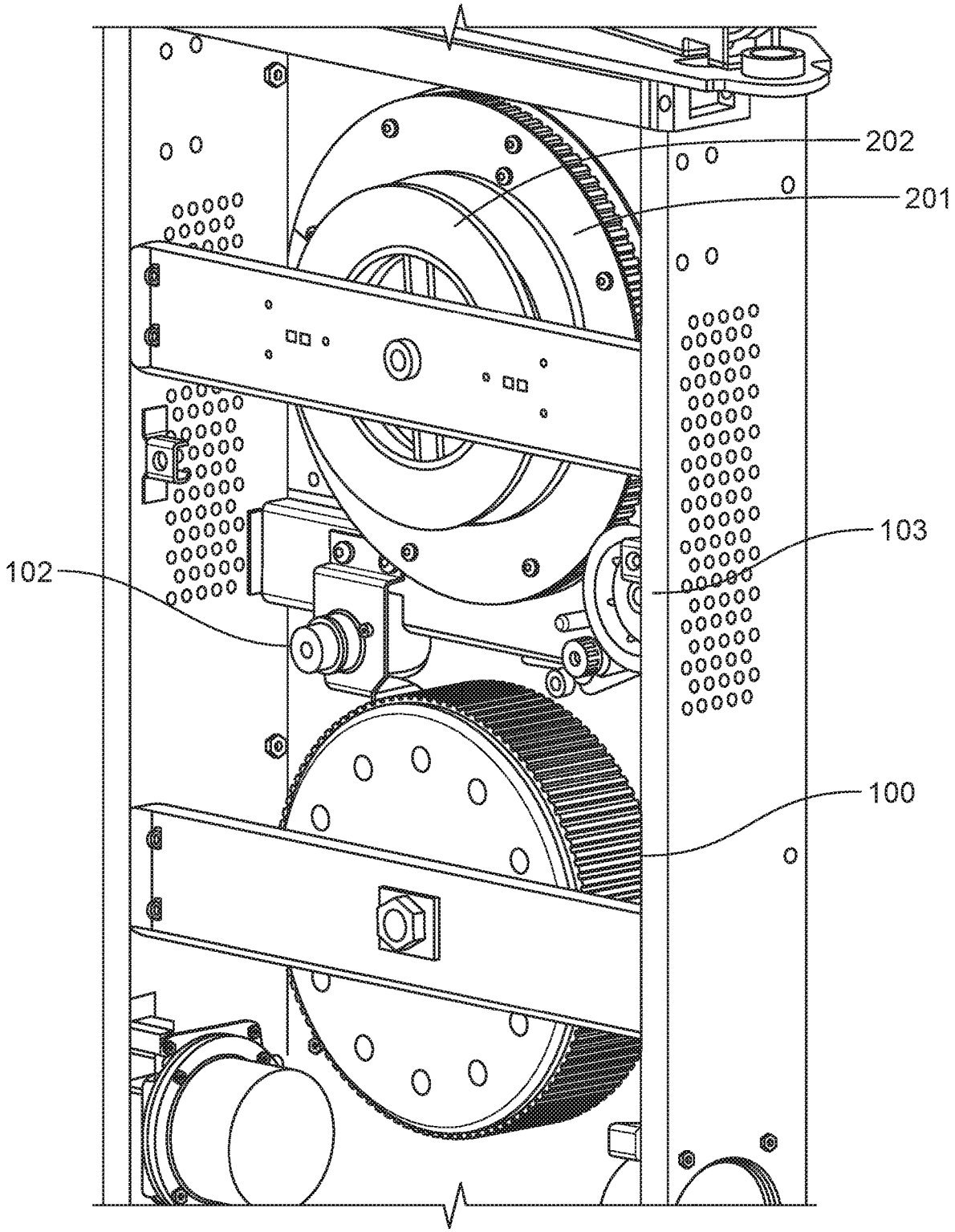
FIG. 1E illustrates a perspective view of the drivetrain of FIG. 1B.

In the example shown in FIG. 1B, pulley (301) is lower than pulley (300). This is not necessary for any functional reason but demonstrates the flexibility of routing cables. In a preferred embodiment, mounting pulley (301) lower leaves clearance for certain design aesthetic elements that make the machine appear to be thinner. FIG. 1C illustrates a perspective view of the system of FIG. 1B wherein for clarity arms, cables, and belts are omitted. FIG. 1D illustrates a front view of the system of FIG. 1B. FIG. 1E illustrates a perspective view of the drivetrain of FIG. 1B.

Figure 2A:
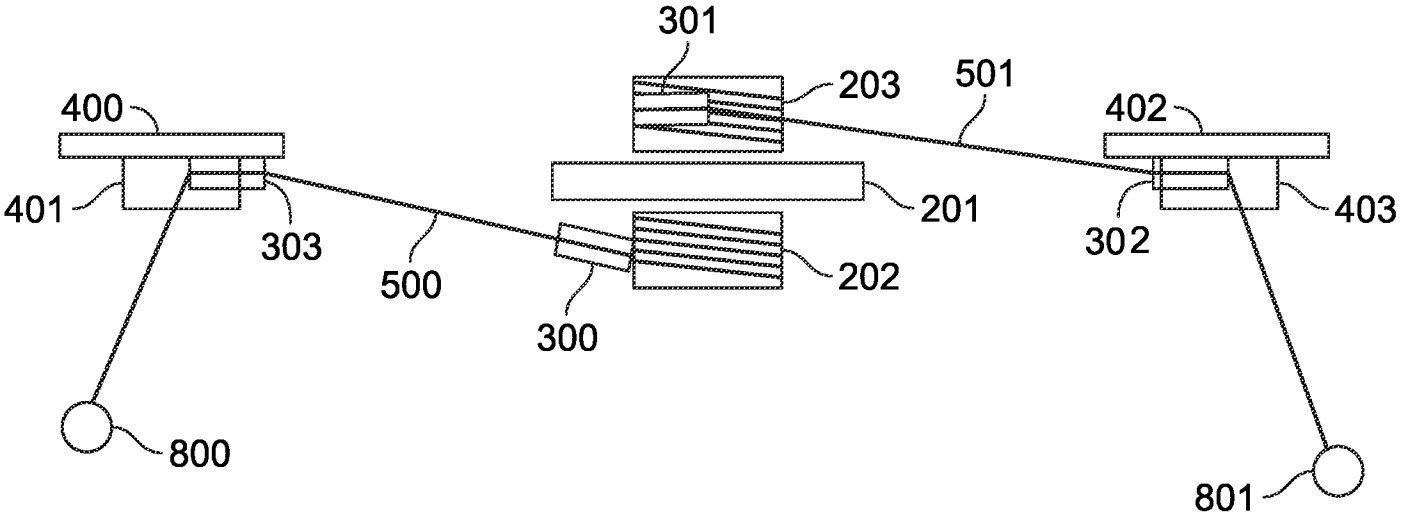
FIG. 2A illustrates a top view of one embodiment of an exercise machine.

FIG. 2A illustrates a top view of one embodiment of an exercise machine. In one embodiment, the top of view of FIG. 2A is that of the system shown in FIG. 1B. As long as motor torque is in the counter-clockwise direction, a cable is under tension. The amount of tension is directly proportional to the torque generated by the motor, based on a factor that includes the relative diameters of the motor (100), sprocket (201), and spools (202) and (203). If the force pulling on a cable overcomes the tension, the respective spool will unspool releasing cable, and hence the spool will rotate clockwise. If the force is below the tension, then the respective spool will spool take in cable, and hence the spool will rotate counter-clockwise.

When the motor is being back-driven by the user, that is when the user is retracting the cable, but the motor is resisting, and the motor is generating power. This additional power may cause the internal voltage of the system to rise. The voltage is stabilized to prevent the voltage rising indefinitely causing the system to fail or enter an unsafe state. In one embodiment, power dissipation is used to stabilize voltage, for example to burn additional power as heat.

Figure 2B:
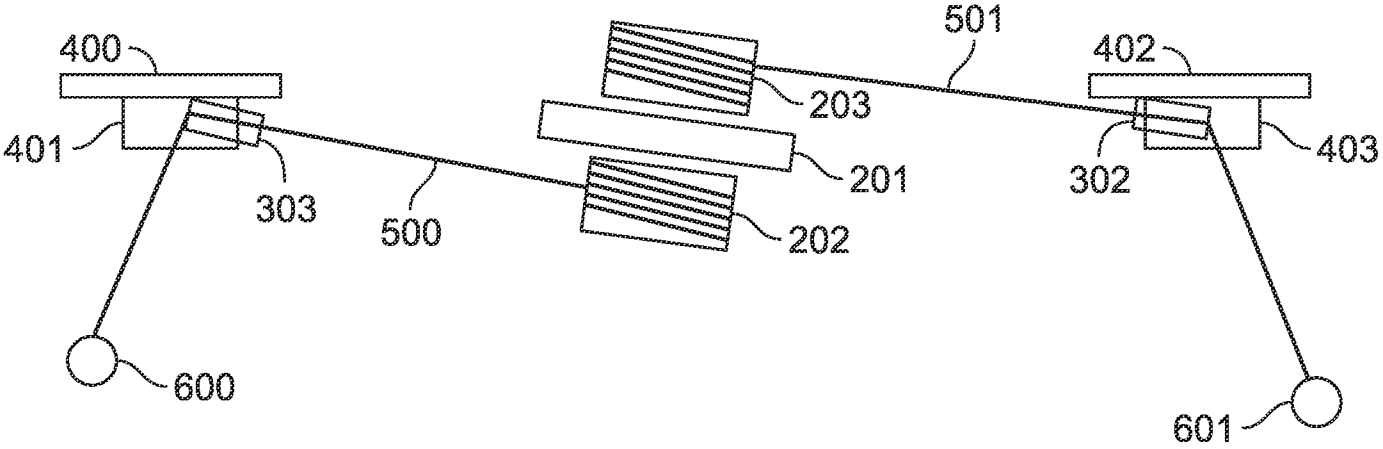
FIG. 2B illustrates a top view of an alternate embodiment of an exercise machine.

FIG. 2B illustrates a top view of an alternate embodiment of an exercise machine. As shown in FIG. 2B, pulleys (300) and (301) may be eliminated by rotating and translating the dual-spool assembly. The ideal location of the dual-spool assembly would be placed such that the cable route from both spools to the respective pulleys (302) and (303) is straight-on. Eliminating these pulleys both reduces system friction and reduces cost with the tradeoff of making the machine (1000) thicker, that is, less shallow from front to back.

Figure 3A:
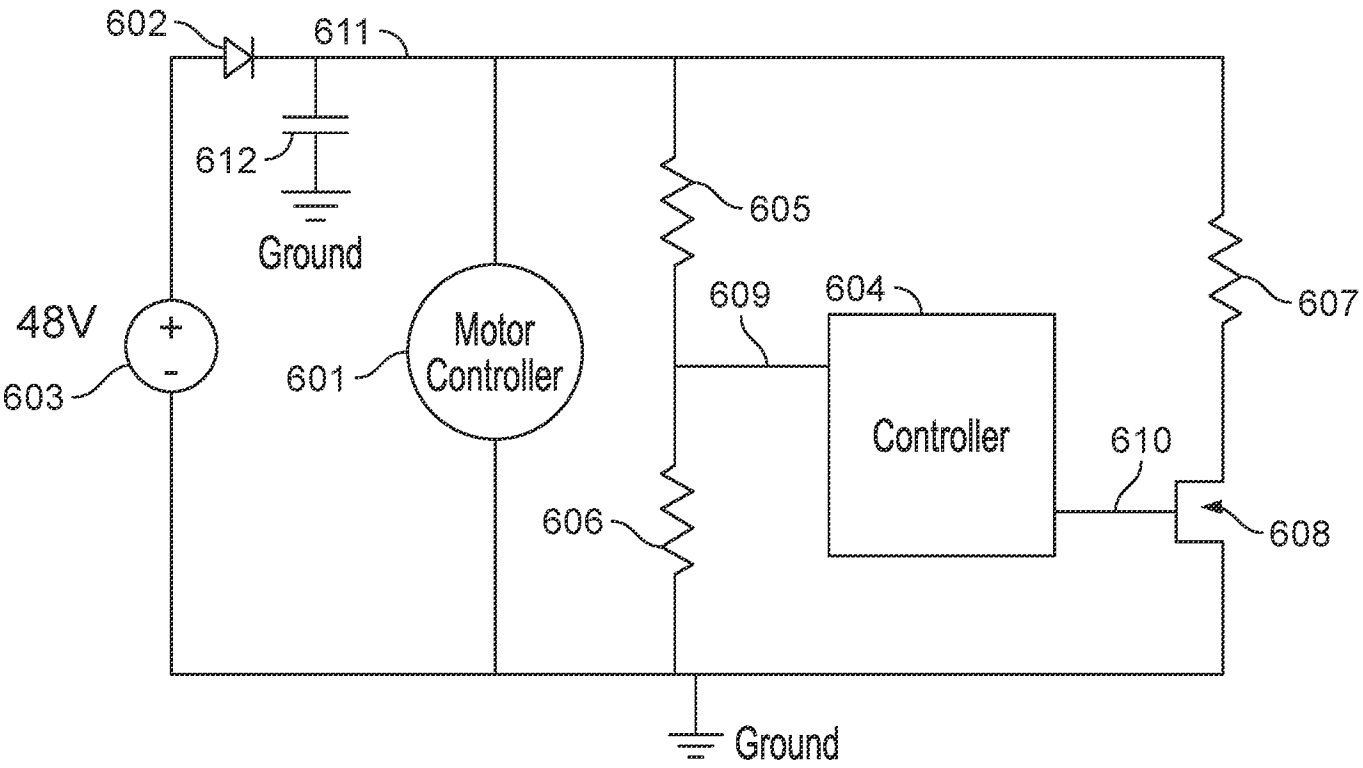
FIG. 3A is a circuit diagram of an embodiment of a voltage stabilizer.

Voltage Stabilization. FIG. 3A is a circuit diagram of an embodiment of a voltage stabilizer. The stabilizer includes a power supply (603) with protective element (602) that provides system power. Such a system may have an intrinsic or by-design capacitance (612). A motor controller (601), which includes the motor control circuits as well as a motor that consumes or generates power is coupled to power supply (603). A controller circuit (604) controls a FET transistor (608) coupled to a high-wattage resistor (607) as a switch to stabilize system power. A sample value for resistor (607) is a 300 W resistor/heater. A resistor divider utilizing a resistor network (605) and (606) is arranged such that the potential at voltage test point (609) is a specific fraction of system voltage (611). When FET (608) is switched on, power is burned through resistor (607). The control signal to the gate of FET (610) switches it on and off. In one embodiment, this control signal is pulse width modulated (PWM) switching on and off at some frequency. By varying the duty cycle and/or percentage of time on versus off, the amount of power dissipated through the resistor (607) may be controlled. Factors to determine a frequency for the PWM include the frequency of the motor controller, the capabilities of the power supply, and the capabilities of the FET. In one embodiment, a value in the range of 15-20 KHz is appropriate.

Controller (604) may be implemented using a micro-controller, micro-processor, discrete digital logic, any programmable gate array, and/or analog logic, for example analog comparators and triangle wave generators. In one embodiment, the same microcontroller that is used to implement the motor controller (601) is also used to implement voltage stabilization controller (604).

In one embodiment, a 48 Volt power supply (603) is used. The system may be thus designed to operate up to a maximum voltage of 60 Volts. In one embodiment, the Controller (604) measures system voltage, and if voltage is below a minimum threshold of 49 Volts, then the PWM has a duty cycle of 0%, meaning that the FET (610) is switched off. If the motor controller (601) generates power, and the capacitance (612) charges, causing system voltage (611) to rise above 49 Volts, then the controller (601) will increase the duty cycle of the PWM. If the maximum operating voltage of the system is 60 Volts, then a simple relationship to use is to pick a maximum target voltage below the 60 Volts, such as 59 Volts, so that at 59 Volts, the PWM is set to a 100% duty cycle. Hence, a linear relationship of PWM duty cycle is used such that the duty cycle is 0% at 49 Volts, and 100% at 59 Volts. Other examples of relationships include: a non-linear relationship; a relationship based on coefficients such as one representing the slope of a linear line adjusted by a PID loop; and/or a PID loop directly in control of the duty cycle of the PWM.

In one embodiment, controller (604) is a micro-controller such that 15,000 times per second an analog to digital converter (ADC) measures the system voltage, invokes a calculation to calculate the PWM duty cycle, then outputs a pulse with a period corresponding to that duty cycle.

Figure 3B:
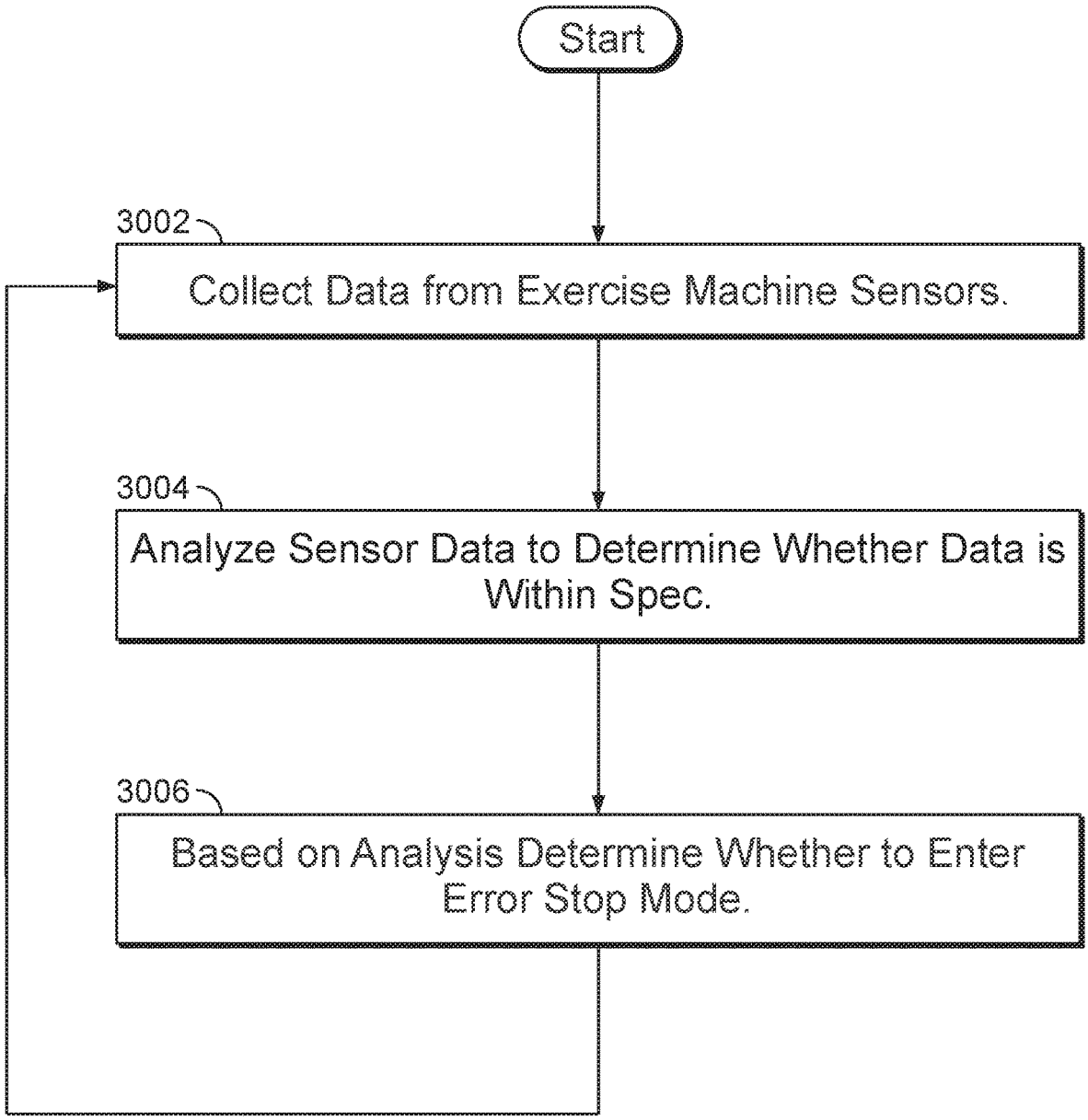
FIG. 3B is a flowchart illustrating an embodiment of a process for a safety loop for an exercise machine.

Safety. Safety of the user and safety of the equipment is important for an exercise machine. In one embodiment, a safety controller uses one or more models to check system behavior, and place the system into a safe-stop, also known as an error-stop mode or ESTOP state to prevent or minimize harm to the user and/or the equipment. A safety controller may be a part of controller (604) or a separate controller (not shown in FIG. 3A). A safety controller may be implemented in redundant modules/controllers/subsystems and/or use redundancy to provide additional reliability. FIG. 3B is a flowchart illustrating an embodiment of a process for a safety loop for an exercise machine.

Depending on the severity of the error, recovery from ESTOP may be quick and automatic, or require user intervention or system service.

In step 3002, data is collected from one or more sensors, examples including:

1) Rotation of the motor (100) via Hall sensors within the motor;
2) Rotation of the motor (100) via an encoder (103) coupled to the belt;
3) Rotation of each of the two spools (202, 203);
4) Electrical current on each of the phases of the three-phase motor (100);
5) Accelerometer mounted to the frame;
6) Accelerometer mounted to each of the arms (400, 402);
7) Motor (100) torque;
8) Motor (100) speed;
9) Motor (100) voltage;
10) Motor (100) acceleration;
11) System voltage (611);
12) System current; and/or
13) One or more temperature sensors mounted in the system.

In step 3004, a model analyzes sensor data to determine if it is within spec or out of spec, including but not limited to:

1) The sum of the current on all three leads of the three-phase motor (100) should equal zero;
2) The current being consumed by the motor (100) should be directly proportional to the torque being generated by the motor (100). The relationship is defined by the motor's torque constant;
3) The speed of the motor (100) should be directly proportional to the voltage being applied to the motor (100). The relationship is defined by the motor's speed constant;
4) The resistance of the motor (100) is fixed and should not change;
5) The speed of the motor (100) as measured by an encoder, back EMF voltage, for example zero crossings, and Hall sensors should all agree;
6) The speed of the motor (100) should equal the sum of the speeds of the two spools (202, 203);
7) The accelerometer mounted to the frame should report little to no movement. Movement may indicate that the frame mount has come loose;
8) System voltage (611) should be within a safe range, for example as described above, between 48 and 60 Volts;
9) System current should be within a safe range associated with the rating of the motor;
10) Temperature sensors should be within a safe range;
11) A physics model of the system may calculate a safe amount of torque at a discrete interval in time continuously. By measuring cable speed and tension, the model may iteratively predict what amount of torque may be measured at the motor (100). If less torque than expected is found at the motor, this is an indication that the user has released one or more actuators (800,801); and/or
12) The accelerometer mounted to the arms (400, 402) should report little to no movement. Movement would indicate that an arm has failed in some way, or that the user has unlocked the arm.

In step 3006, if a model has been determined to be violated, the system may enter an error stop mode. In such an ESTOP mode, depending on the severity, it may respond with one or more of:

1) Disable all power to the motor;
2) Disable the main system power supply, relying on auxiliary supplies to keep the processors running;
3) Reduce motor torque and/or cable tension to a maximum safe value, for example the equivalent of torque that would generate 5 lbs of motor tension; and/or
4) Limit maximum motor speed, for example the equivalent of cable being retracted at 5 inches per second.

Figure 4:
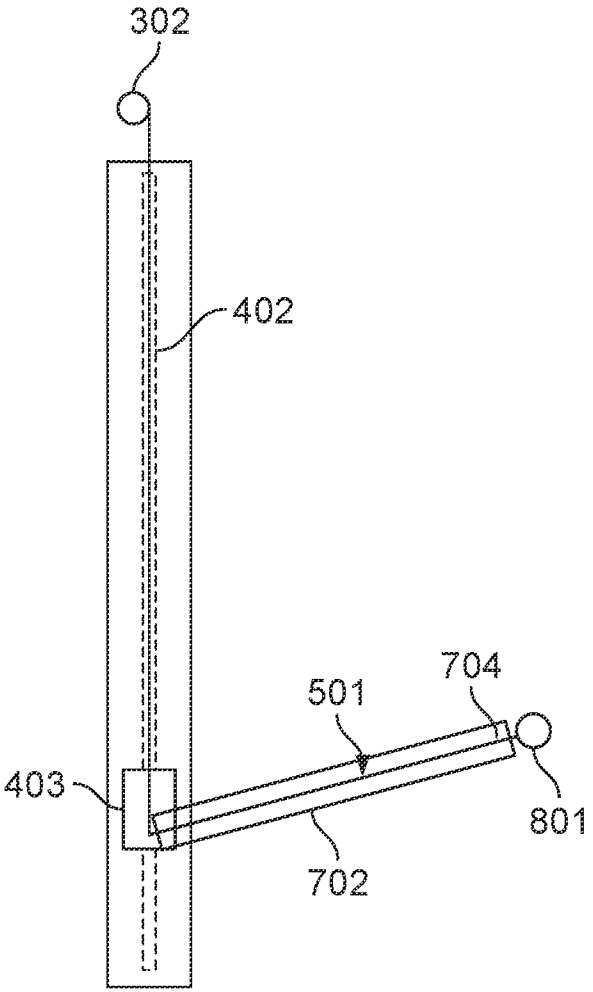
FIG. 4 is an illustration of arms in one embodiment of an exercise machine.

Arms. FIG. 4 is an illustration of arms in one embodiment of an exercise machine. An exercise machine may be convenient and more frequently used when it is small, for example to fit on a wall in a residential home. As shown in FIG. 4, an arm (702) provides a way to position a cable (501) to provide a directional resistance for a user's exercise, for example if the arm (702) positions the cable user origination point (704) near the ground, by pulling up on actuator (801) the user may perform a bicep curl exercise or an upright row exercise. Likewise, if the arm (702) positions cable user origination point (704) above the user, by pulling down on actuator (801) the user may perform a lat pulldown exercise.

Traditionally, exercise machines utilize one or more arms pivoting in the vertical direction to offer adjustability in the vertical direction. However, to achieve the full range of adjustability requires long arms. If a user wishes to have 8 feet of adjustment such that the tip of the arm may be above the user 8 feet off the ground, or at a ground position, then a 5 foot arm may be required to be practical. This is inconvenient because it requires more space to pivot the arm, and limits the number of places where such a machine can be placed. Furthermore, a longer arm undergoes higher lever-arm forces and increases the size and complexity of the joint in order to handle those larger forces. If arms could be kept under three feet in length, a machine may be more conveniently placed and lever-arm forces may be more reasonable.

FIG. 4 shows arm (702) connected to slider (403) on track (402). Without limitation, the following discussion is equally applicable to arm (700) connected to slider (401) and track (400) in FIG. 1B. Note that as shown in FIG. 4, cable (501) travels within arm (702). For clarity, cable (501) is omitted from some of the following figures and discussion that concern the arm (702) and its movement.

An arm (702) of an exercise machine capable of moving in different directions and ways is disclosed. Three directions and ways include: 1) translation; 2) vertical pivot; and 3) horizontal pivot.

Translation. In one embodiment, as shown in FIG. 4, arm (702) is capable of sliding vertically on track (402), wherein track (402) is between 24 and 60 inches, for example 42 inches in height. Arm (702) is mounted to slider (403) that slides on track (402). This is mirrored on the other side of the machine with slider (401) on track (400).

Figure 5B:
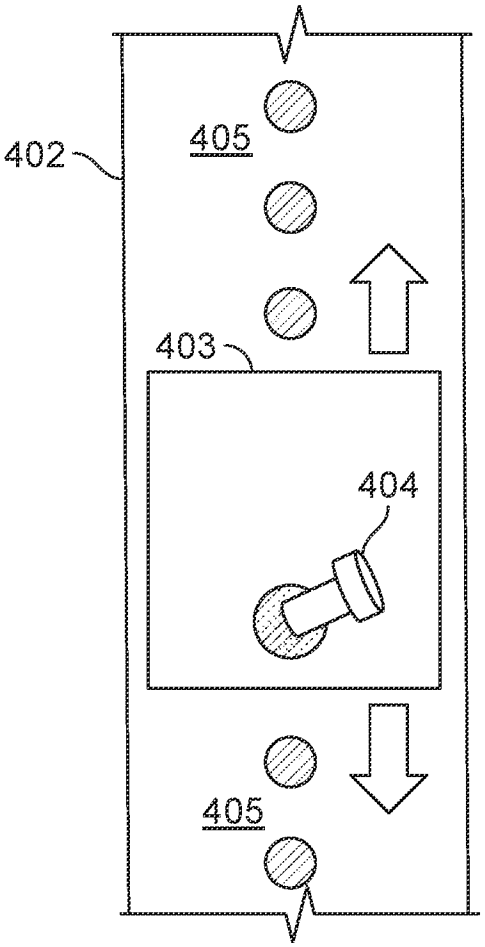
FIG. 5B is an illustration of an unlocked position for an arm.
Figure 5A:
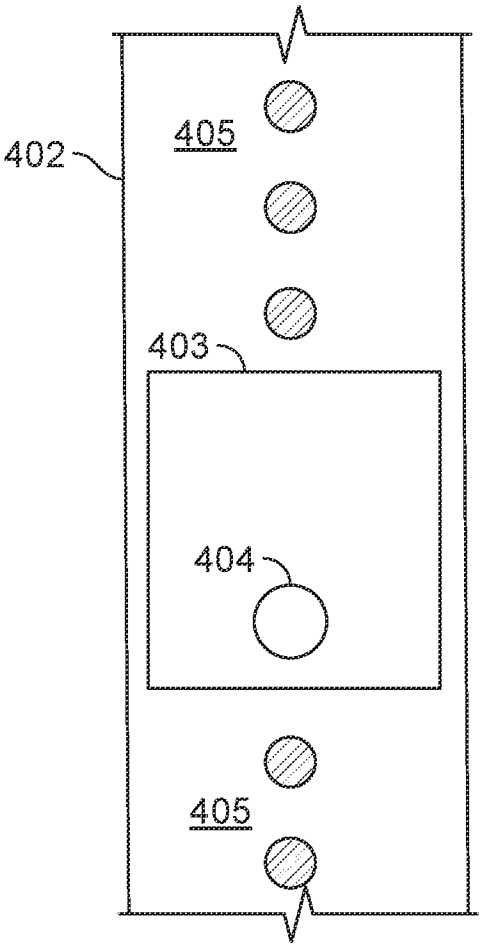
FIG. 5A is an illustration of a locked position for an arm.

As shown in FIG. 1B, slider (401) is at a higher vertical position than right slider (403), so the base of arm (700) is higher than that of arm (702). FIGS. 5A and 5B show how an arm (702) can be moved up and down in a vertical direction.

FIG. 5A is an illustration of a locked position for an arm. In FIG. 5A, pin (404), within slider (403), is in a locked position. This means that the end of pin (404) is located within one of a set of track holes (405). Pin (404) may be set in this position through different means, including manual pushing, spring contraction, and electrically driven motion.

FIG. 5B is an illustration of an unlocked position for an arm. In FIG. 5B, pin (404) has been retracted for track holes (405). This enables slider (403) to move up or down track (402), which causes arm (702) to move up or down. In one embodiment, the user manually moves slider (403). In an alternate embodiment, the motor uses cable tension and gravity to move sliders up and down to desired positions.

Sliding the slider (403) up and down track (402) physically includes the weight of the arm (702). The arm (702), being between 2 and 5 feet long, for example 3 feet long, and for example made of steel, may weigh between 6 and 25 lbs, for example 10 lbs. This may be considered heavy by some users to carry directly. In one embodiment, motor (100) is configured to operate in an 'arm cable assist' mode by generating a tension matching the weight of the arm (702) on the slider (403), for example 10 lbs on cable (501), and the user may easily slide the slider (403) up and down the track without perceiving the weight of the arms.

The exercise machine is calibrated such that the tension on the cable matches the weight of the slider, so the user perceives none of the weight of the arm. Calibration may be achieved by adjusting cable tension to a level such that the slider (403) neither rises under the tension of the cable (501), or falls under the force of gravity. By increasing or reducing motor torque as it compares to that used to balance gravity, the slider may be made to fall lower, or raise higher.

Placing the motor (100) and dual-spool assembly (200) near the top of the machine as shown in FIG. 1B is disclosed. An alternate design may place heavy components near the bottom of the machine, such that cables (500) and (501) are routed from the bottom to the sliders which would conceal cables and pulleys from the user. By placing heavier components near the top of the machine, routing cables from the top of the machine and columns down to the slider allows cable tension to offset the effect of gravity. This allows motor torque to be utilized to generate cable tension that allows the user to not perceive the weight of the arms and slider without an additional set of pulleys to the top of a column. This also allows motor torque to be utilized to move the slider and arms without the intervention of the user.

Vertical Pivot. In addition to translating up and down, the arms may pivot up and down, with their bases in fixed position, to provide a great range of flexibility in positioning the user origination point of a given arm. Keeping arm (702) in a fixed vertically pivoted position may require locking arm (702) with slider (403).

Figure 6:
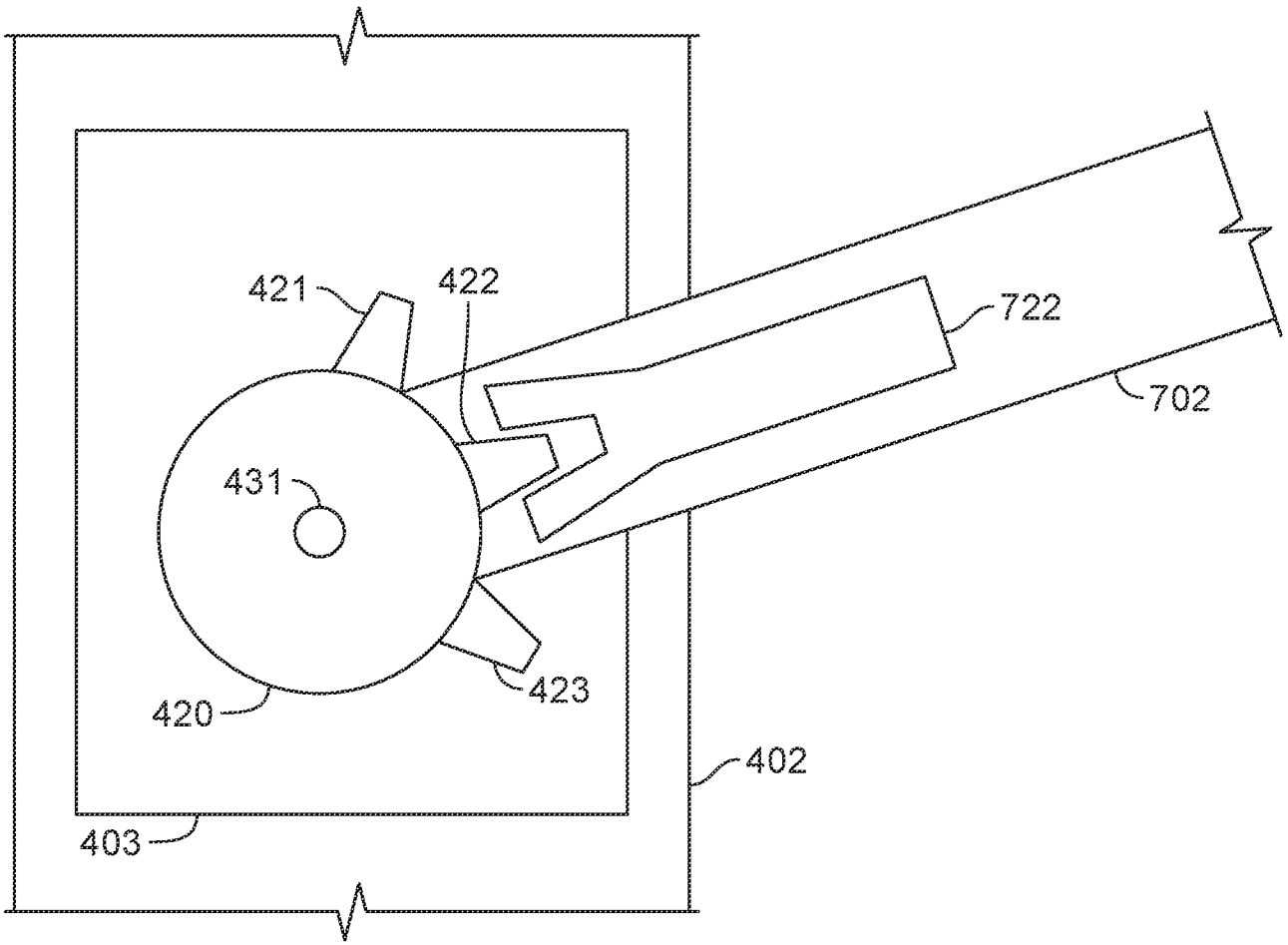
FIG. 6 is an illustration of an embodiment of a vertical pivot locking mechanism.

FIG. 6 is an illustration of an embodiment of a vertical pivot locking mechanism. In FIG. 6, slider (403) includes a part (420) that has teeth (422). Teeth (422) match female locking member (722) of arm (702).

Using trapezoidal teeth for locking is disclosed. The teeth (422) and matching female locking member (722) use a trapezoidal shape instead of a rectangular shape because a rectangular fitting should leave room for the teeth to enter the female locking member. Using a rectangular tooth causes "wiggle" in the locking joint, and this wiggle is leveraged at the end of arm (702). A trapezoidal set of teeth (422) to enter female locking mechanism (722) makes it simpler for the two members to be tightly coupled, minimizing joint wiggle.

Using a trapezoidal set of teeth increases the risk of the joint slipping/back-drive while under the stress of high loads. Empirically a slope of between 1 and 15 degrees, for example 5 degrees, minimizes joint slippage while maximizing case of entry and tightening. The slope of the trapezoid is set such that the amount of back-drive force is lower than the amount of friction of the trapezoidal surfaces on one another.

Figure 7A:
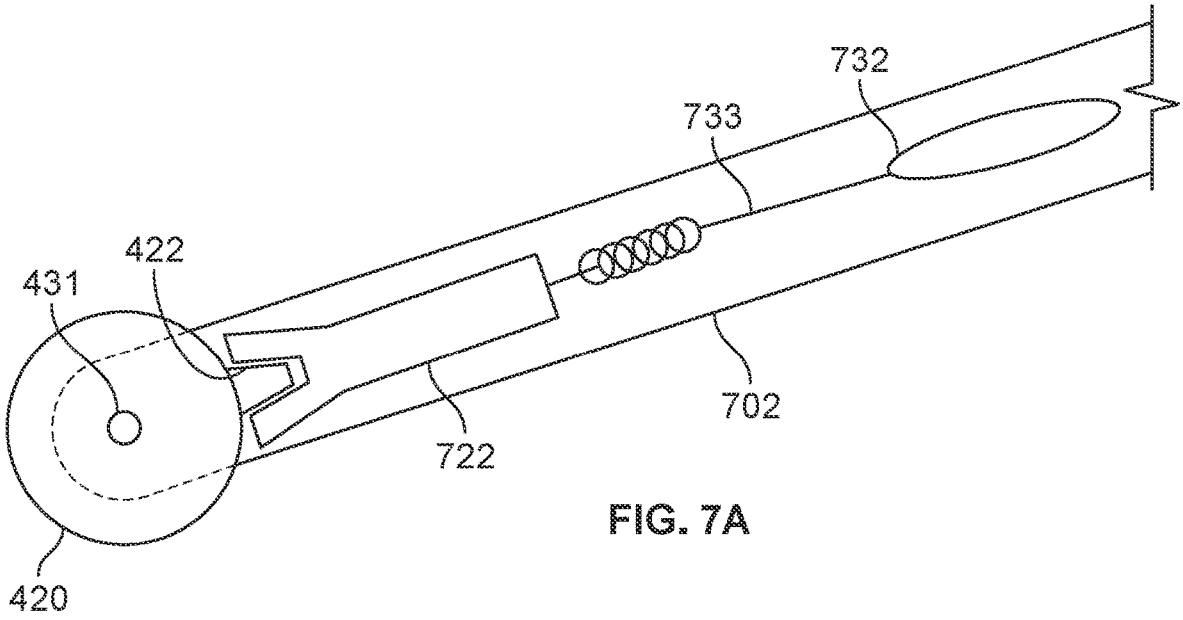
FIGS. 7A and 7B illustrate locking and unlocking for arm vertical pivoting.
Figure 7B:
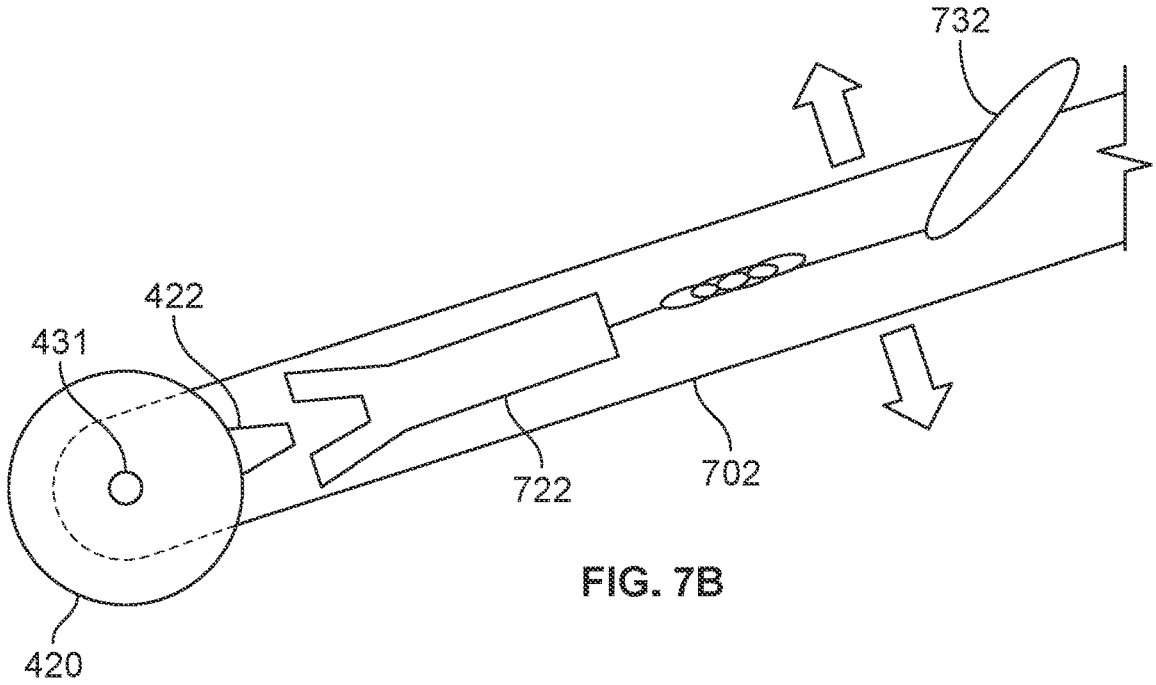

FIGS. 7A and 7B illustrate locking and unlocking for arm vertical pivoting. In FIG. 7A, arm (702) is locked into slider part (420). As shown in FIG. 7A, teeth (422) and female member (722) are tightly coupled. This tight coupling is produced by the force being produced by compressed spring (733).

In FIG. 7B a user unlocks arm (702). When the user pulls up on lever (732) of arm (702), this causes spring (733) to release its compression, thus causing female locking member (722) to pull backward, disengaging from teeth (422). With arm (702) thus disengaged, the user is free to pivot arm (702) up or down around hole (451). To lock arm (702) to a new vertically pivoted position, the user returns lever (732) to the flat position of FIG. 7A.

Alternate Vertical Pivot. In one embodiment, a rod-based lever and/or a squared tooth-gear geometry is used for teeth (422), at least in part to reduce a chance of getting "hung up" wherein the tooth (422) and locking member (722) do not completely interlock. A squared tooth-gear geometry may be used with other systems that reduce this chance including: a rod for user signal of tooth position, and a ball locking system.

Figure 7C:
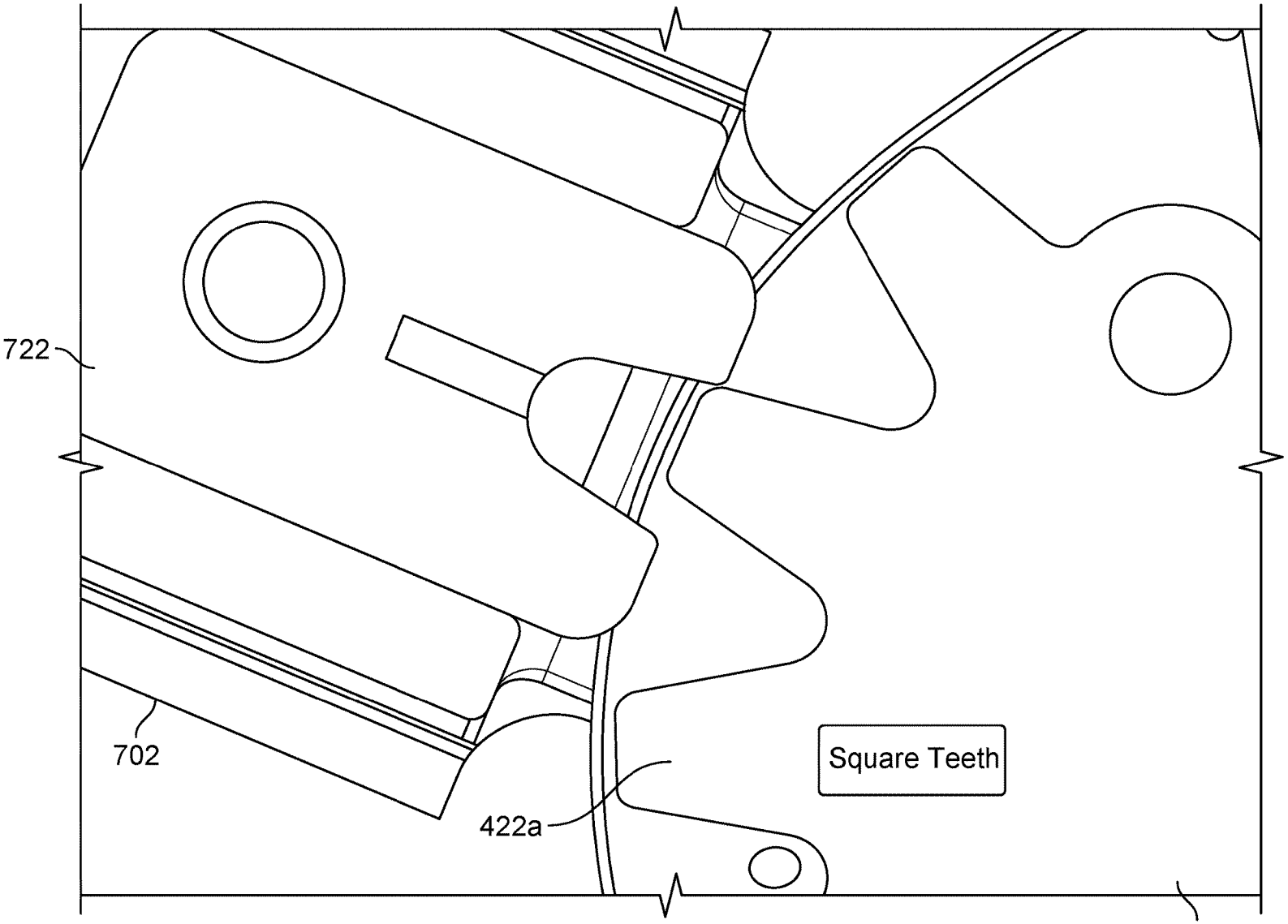
FIG. 7C illustrates squared tooth-gear geometry for arm vertical pivoting.

FIG. 7C illustrates squared tooth-gear geometry for arm vertical pivoting. In FIG. 7C, arm (702) is locked into a vertical pivot position at least in part as squared teeth (422*a*) and female member (722) are tightly coupled. In some cases, a shape of gear to rounded tooth interfaces (422) as shown in FIG. 7A provide roll-in lead-ins, which may afford a smooth sliding feeling when going into a vertical pivot position. The arm tooth (422) may rest on edges and the weight of the arm (702) may keep the spring from driving the tooth forward and/or arm angle up, and this may be more prevalent at upper angles.

The alternate use of squared teeth (422*a*) over the rounded teeth (422) reduces and/or removes lead-in geometries on tooth and gear. This reduces surface affordances for getting "hung up", and the tooth action is more "binary"; it is either completely in or completely out.

Figure 7D:
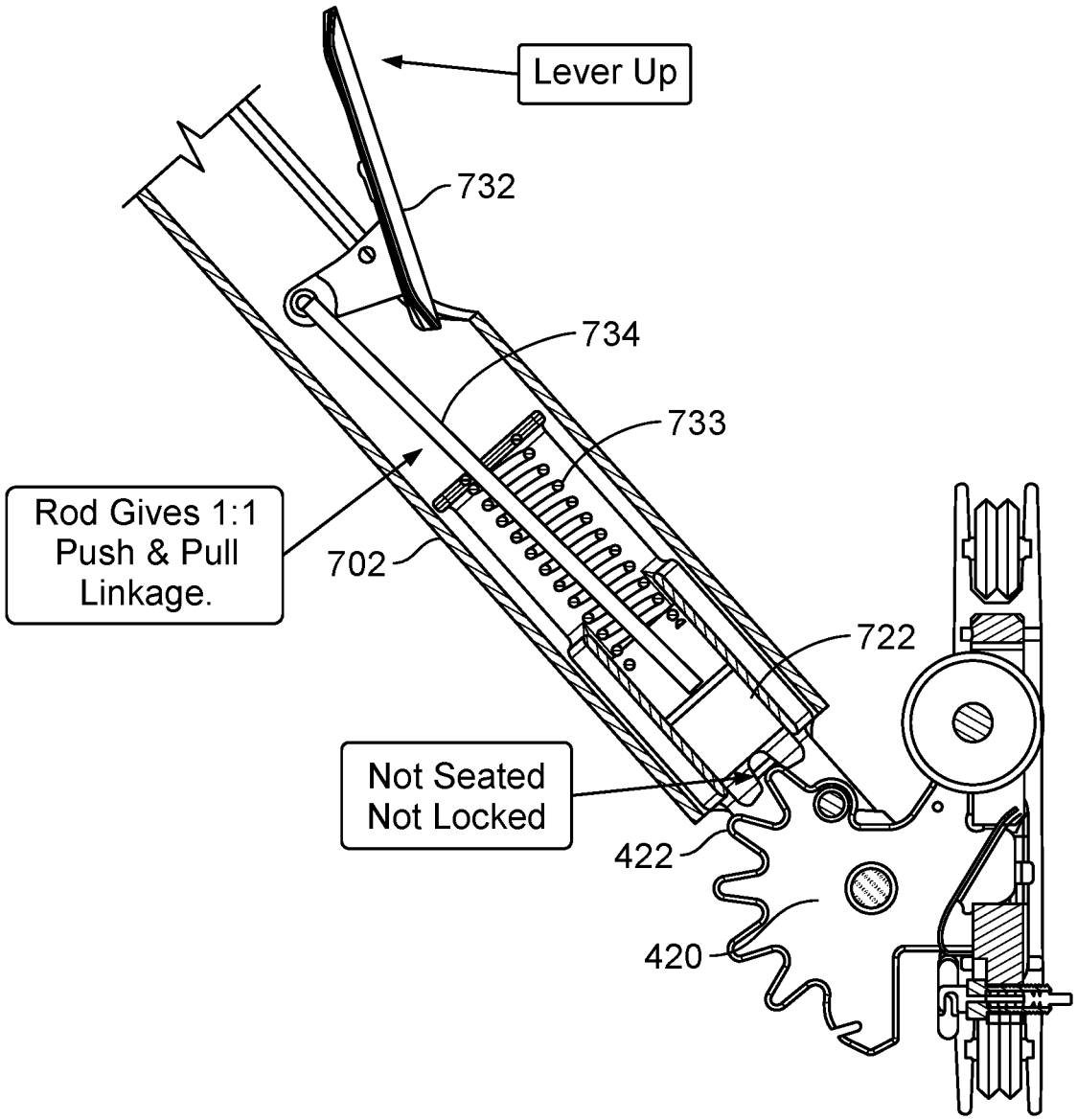
FIG. 7D illustrates a rod-based lever system for arm vertical pivoting.

FIG. 7D illustrates a rod-based lever system for arm vertical pivoting. In FIG. 7D, the arm (702) is shown in an unlocked position, where a rod (734) couples female locking member (722) and spring (733) with lever (732).

When the user pulls up on lever (732) of arm (702), the rod (734) pulls on spring (733) to release its compression, thus causing female locking member (722) to pull backward, disengaging from teeth (422) and slider (420). In one embodiment, squared teeth (422*a*) are used instead of the rounded teeth (422) shown in FIG. 7D.

With arm (702) thus disengaged, the user is free to pivot arm (702) up or down. To lock arm (702) to a new vertically pivoted position, the user positions the arm (702) until the teeth (422) mesh with member (722), the spring (733) compresses, and the rod (734) is pushed the lever (732) down in line with the arm (702). Because the rod (734) is a one-to-one push and pull linkage, the user has a physical cue that the arm is locked because the lever is down and inline with the arm (702).

Figure 7E:
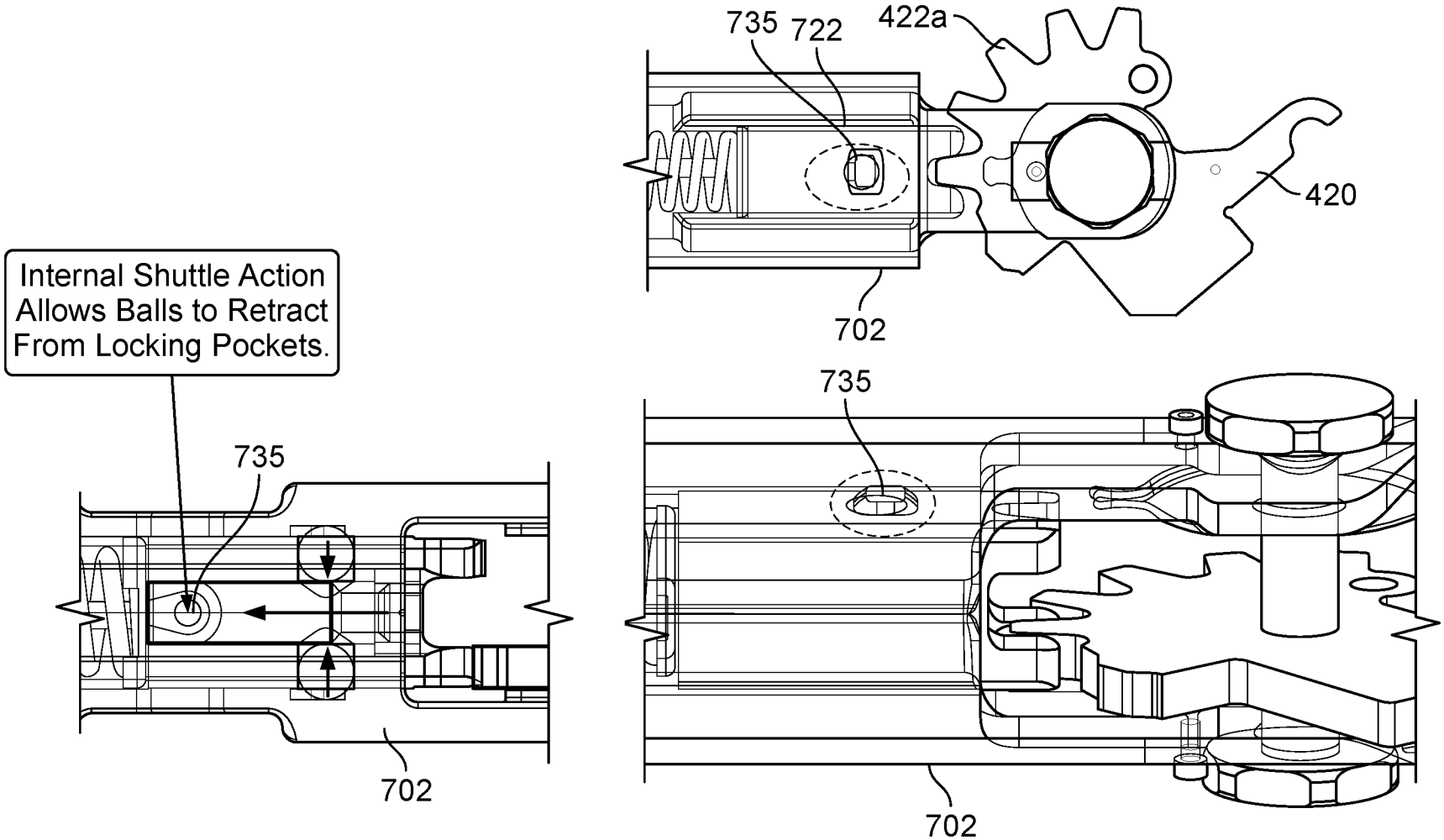
FIG. 7E illustrates a ball-locking system for arm vertical pivoting.

FIG. 7E illustrates a ball-locking system for arm vertical pivoting. In FIG. 7E, a side and top view is shown along with a perspective between side and top. The arm (702) is shown engaged with slider (420) by way of teeth (shown in FIG. 7E to be squared teeth (422*a*)) locked with member (722). A ball-lock (735) is used to mechanically lock tooth movement. An internal shuttle provides locking mechanism by allowing the ball to retract from a locking pocket. This provides a two-stage tooth action, to unlock and to move.

Without a system similar to a ball-locking system, certain movements down and with a side to side oscillation may produce small incremental movements of the tooth (422). Without a ball-lock, the spring (733) is primarily used to drive the tooth for engagement, and as an analogue system, the spring (733) pushes to force the interface surfaces. One issue that may arise is that even a small oscillation action of arm with constant down force may create a motion and loading situation that rock and racks the tooth back away from the gear.

Figure 7F:
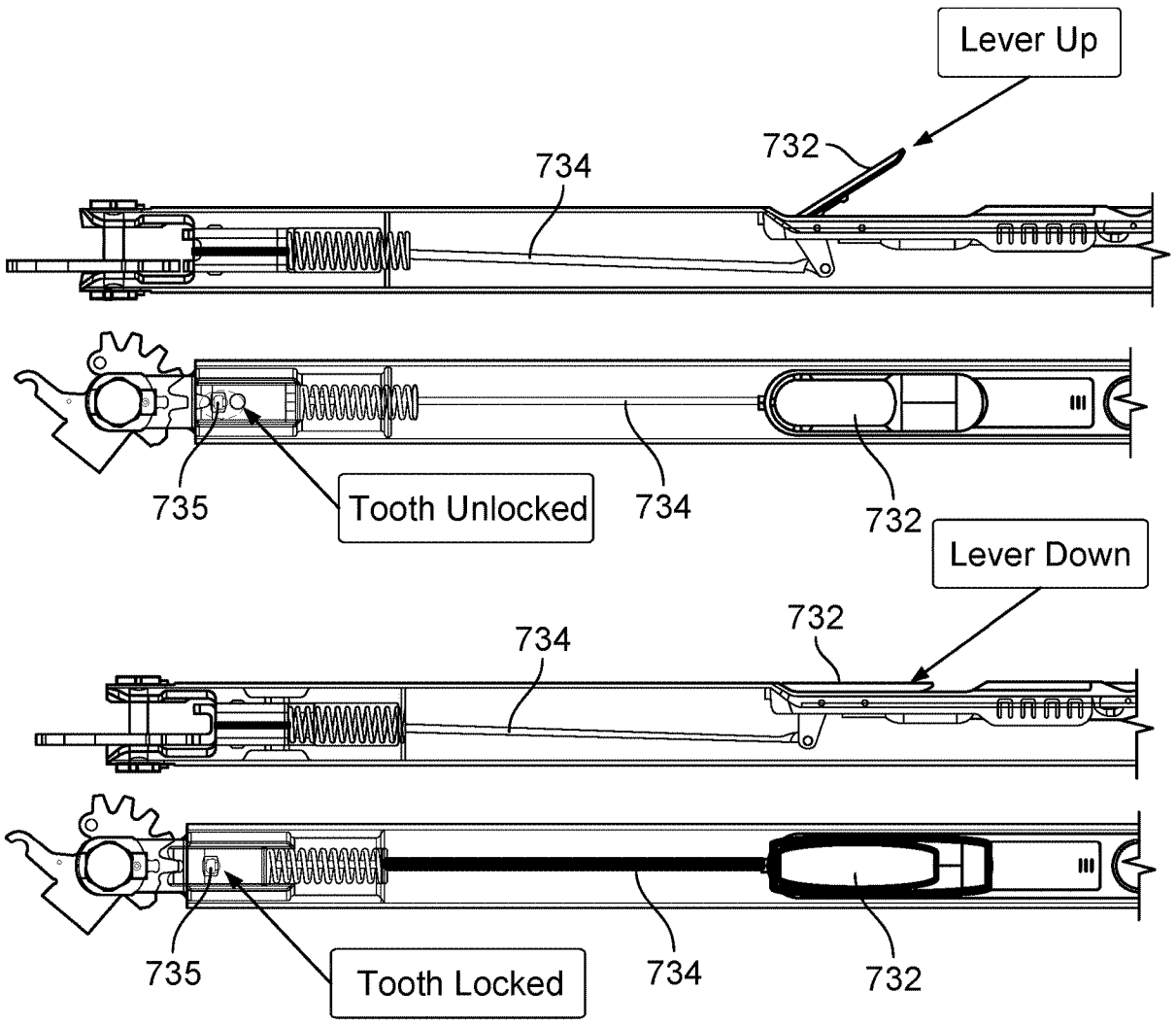
FIG. 7F illustrates a rod and ball-lock system for arm vertical pivoting.

FIG. 7F illustrates a rod and ball-lock system for arm vertical pivoting. In FIG. 7F, a side and top view is shown on the top when a lever (732) is up, and a side and top view is shown on the bottom when a lever (732) is down. In both cases, a rod (734) provides a one-to-one push-pull linkage to the ball-lock (735) mechanism. Thus, when the lever is up, the coupling unlocks the ball-lock and teeth (422). Alternately when the lever is seated, the coupling locks the ball-lock and teeth (422). Thus the lever changes to provide more stroke.

Horizontal Pivot. The arms may pivot horizontally around the sliders to provide user origination points for actuators (800,802) closer or further apart from each other for different exercises. In one embodiment, track (402) pivots, thus allowing arm (702) to pivot.

Figure 8B:
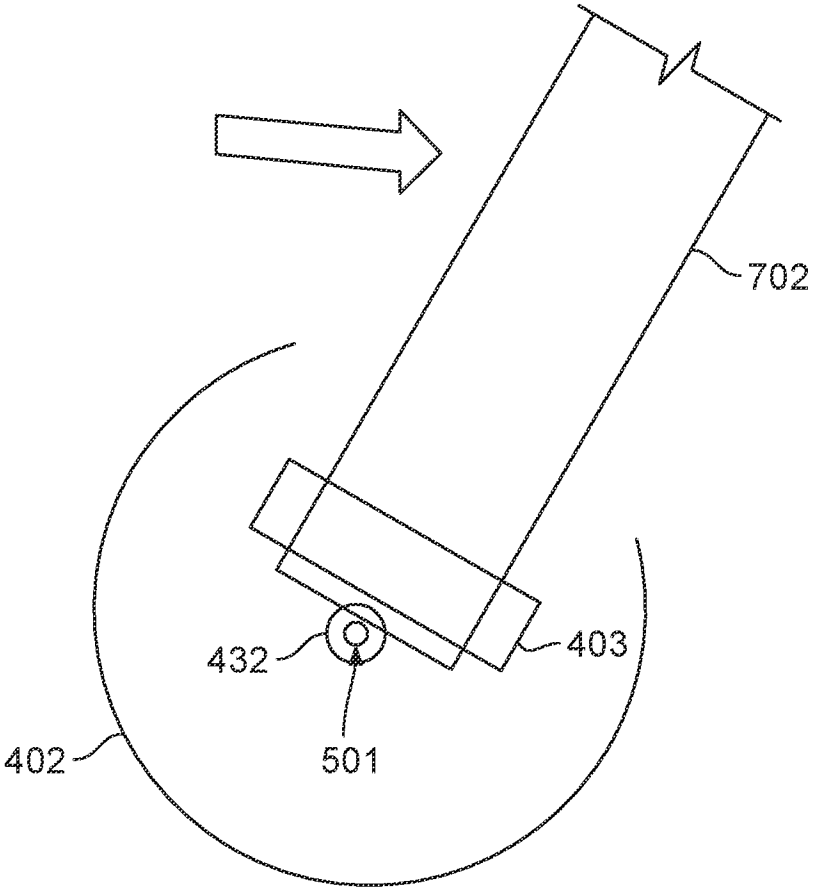
FIGS. 8A and 8B illustrate a top view of a track that pivots horizontally.
Figure 8A:
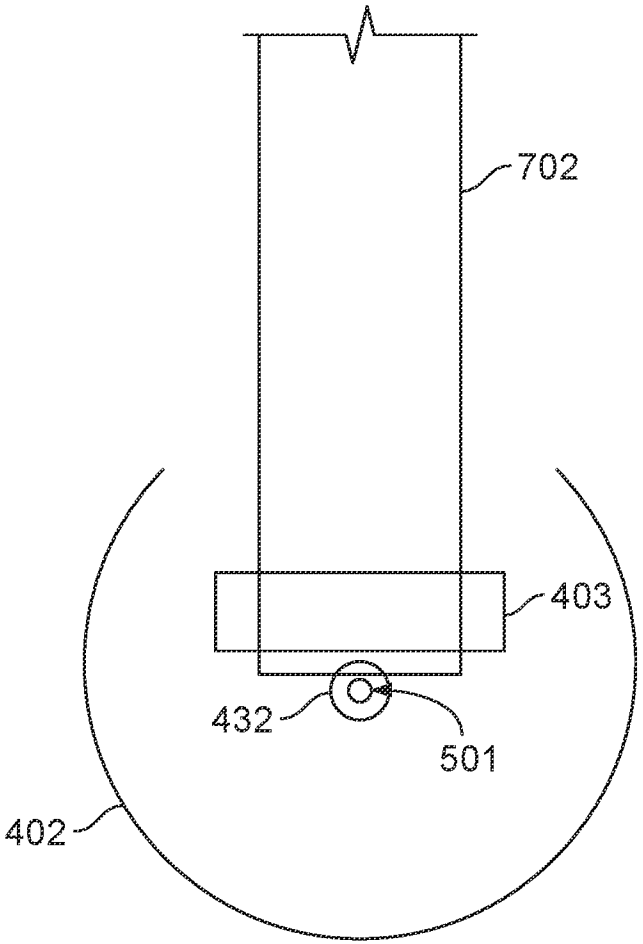

FIGS. 8A and 8B illustrate a top view of a track that pivots horizontally. In FIG. 8A, arm (702) is positioned straight out from the machine, in a 90 degree orientation to the face of the machine. Arm (702) may be locked to slider as shown in FIG. 7A. Further, slider (403) may be locked into track (402) as shown in FIG. 5A.

FIG. 8B shows all of track (402), slider (403), and arm (702) pivoted to the right around hole (432). The user may do this simply by moving the arm left or right when it is in an unlocked position.

Figure 9C:
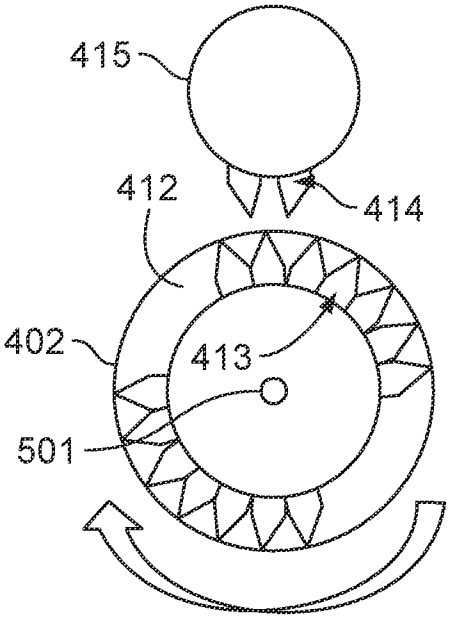
FIG. 9C shows device locking member (415) having been pulled back from top member (412).
Figure 9B:
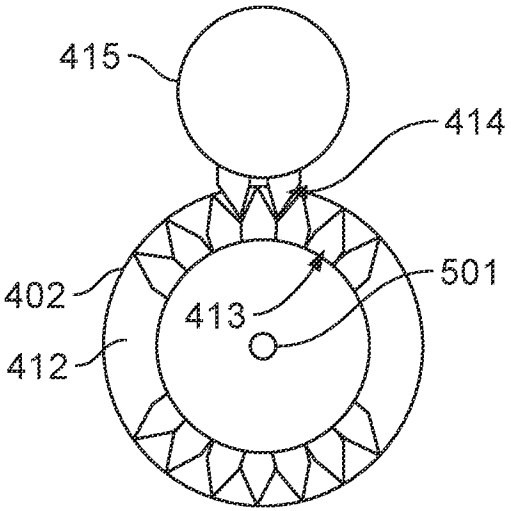
FIG. 9B shows a top view of arm (402).
Figure 9A:
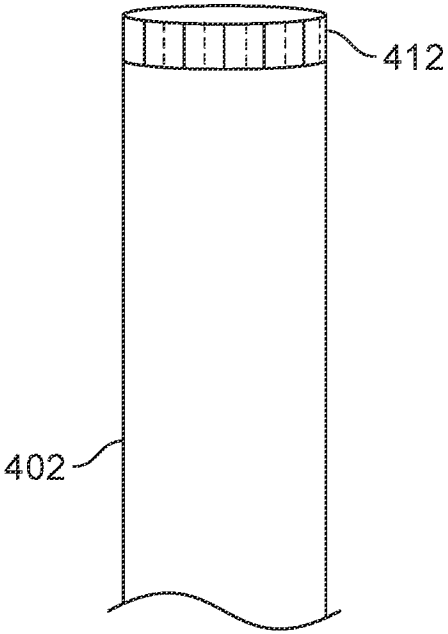
FIG. 9A shows column (402) from a side view.

FIGS. 9A, 9B, and 9C illustrate a locking mechanism for a horizontal pivot. FIG. 9A shows column (402) from a side view. This view shows top member (412). In one embodiment, the bottom of track 402 not shown in FIG. 9A has a corresponding bottom member (412*a*, not shown), with the same function and operation as top member (412).

FIG. 9B shows a top view of arm (402). This view shows that top member (412) and corresponding bottom member (412*a*) both have teeth (413). Teeth (413) can be placed around the entire circumference of top member (412), or just specific arcs of it corresponding to the maximum rotation or desired positions of track (402).

FIG. 9B shows track (402) in a locked position as the teeth (414) of a device locking member (415) are tightly coupled to teeth (413). This tight coupling prevents track (402), and thus arm (702) from pivoting left or right, horizontally.

FIG. 9C shows device locking member (415) having been pulled back from top member (412). In one embodiment, device locking member (415) uses a similar compression spring mechanism as shown in FIGS. 7A and 7B. This, together with the pulling back for bottom member (412*a*), frees up track (402) to rotate freely around cable (501). To do this, the user simply rotates arm (702) left or right, as desired. In one embodiment, a mechanism is used to permit the simultaneous unlocking and locking of top/bottom members (412, 412*a*).

Figure 9E:
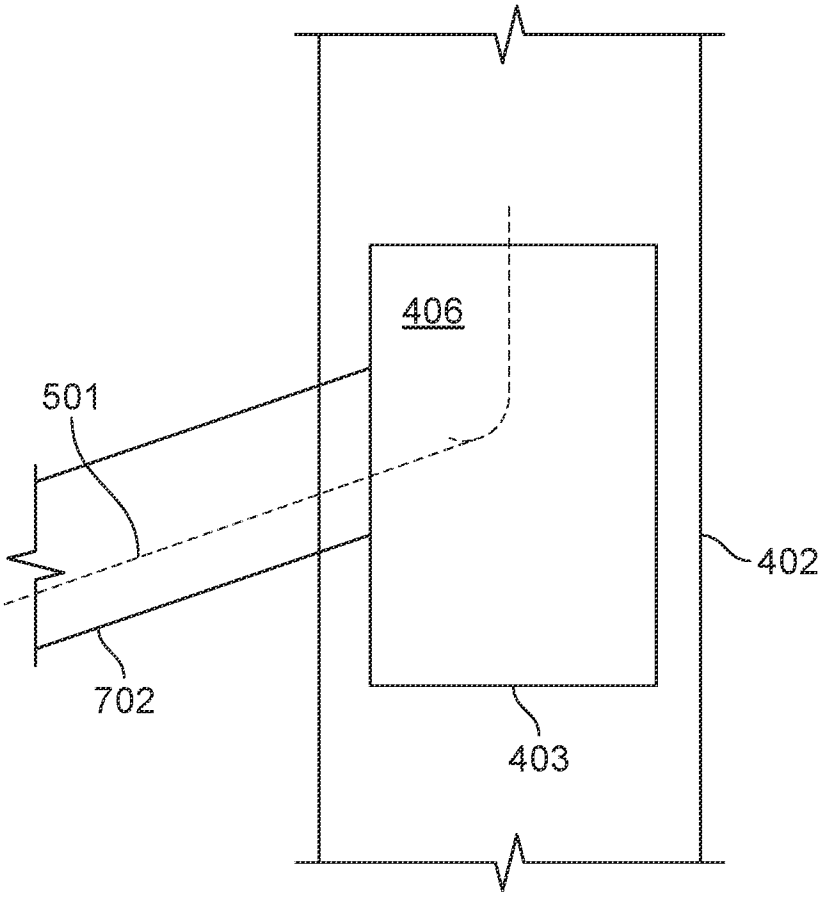
FIG. 9E shows the front view, now with arm (702) traveling down and to the left.
Figure 9D:
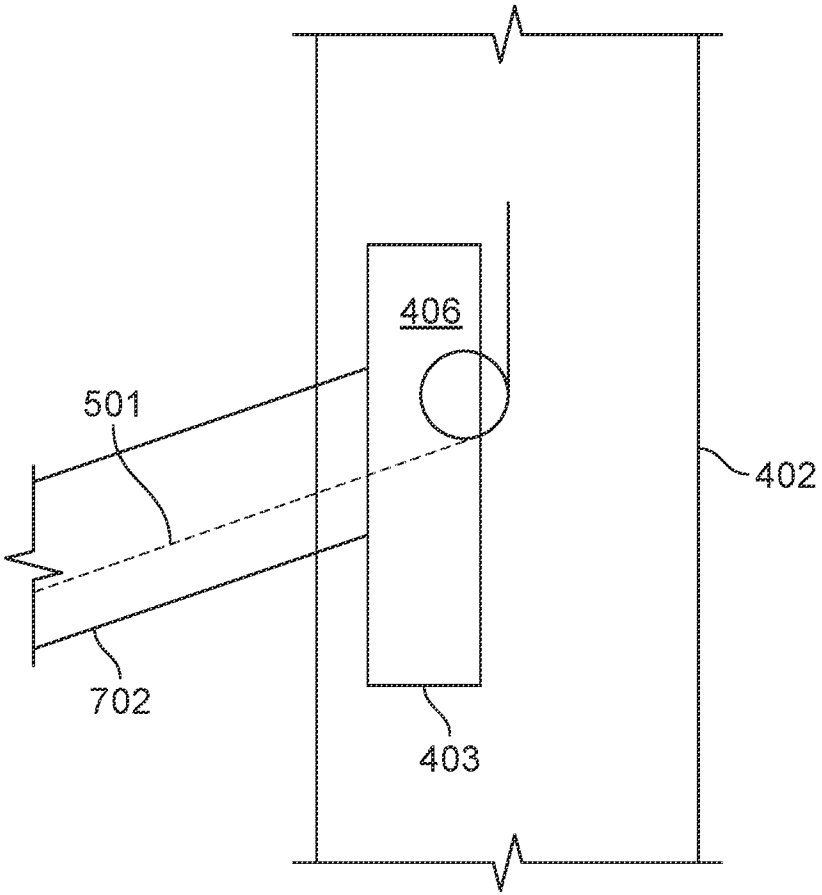
FIG. 9D shows a side view of track (402) with cable (501) located in the center of track (402), and arm (702) traveling down and directly away from the machine.

Concentric Path. In order for cable (501) to operate properly, bearing high loads of weight, and allow the track to rotate, it should always remain and travel in the center of track (402), no matter which direction arm (702) is pointed or track (402) is rotated. FIGS. 9D and 9E illustrate a concentric path for cabling.

FIG. 9D shows a side view of track (402) with cable (501) located in the center of track (402), and arm (702) traveling down and directly away from the machine. FIG. 9E shows the front view, now with arm (702) traveling down and to the left. In both views of FIG. 9D and FIG. 9E, cable (501) is directly in the center of track (402). The system achieves this concentric path of cable (501) by off-centering slider (403) and including pulley (406) that rotates horizontally as arm (702), slider (403), and track (402) rotate.

Figure 9F:
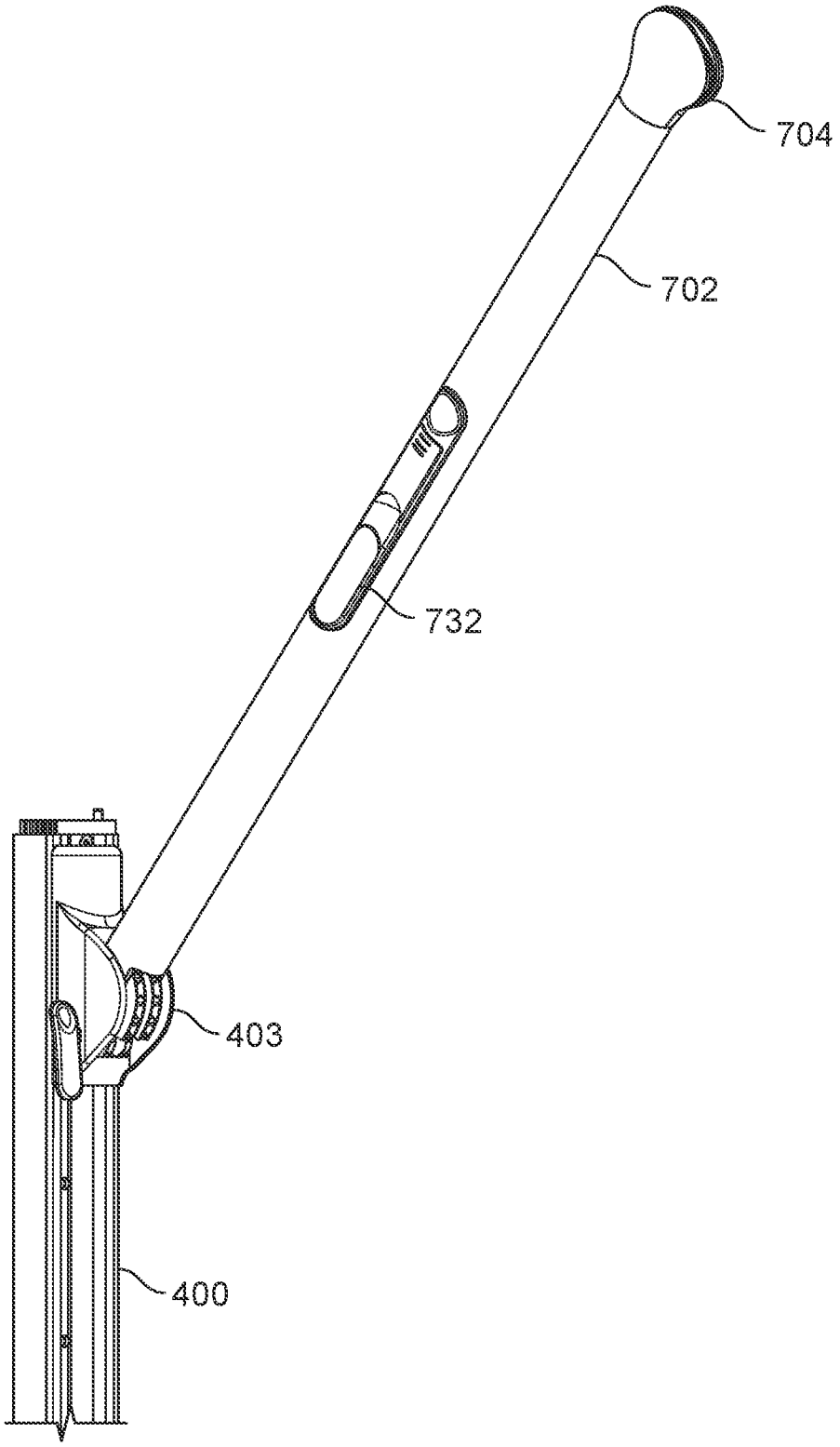
FIG. 9F is a perspective view of an exercise machine arm extended upward.
Figure 9G:
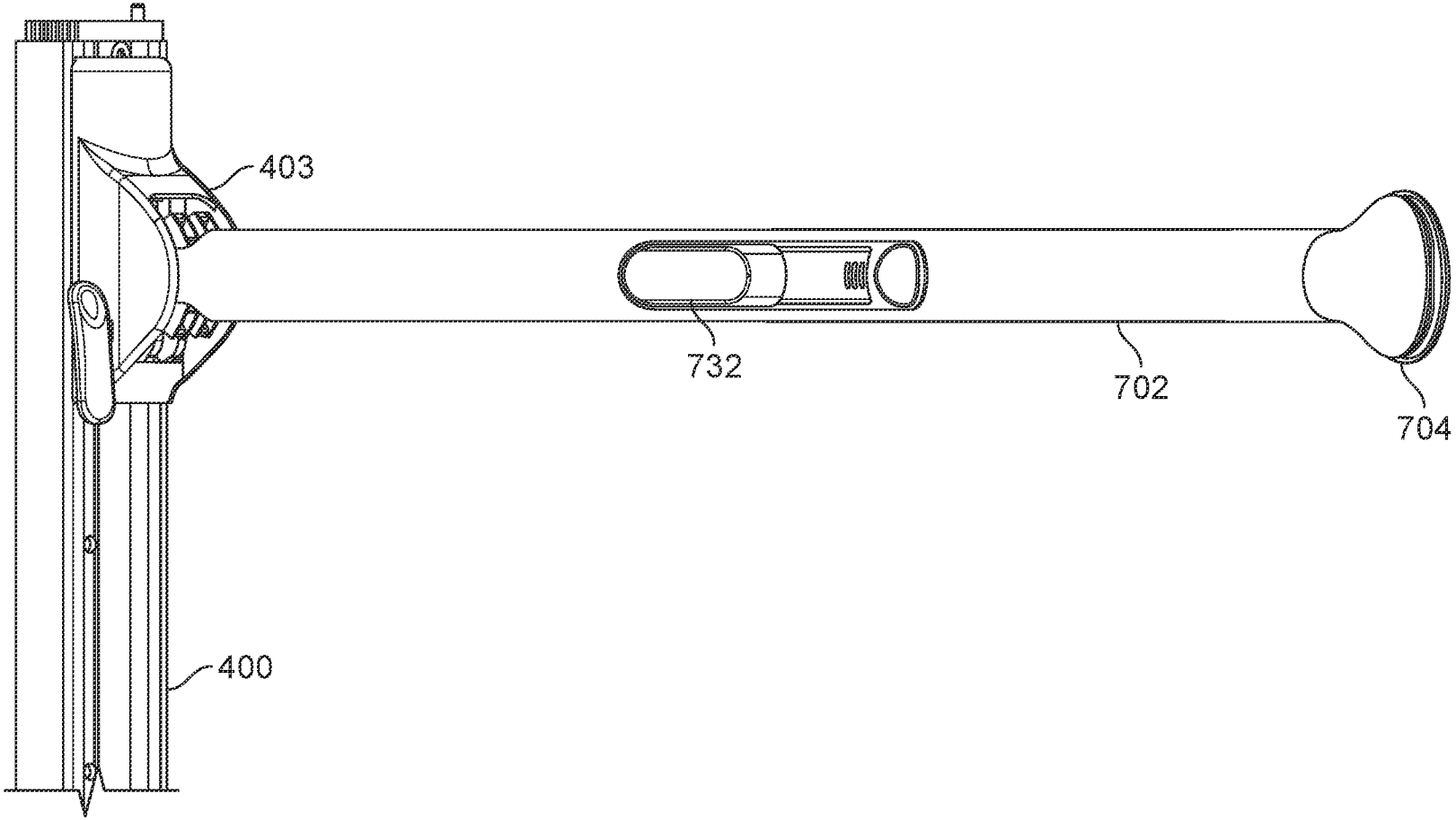
FIG. 9G is a perspective view of an exercise machine arm extended horizontally.
Figure 9H:
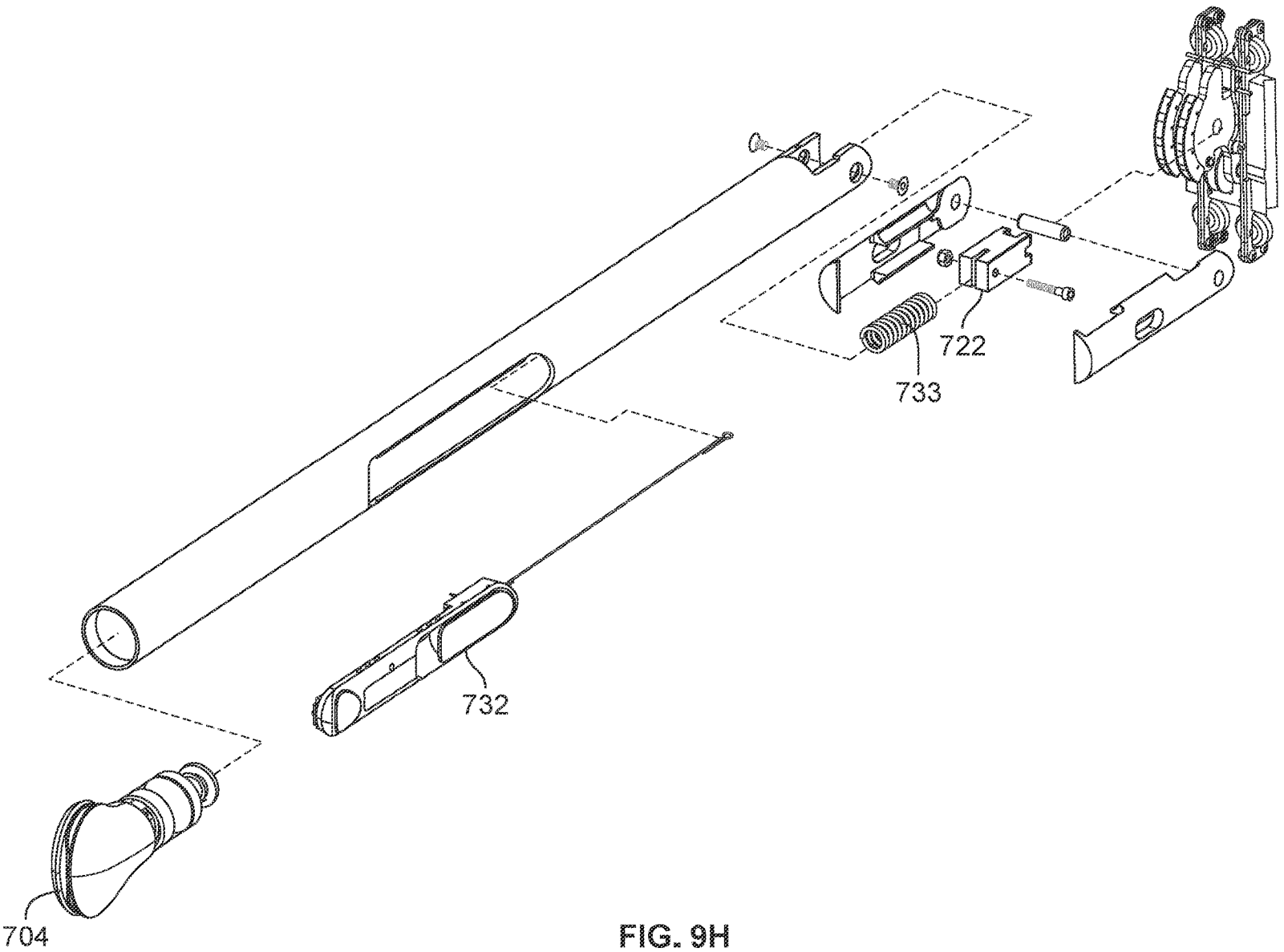
FIG. 9H illustrates an exploded perspective view drawing of an arm (702) including its lever (732), compression spring (733), and locking member (722).
Figure 9I:
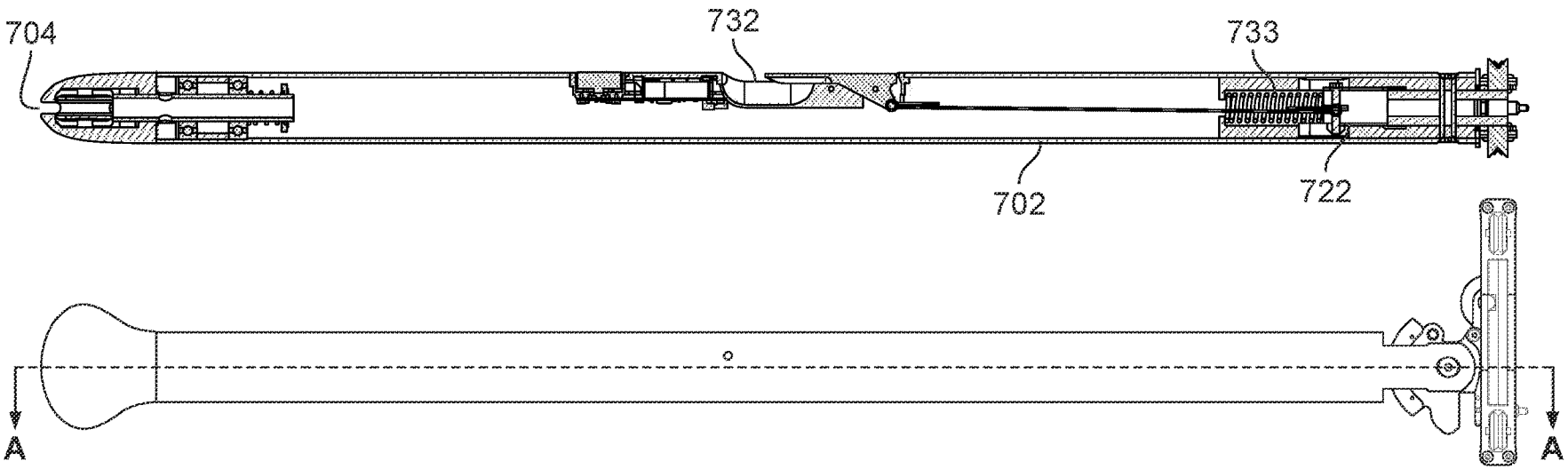
FIG. 9I illustrates both an assembled sectioned and non-sectioned perspective view drawing of the arm (702).

Arm Mechanical Drawings. FIGS. 9F-9X illustrate mechanical drawings of the arm (700, 702), components coupled to the arm such as the slider (401,403), and various features of the arm. FIG. 9F is a perspective view of an exercise machine arm extended upward. FIG. 9F is a view from the side of an arm (702) extended upward on an angle and its associated column (400), with the arm at its highest position along the column (400). FIG. 9G is a perspective view of an exercise machine arm extended horizontally. FIG. 9G is a view from the side of an arm (702) extended straight horizontally and its associated column (400), with the arm at its highest position along the column (400). FIG. 9H illustrates an exploded perspective view drawing of an arm (702) including its lever (732), compression spring (733), and locking member (722). FIG. 9I illustrates both an assembled sectioned and non-sectioned perspective view drawing of the arm (702).

Figure 9J:
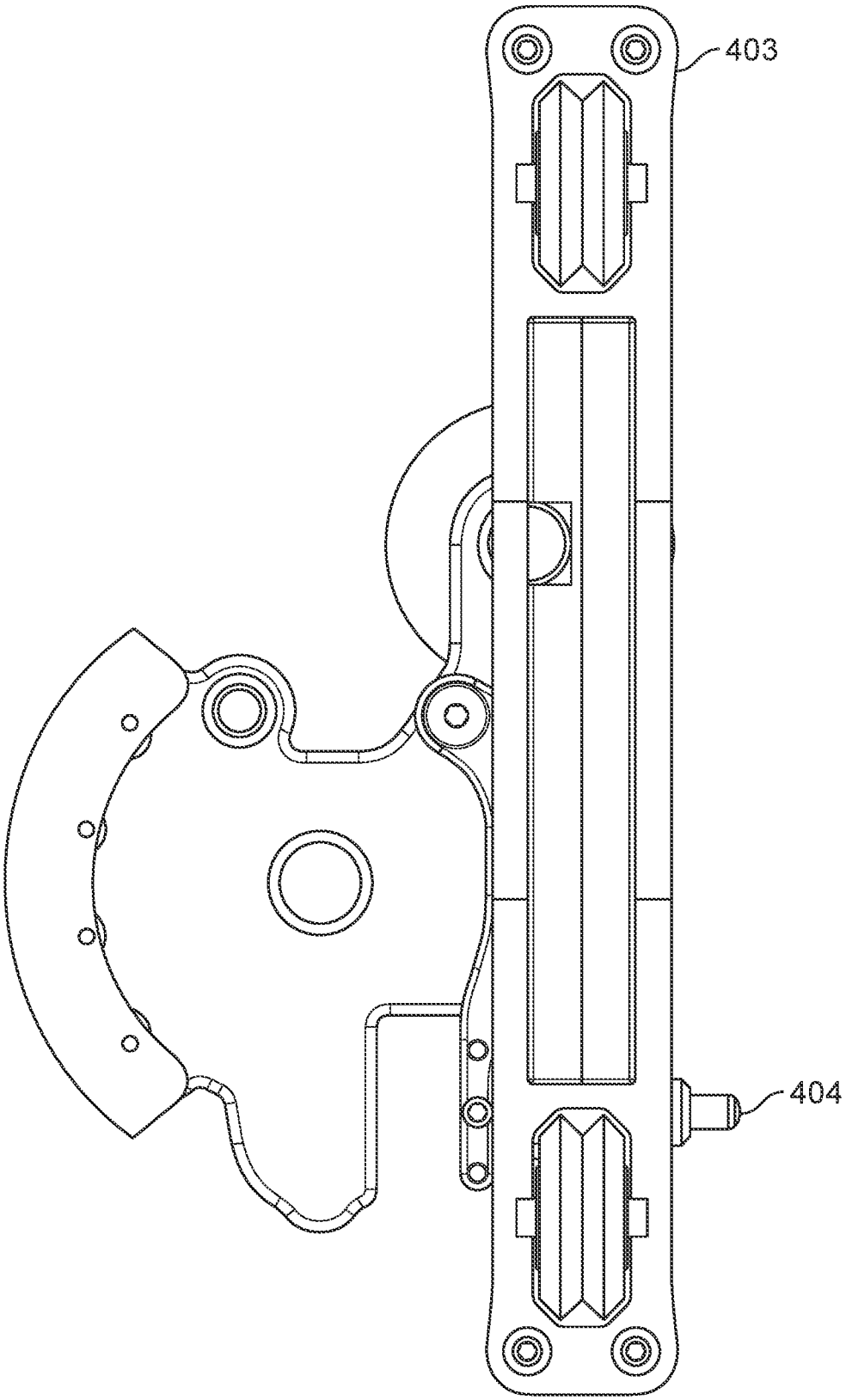
FIG. 9J is a side view section of an exercise machine slider (403) with its locking mechanism and pin locked.
Figure 9K:
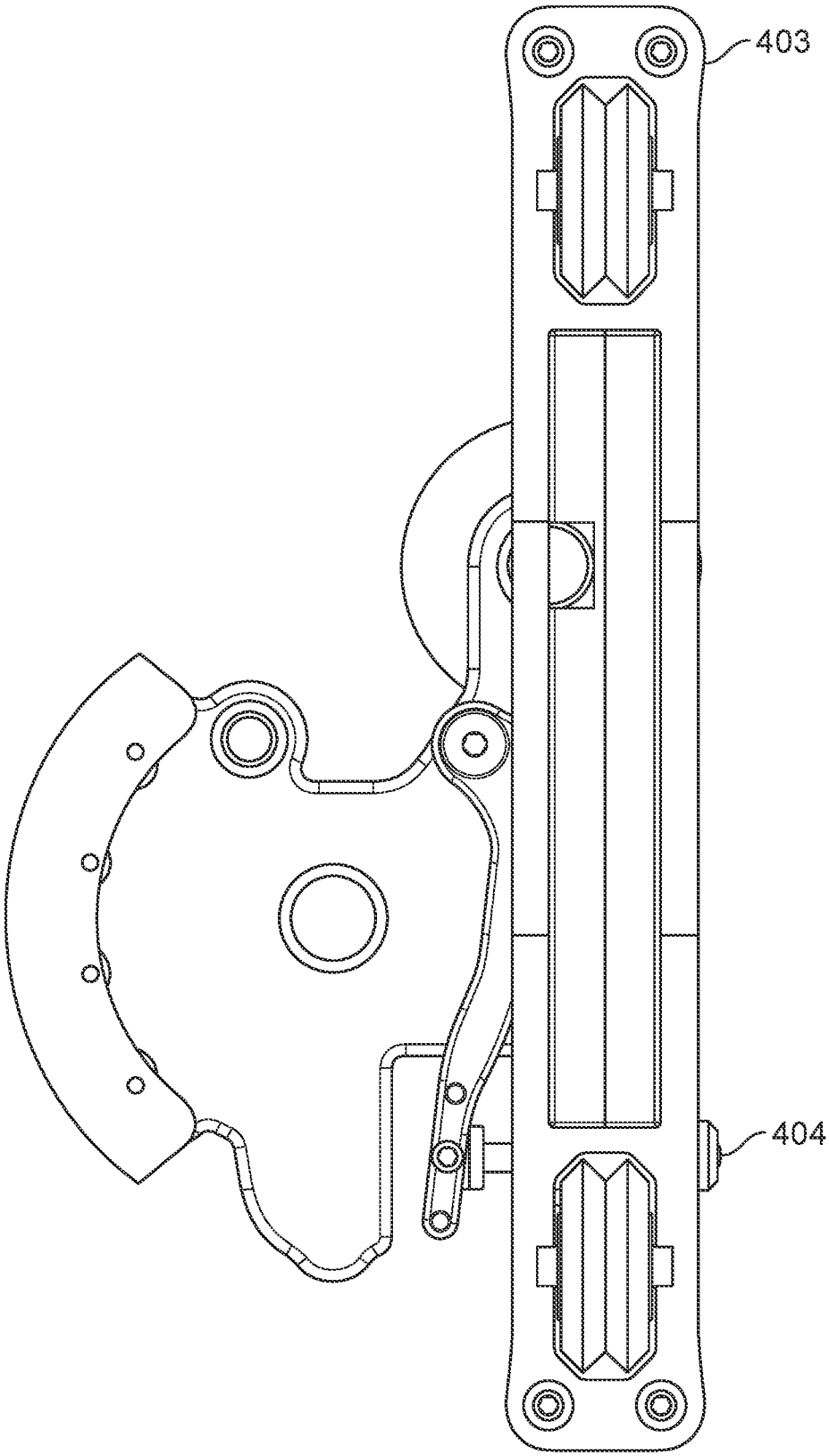
FIG. 9K is a side view section of an exercise machine slider (403) with its locking mechanism and pin unlocked.
Figure 9L:
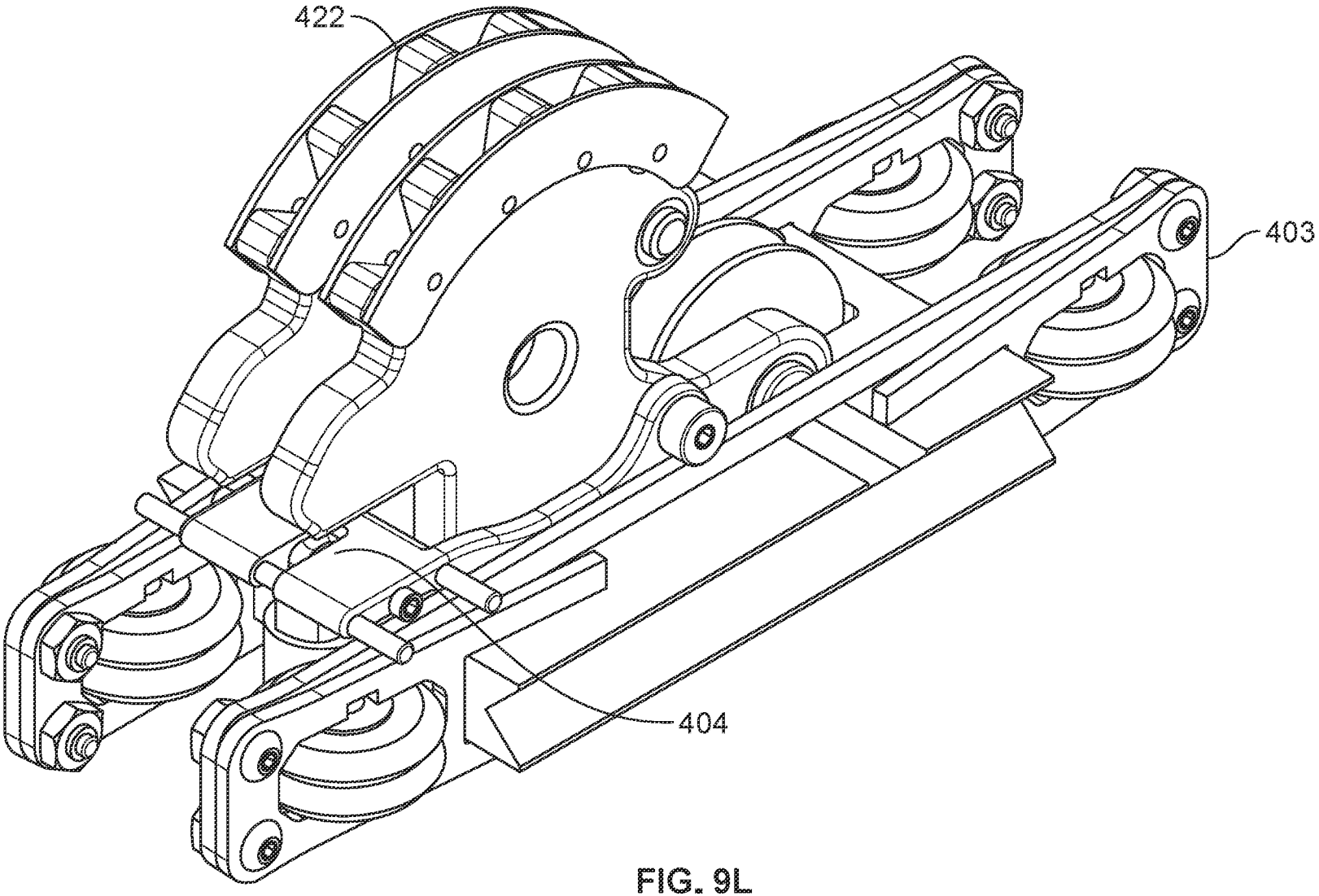
FIG. 9L is a perspective view of an exercise machine slider (403), revealing the pin (404) as well as teeth (422) for an arm vertical pivot.
Figure 9M:
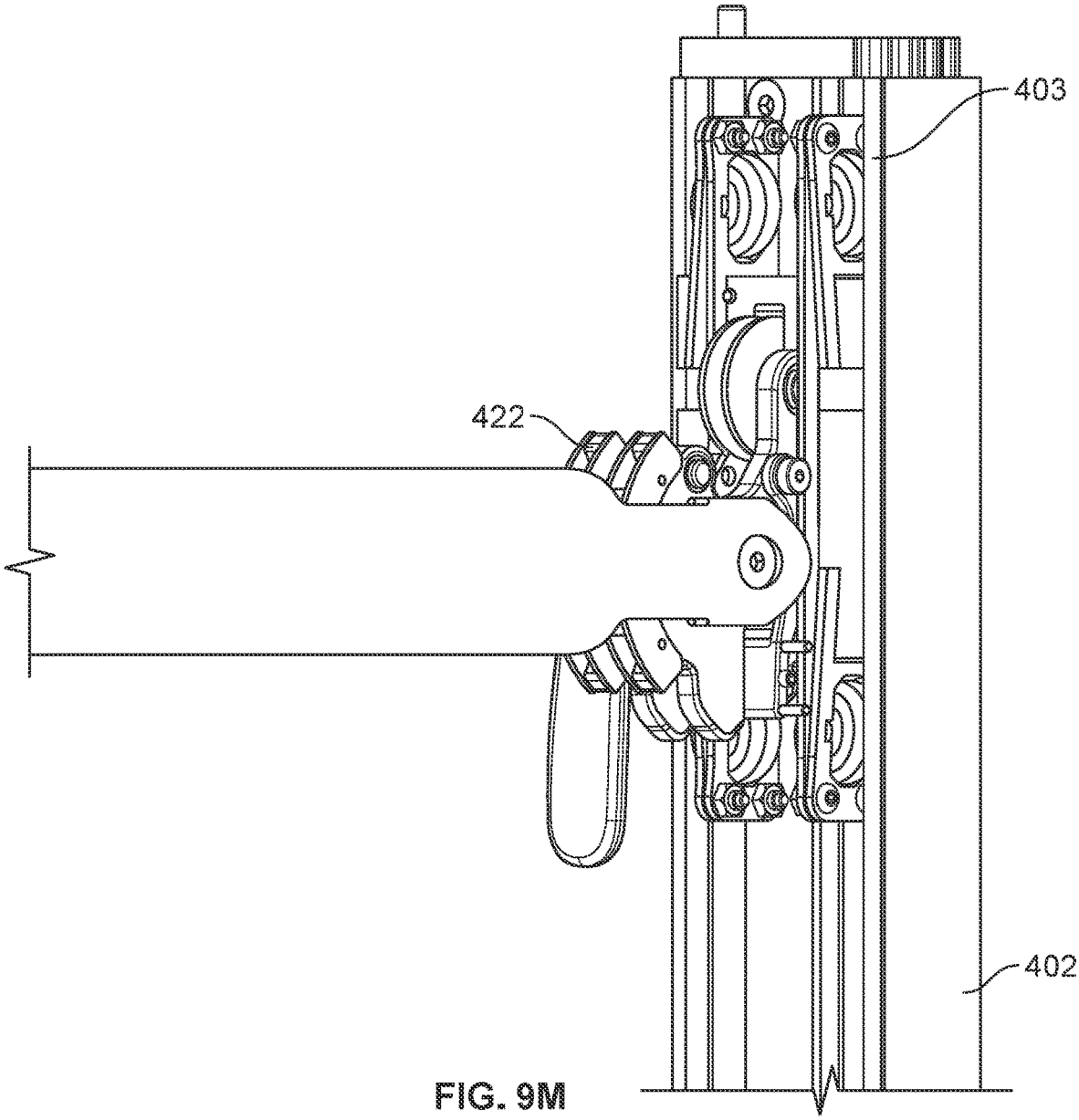
FIG. 9M is a perspective view of the exercise machine slider (403) in a column/rail (402) with revealed teeth (422), with arm (702) set at a vertical pivot at a point parallel to the horizontal plane.
Figure 9N:
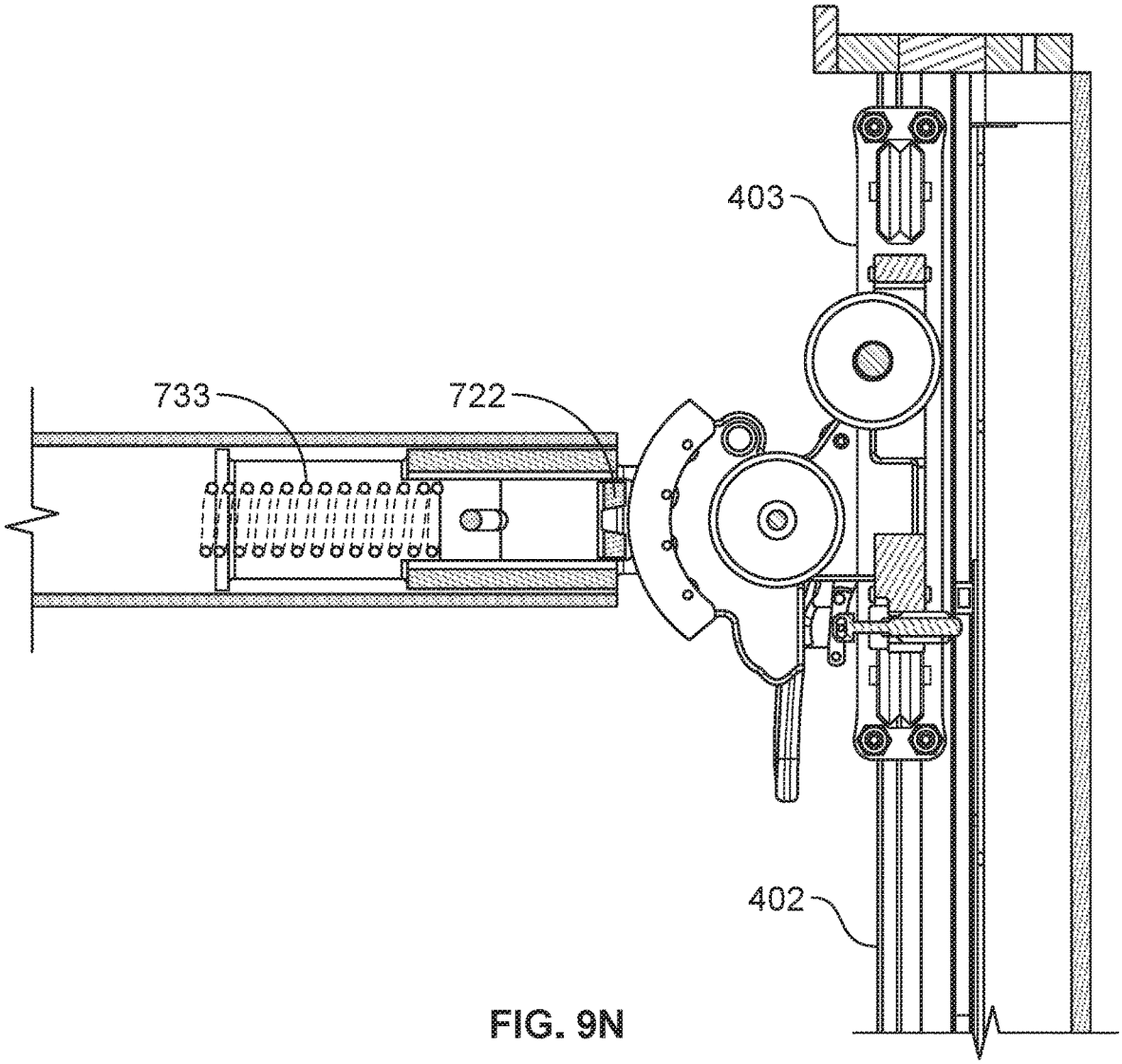
FIG. 9N is a side view section of the exercise machine slider (403) in a column/rail (402), with arm (702) set at a vertical pivot at a point parallel to the horizontal plane.
Figure 9P:
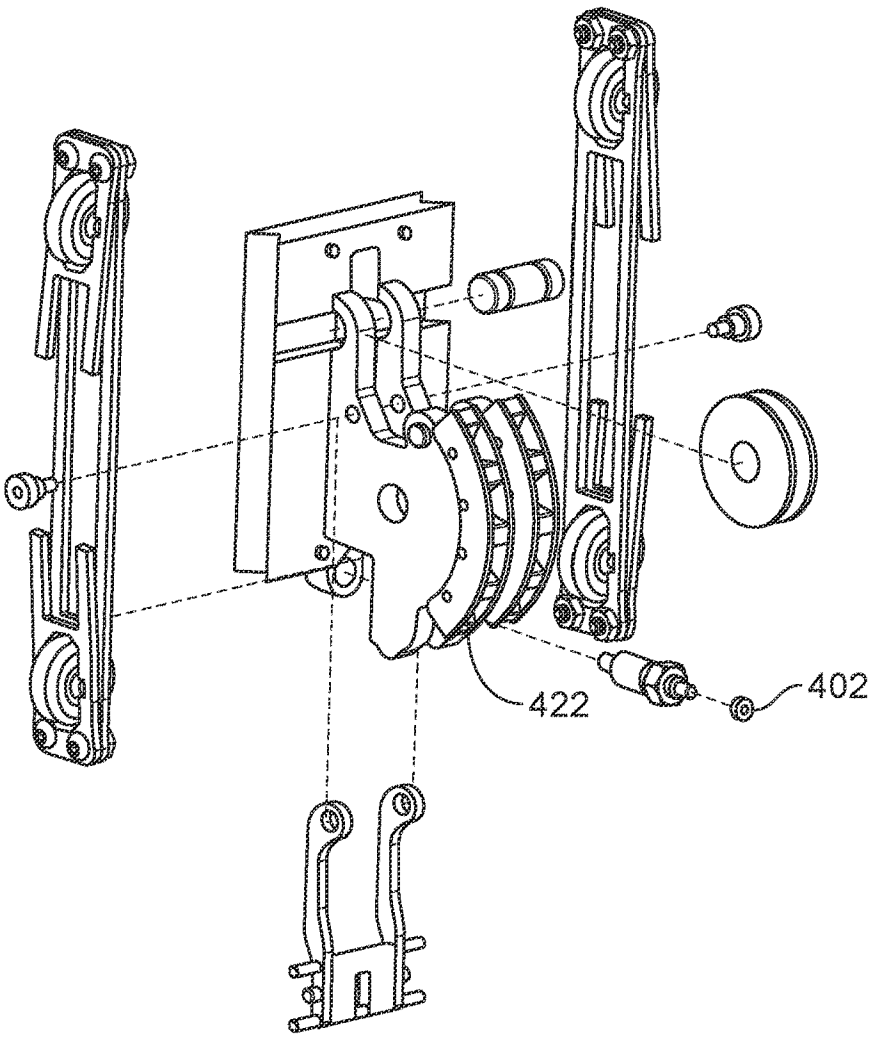
FIG. 9P illustrates an exploded perspective view drawing of the exercise machine slider (403).
Figure 9O:
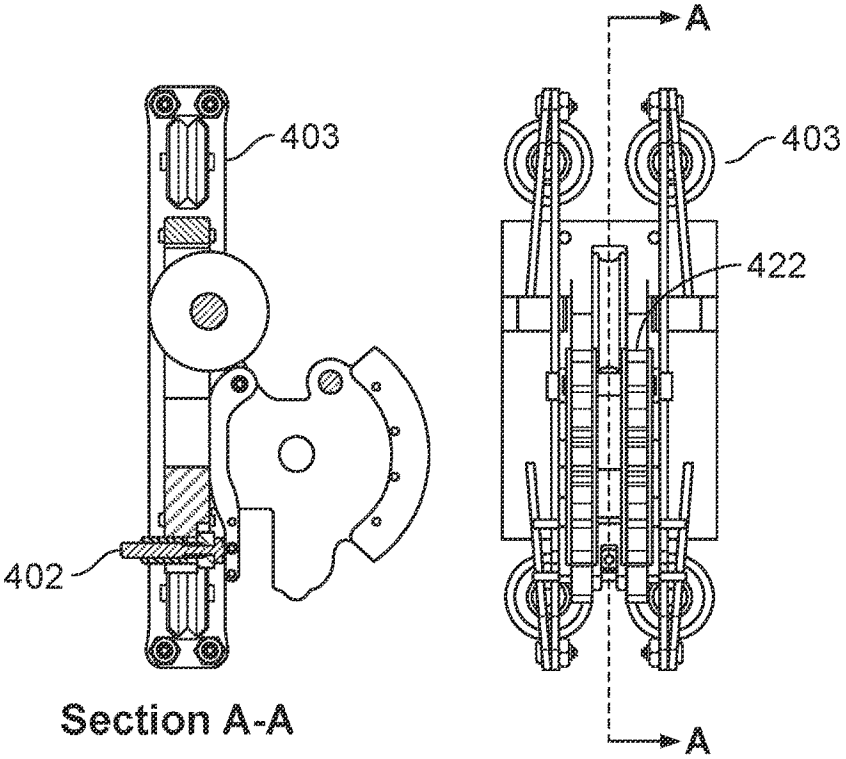
FIG. 9O is a sectional side view of the exercise machine slider (403).

FIG. 9J is a side view section of an exercise machine slider (403) with its locking mechanism and pin locked. FIG. 9K is a side view section of an exercise machine slider (403) with its locking mechanism and pin unlocked. FIG. 9L is a perspective view of an exercise machine slider (403), revealing the pin (404) as well as teeth (422) for an arm vertical pivot. FIG. 9M is a perspective view of the exercise machine slider (403) in a column/rail (402) with revealed teeth (422), with arm (702) set at a vertical pivot at a point parallel to the horizontal plane. FIG. 9N is a side view section of the exercise machine slider (403) in a column/rail (402), with arm (702) set at a vertical pivot at a point parallel to the horizontal plane. The female locking member (722) and compression spring (733) are visible within the section of FIG. 9N. FIG. 9O is a sectional side view of the exercise machine slider (403). FIG. 9P illustrates an exploded perspective view drawing of the exercise machine slider (403).

Figure 9Q:
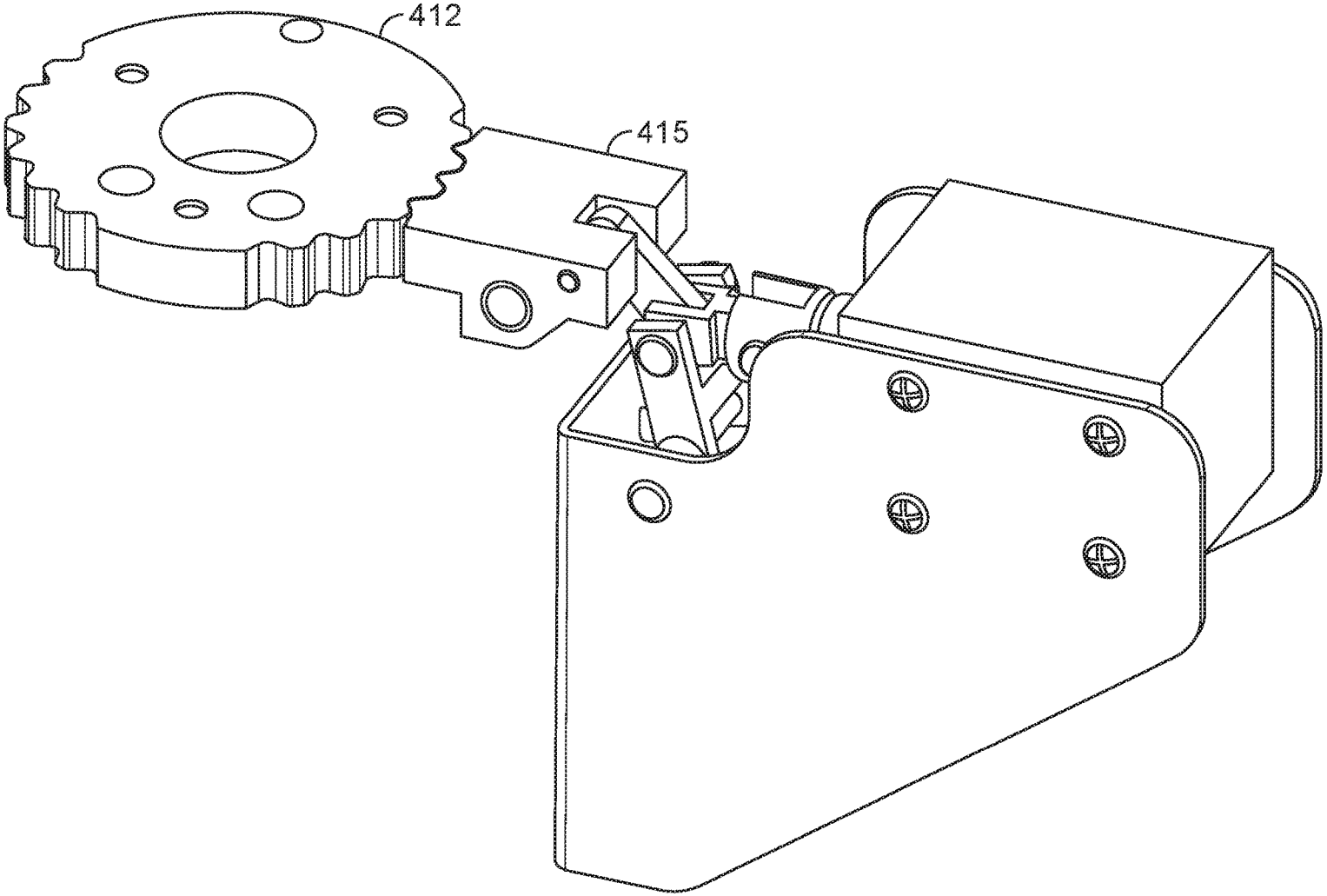
FIG. 9Q is a perspective view of a column locking mechanism for a horizontal pivot.
Figure 9R:
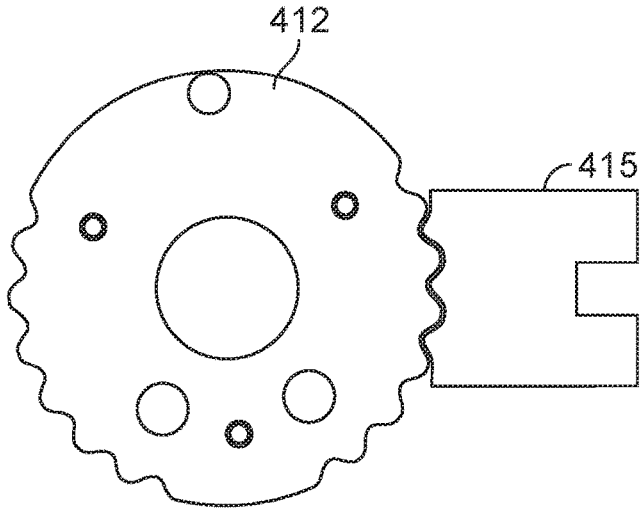
FIG. 9R is a top view of the top member (412).
Figure 9S:
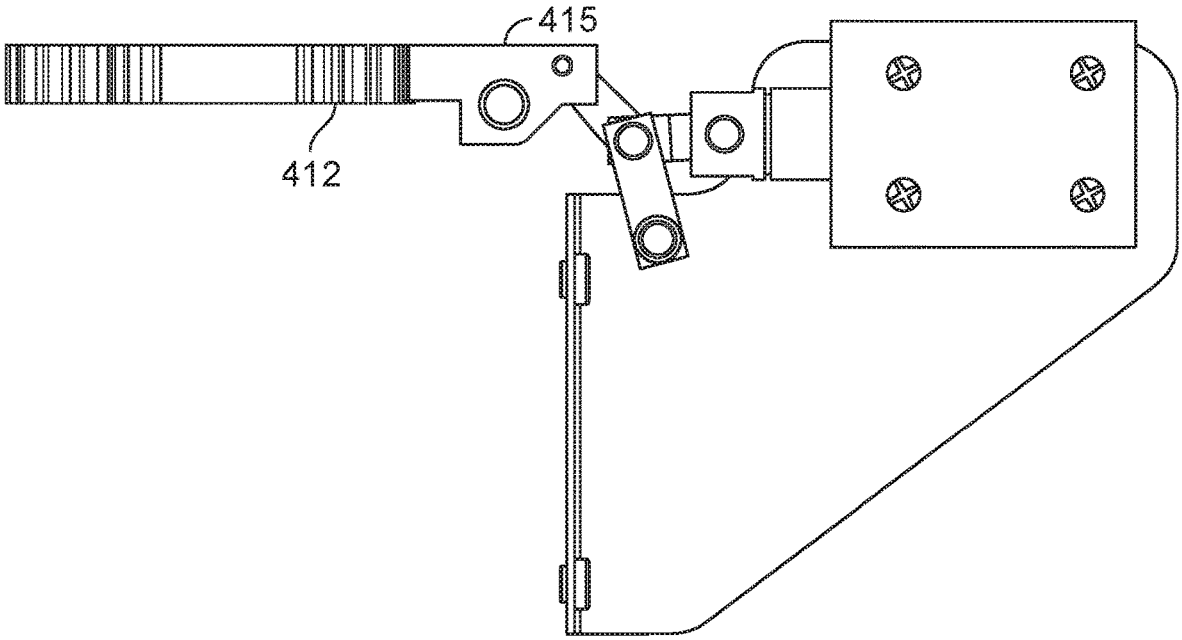
FIG. 9S is a side view of the column locking mechanism for the horizontal pivot.
Figure 9T:
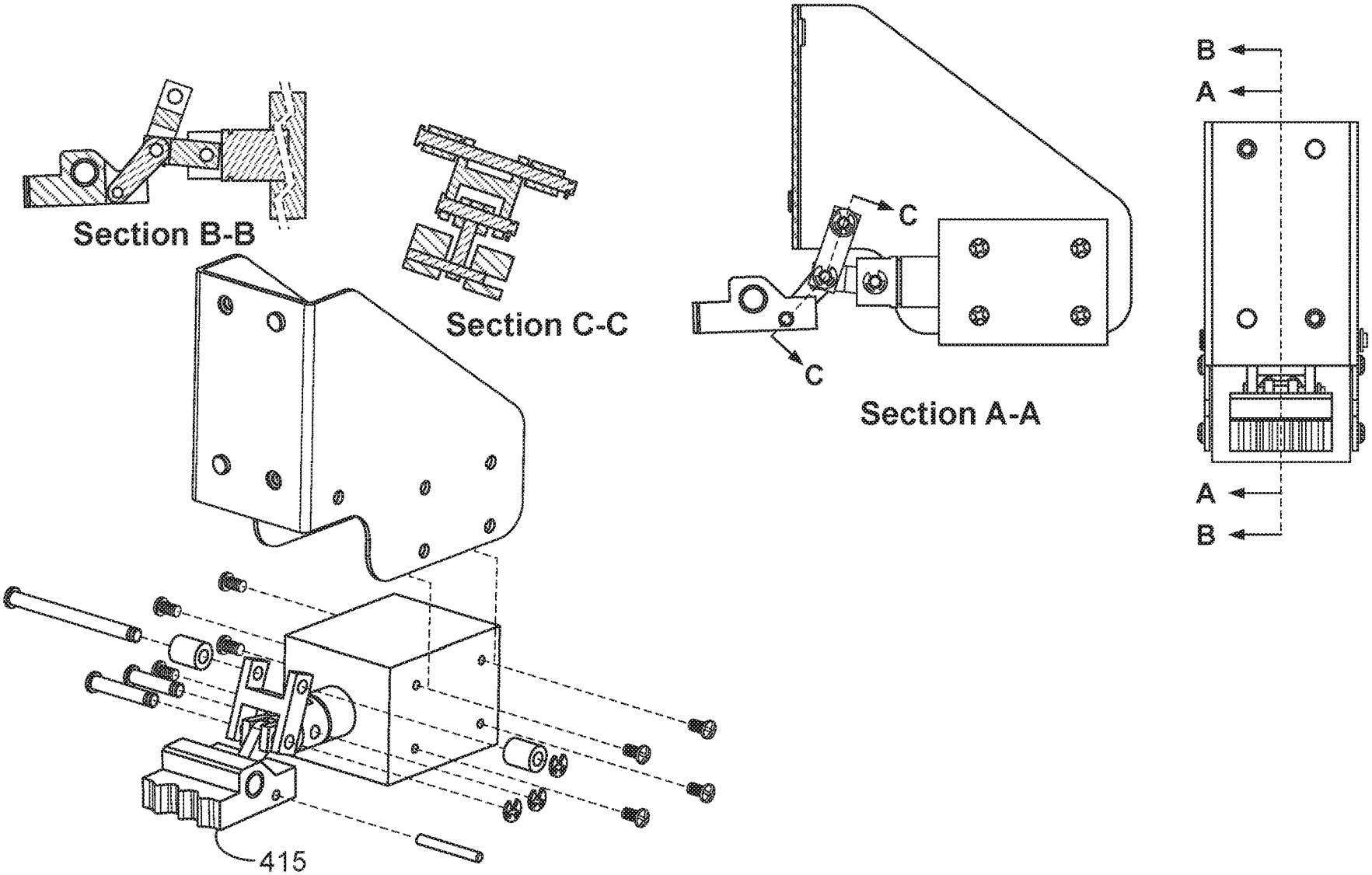
FIG. 9T illustrates an exploded perspective view drawing of the column locking mechanism including locking member (415).

FIG. 9Q is a perspective view of a column locking mechanism for a horizontal pivot. FIG. 9Q shows both top member (412) interfacing with the device locking member (415). FIG. 9Q shows without limitation a solenoid mechanism for controlling the device locking member (415). FIG. 9R is a top view of the top member (412), and FIG. 9S is a side view of the column locking mechanism for the horizontal pivot. FIG. 9T illustrates an exploded perspective view drawing of the column locking mechanism including locking member (415).

Figure 9V:
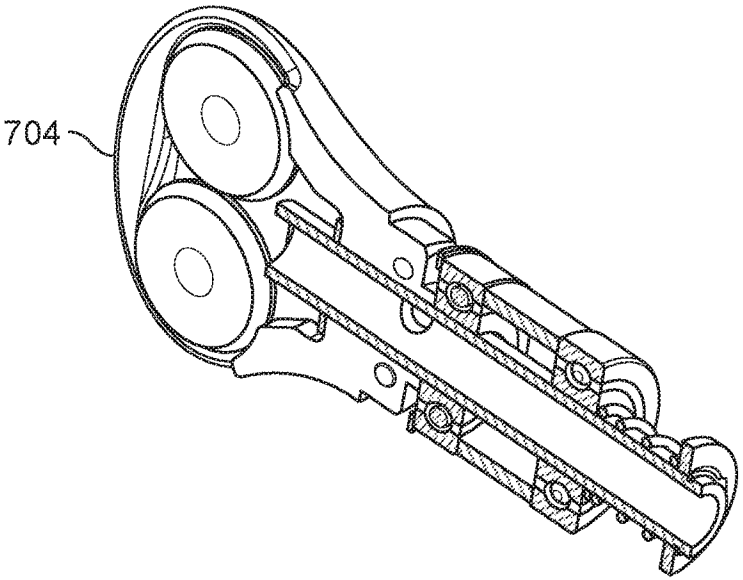
FIG. 9V is a perspective section of the wrist (704).
Figure 9U:
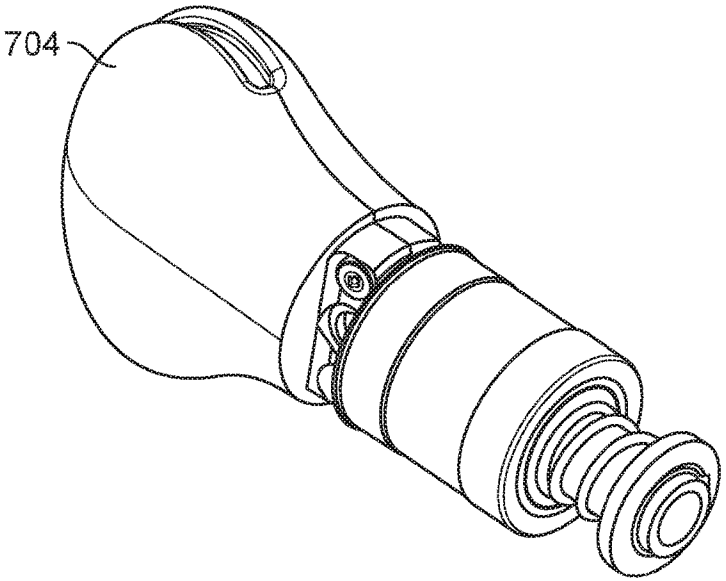
FIG. 9U is a perspective view of a wrist (704), showing a spring mechanism that enables access to the interior of the wrist (for example, to the bolts shown in FIGS. 9V and 9W) in order to, for example, service the wrist.
Figure 9W:
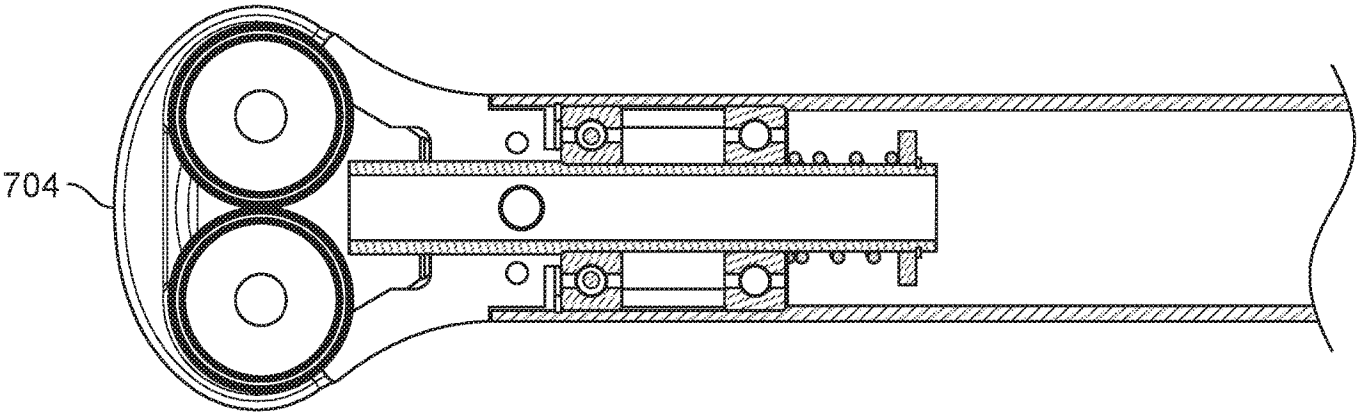
FIG. 9W is a side view section of the wrist (704).
Figure 9X:
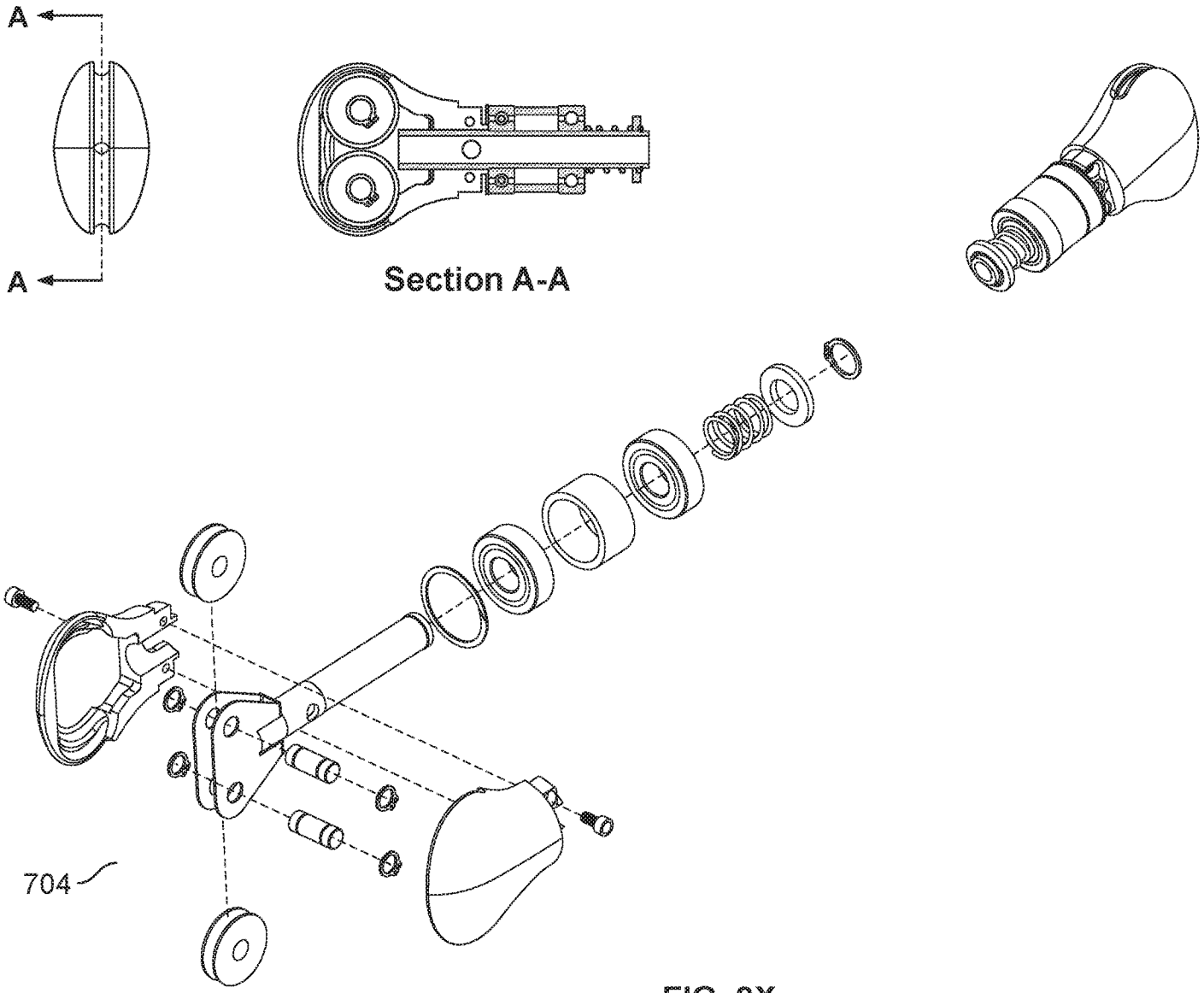
FIG. 9X illustrates an exploded perspective view drawing of the wrist (704).

In one embodiment, the user origination point (704) is a configurable "wrist" to allow local rotation for guiding the cable (500, 501). FIG. 9U is a perspective view of a wrist (704), showing a spring mechanism that enables access to the interior of the wrist (for example, to the bolts shown in FIGS. 9V and 9W) in order to, for example, service the wrist. This has the benefit of concealing aspects of the wrist without preventing access to them. FIG. 9V is a perspective section of the wrist (704). FIG. 9W is a side view section of the wrist (704). FIG. 9X illustrates an exploded perspective view drawing of the wrist (704).

Stowing. Stowing arms (700, 702) to provide a most compact form is disclosed. When arm (702) is moved down toward the top of the machine as described above, and pivoted vertically until is flush with the machine as described above, the machine is in its stowed configuration which is its most compact form. FIGS. 10A, 10B, and 10C illustrate a stowed configuration. FIG. 10A shows this stowed configuration wherein the rails (400, 402) may be pivoted horizontally until the arm is facing the back of the machine (1000) and completely out of the view of the user. FIG. 10B illustrates a perspective view mechanical drawing of an arm (702) stowed behind rail (402).

FIG. 10C shows that this configuration may be unobtrusive. Mounted on wall (2000), machine (1000) may take no more space than a large mirror with ornamental framing or other such wall hanging. This compact configuration makes machine (1000) attractive as exercise equipment in a residential or office environment. Typically home exercise equipment consumes a non-trivial amount of floor space, making them obstacles to foot traffic. Traditionally home exercise equipment lacks functionality to allow the equipment to have a pleasing aesthetic. Machine (1000), mounted on wall (2000), causes less of an obstruction and avoids an offensive aesthetic.

Range of Motion. An exercise machine such as a strength training machine is more useful when it can facilitate a full body workout. An exercise machine designed to be configurable such that it can be deployed in a number of positions and orientation to allow the user to access a full body workout is disclosed. In one embodiment, the exercise machine (1000) is adjustable in three degrees of freedom on the left side, and three degrees of freedom on the right side, for a total of six degrees of freedom.

As described above, each arm (700, 702) may be translated/moved up or down, pivoted up or down, or pivoted left and right. Collectively, this wide range of motion provides a substantial footprint of workout area relative to the compact size of machine (1000). FIG. 11 illustrates the footprint of the dynamic arm placement. The footprint (2100) as shown in FIG. 11 indicates than a compact/unobtrusive machine (1000) may serve any size of human being, who vary in "wing spans". As described herein, a wing span is the distance between left and right fingertips when the arms are extended horizontally to the left and right.

Arm Sensor. Wiring electrical/data connectivity through a movable arm (700, 702) is not trivial as the joint is complex, while sensors to measure angle of an arm are useful. In one embodiment, an accelerometer is placed in the arm coupled to a wireless transmitter, both powered by a battery. The accelerometer measures the angle of gravity, of which gravity is a constant acceleration. The wireless transmitter sends this information back to the controller, and in one embodiment, the wireless protocol used is Bluetooth.

For manufacturing efficiency, one arm is mounted upside down from the other arm, so control levers (732) in either case are oriented inwards. As the two arms are thus mirror images of one another, the signals from the accelerometer may be distinguished based at least in part because the accelerometer is upside down/mirrored on one opposing arm.

Differential. FIGS. 12A-12D illustrate a differential for an exercise machine. FIG. 12A shows a top view of the differential, making reference to the same numbering as in FIG. 1B and FIG. 2, wherein sprocket (201) and spools (202, 203) rotate around shaft (210).

FIG. 12B illustrates a cross-sectional view of FIG. 12A. In addition to the components shown and discussed for FIG. 12A, this figure shows differential configuration of components embedded within sprocket (201) and spools (202) and (203). In one embodiment, sun gears (204) and (206) are embedded inside of cavities within spools (203) and (202), respectively. In one embodiment, planet gear (205) is embedded within sprocket (201), with the planet gear (205) to mesh with sun gears (204, 206) within spools (203, 202).

This configuration of sun gears (204, 206) and planet gear (205) operates as a differential. That is, sun gears (204, 206) rotate in a single vertical plane around shaft (210), whereas planet gear (205) rotates both in that vertical plane, but also horizontally. As described herein, a differential is a gear box with three shafts such that the angular velocity of one shaft is the average of the angular velocities of the others, or a fixed multiple of that average. In one embodiment, bevel style gears are used rather than spur gears in order to promote a more compact configuration.

The disclosed use of sun gears (204, 206) and planet gear (205) and/or embedding the gears within other components such as sprocket (201) permit a smaller size differential for dividing motor tension between cables (500) and (501) for the purposes of strength training.

FIG. 12C illustrates a cross-sectional view mechanical drawing of differential (200). FIG. 12C shows an assembled sprocket (201), front spool (202), rear spool (203) and shaft (210).

FIG. 12D illustrates a front cross-sectional view of sprocket (201). In one embodiment, multiple planet gears are used instead of a single gear (205) as shown in FIG. 12B. As shown in FIG. 12D, sprocket (201) is shown with cavities (211) and (212), which house planet gears (205) and (207). Without limitation, sprocket (201) is capable of embedding a plurality of planet gears. More planet gears enable a more balanced operation and a reduced load on their respective teeth, but cost a tradeoff of greater friction. Cavities (211) and (212), together with other cavities within sprocket (201) and spools (202) and (203), collectively form a "cage" (200) in which the sun gears (204, 206) and planet gears (205, 207) are housed and operate.

As shown in FIG. 12D, planet gears (205) and (207) are mounted on shafts (208) and (209), respectively. Thus, these gears rotate around these shafts in the horizontal direction. As noted above, while these gears are rotating around their shafts, they may also rotate around shaft (210) of FIGS. 12B and 12D as part of sprocket (201).

In one embodiment, each planet and sun gear in the system has at least two bearings installed within to aid in smooth rotation over a shaft, and the sprocket (201) has at least two bearings installed within its center hole to aid in smooth rotation over shaft (210). Shaft (210) may have retaining rings to aid in the positioning of the two sun gears (204, 206) on shaft (210).

In one embodiment, spacers may be installed between the sun gears (204, 206) and the sprocket (201) on shaft (210) to maintain the position of the sun gears (204, 206). The position of the planet gears (205, 207) may be indexed by the reference surfaces on the cage (200) holding the particular planet gear (205, 207), with the use of either spacers or a built in feature.

Differential Mechanical Drawings. FIGS. 12E-12I illustrate detailed mechanical drawings of differential (200) and various features of the differential. FIG. 12E illustrates an exploded perspective view drawing of sprocket (201) and shaft (210). FIG. 12F illustrates an exploded perspective view drawing of planet gears (205, 207), sprocket (201) and shaft (210). FIG. 12G illustrates an exploded perspective view drawing of a cover for sprocket (201). FIG. 12H illustrates an exploded perspective view drawing of the sun gears (204, 205) respectively bonded to spools (202, 203) and assembled with sprocket (201). FIG. 12I illustrates an exploded perspective view drawing of the assembled differential (200) with finishing features.

Together, the components shown in FIGS. 12A-12I function as a compact, integrated, pancake style gearbox (200). The teeth (213) of sprocket (201), which mesh with toothed belt (104), enable the pancake differential/gearbox (200) to rotate in specific, pre-measured increments. This may allow electronics bay (600) to maintain an accurate account of the lengths of cables (500) and (501).

The use of a differential in a fitness application is not trivial as users are sensitive to the feel of cables. Many traditional fitness solutions use simple pulleys to divide tension from one cable to two cables. Using a differential (200) with spools may yield a number of benefits and challenges. An alternative to using a differential is to utilize two motor or tension generating methods. This achieves two cables, but may be less desirable depending on the requirements of the application.

One benefit is the ability to spool significantly larger amounts of cables. A simple pulley system limits the distance that the cable may be pulled by the user. With a spool based configuration, the only limitation on the length of the pull is the amount of the cable that may be physically stored on a spool-which may be increased by using a thinner cable or a larger spool.

One challenge is the feel of the cable. If a user pulls a cable and detects the teeth of the gears passing over one another, it may be an unpleasant experience for the user. Using spherical gears rather than traditional straight teeth bevel gears is disclosed, which provides smoother operation. Metal gears may be used, or plastic gears may be used to reduce noise and/or reduce the user feeling of teeth.

Cable Zero Point. With configurable arms (700, 702), the machine (1000) must remember the position of each cable (500, 501) corresponding to a respective actuator (800, 801) being fully retracted. As described herein, this point of full retraction is the "zero point". When a cable is at the zero point, the motor (100) should not pull further on that cable with full force. For example, if the weight is set to 50 lbs, the motor (100) should not pull the fully retracted cable with 50 lbs as that wastes power and generates heat.

In one embodiment, the motor (100) is driven to reduce cable tension instead to a lower amount, for example 5 lbs, whenever the end of the cable is within a range of length from the zero point, for example 3 cm. Thus when a user pulls on the actuator/cable that is at the zero point, they will sense 5 lbs of nominal tension of resistance for the beginning 3 cm, after which the intended full tension will begin, for example at 50 lbs.

In one embodiment, to determine the zero point upon system power-up the cables are retracted until they stop. In addition, if the system is idle with no cable motion for a pre-determined certain amount of time, for example 60 seconds, the system will recalibrate its zero point. In one embodiment, the zero point will be determined after each arm reconfiguration, for example an arm translation as described in FIGS. 5A and 5B above.

Cable Length Change. In order to determine when a cable is at the zero point, the machine may need to know whether and how much that cable has moved. Keeping track of cable length change is also important for determining how much of the cable the user is pulling. For example, in the process demonstrated in FIGS. 5A and 5B, if a user moves slider (403) down 20 cm, then the cable length will have increased by 20 cm. By keeping track of such length change, the machine (1000) avoids overestimating the length of the user's pull and avoids not knowing the ideal cable length at which to drop cable tension from full tension to nominal tension.

In a preferred embodiment, to keep track of cable length change the machine has a sensor in each of the column holes (405) of FIGS. 5A and 5B. When the user retracts pin (404), the sensor in that hole sends a signal to electronics bay (600) that slider (403) is about to be moved. Once the user moves slider (403) to a new location and resets pin (404), the track hole (405) receiving pin (404) sends a signal to electronics bay (600) of the new location of slider (403). This signal enables electronics bay (600) to compute the distance between the former hole and current holes (405), and add or subtract that value to the current recorded length of the cable. The control signals from holes (405) to electronics bay (600) concerning pin (404) retraction and resetting travel along physical transmission wires that maintain a connection regardless of where cable (501) or pin (404) are.

In practice, a user retracts and replaces pin (404) only when the cable is fully retracted since any cable resistance above the slider and arm weight matching resistance as described above makes it quite physically difficult to remove the pin. As the machine (1000) is always maintaining tension on the cable in order to offset the weight of the slider plus arm, as the slider moves up and down, the cable automatically adjusts its own length. After the pin is re-inserted, the machine re-zeroes the cable length and/or learns where the zero point of the cable is.

In an alternate embodiment, the sensor is in pin (404) instead of holes (405). In comparison to the preferred embodiment, the physical connections between holes (405) and electronics bay (600) still exist and signals are still generated to be sent to electronics bay (600) once pin (404) is removed or reset. One difference is that the signal is initiated by pin (404) instead of by the relevant hole (405). This may not be as efficient as the preferred embodiment because holes (405) still need to transmit their location to electronics bay (600) because of system startup, as if the hole (405) were not capable of transmitting their location, the machine would have no way of knowing where on track (402) slide (403) is located.

In one embodiment, using hole sensors (405) is used by the electronics (600) to determine arm position and adjust torque on the motor (100) accordingly. The arm position may also be used by electronics (600) to check proper exercise, for example that the arm is low for bicep curl and high for a lat pulldown.

Cable Safety. When a user has retracted cable (501), there is typically a significant force being applied on slider (403) of FIGS. 5A and 5B. This force makes it physically challenging for the user to retract pin (404) at this point. After the user retracts cable (501) to the zero point and the machine resets the tension at the nominal weight of 5 lbs, the user instead may find it easy to retract pin (404).

Without a safety protocol, if a user were able to begin removing pin (404) while, for example, 50 lbs of force is being applied to cable (501), a race would ensue between the user fully removing pin (404) and the machine reducing tension weight to 5 lbs. As the outcome of the race is indeterminate, there is a potentially unsafe condition that the pin being removed first would jerk the slider and arm suddenly upwards with 50 lbs of force. In one embodiment, a safety protocol is configured so that every sensor in holes (405) includes a safety switch that informs the electronics bay (600) to reduce motor tension to a safe level such as 5 or 10 lbs. The electrical speed of such a switch being triggered and motor tension being reduced is much greater than the speed at which the slider would be pulled upward against gravity.

In a preferred embodiment, the removal of the locking pin (404) causes the system to reduce cable tension to the amount of tension that offsets the weight of the slider and arm. This allows the slider and arm to feel weightless.

Wall Bracket. To make an exercise machine easier to install at home, in one embodiment the frame is not mounted directly to the wall. Instead, a wall bracket is first mounted to the wall, and the frame as shown in FIG. 1C is attached to the wall bracket. Using a wall bracket has a benefit of allowing a single person to install the system rather than requiring at least two people. Using a wall bracket also allows the mounting hardware such as lag bolts going into wall studs for the bracket to be concealed behind the machine. Alternately, if the machine (1000) were mounted directly, then mounting hardware would be accessible and visible to allow installation. Using a wall bracket also keeps the machine away from dust created while drilling into the wall and/or installing the hardware.

Compactness. An advantage of using digital strength training is compactness. The system disclosed includes the design of joints and locking mechanisms to keep the overall system small, for example the use of a pancake motor (100) and differential (200) to keep the system small, and tracks (400) and sliders (401) to keep arms (700) short.

The compact system also allows the use of smaller pulleys. As the cable traverses the system, it must flow over several pulleys. Traditionally fitness equipment uses large pulleys, often 3 inches to 5 inches in diameter, because the large diameter pulleys have a lower friction. The disclosed system uses many 1 inch pulleys because of the friction compensation abilities of the motor control filters in electronics box (600); the friction is not perceived by the user because the system compensates for it. This additional friction also dampens the feeling of gear teeth in the differential (200).

One-Handed Arm Adjustment

The following are embodiments of a one-handed arm adjustment. Described above are embodiments of a rod-based lever system for arm vertical pivoting. As shown in the above example of FIG. 7D, the female locking member (722) disengages from teeth (422) of part 420 (also referred to herein as a sagittal gear) when a user pulls up on lever (732), unlocking the arm for vertical pivoting.

In some cases, the act of pulling up on a lever such as lever 732 to unlock the arm may need the use of two arms. The following are embodiments of user controls or actuation points that facilitate one-handed unlocking of the arm vertical pivoting.

Push Down Lever Button

In the example of FIG. 7D, the arm is unlocked by pulling up on the lever, which includes rotating the lever out of the arm, away from the central axis of the arm. Described below are embodiments of a push down control that unlocks the arm with a user action that involves the user pushing down on a push down lever and causing the lever to rotate inwards, towards the central axis of the arm. The rotation of the lever causes the rod to be pulled back, disengaging the sagittal lock tooth from the gear.

Facilitating single-handed arm adjustment includes translating a user's activation force into linear travel of a rod. The following are embodiments of mechanisms for translating angular travel (i.e., rotation) of the lever into linear travel of the rod. Using the mechanisms described herein, the user's activation force is effectively reversed.

Linkage

FIGS. 13A and 13B illustrate an embodiment of a control for unlocking an arm. In this example, a push down lever is attached to a linkage that rotates about a pivot point/fixed axis. When the user pushes down on the lever (e.g., with their thumb), the lever rotates inwards, causing the linkage to rotate, which in turn pulls the lock tooth (722) (also referred to herein as the sagittal tooth) out, disengaging it from the teeth 422 of the sagittal gears 420. In the examples of FIGS. 13A and 13B, the shoulder joint and body of the trainer are to the right of the controls shown.

FIG. 13A illustrates the lever in an un-pressed state. FIG. 13B illustrates the lever in a pressed state. As shown in the example of FIG. 13A, the lever 1302 rotates about axis 1314 and is connected to the linkage 1304 at pivot/rotation point 1306. The rod 1308 (that is connected to the lock tooth) is connected to the linkage at pivot/rotation point 1310. The linkage rotates about axis 1312, which is fixed.

As shown in FIG. 13B, when the user presses down at the end 1316 of the lever (which is the portion of the lever that is closer to the user), this causes the lever 1302 to rotate inward about axis 1314. Due to the connection 1306 between the lever 1302 and the linkage 1304, and because axis 1312 is fixed, the linkage is caused to rotate about axis 1312 such that portion 1310 of the linkage moves away from the trainer (where portion 1310 in FIG. 13B is further away from the trainer as compared to where it is as shown in FIG. 13A), thereby causing the rod to be pulled back such that the lock tooth 722 is disengaged from the teeth 422 of the sagittal gears. For example, as described above, the rod is connected to an internal shuttle, which, when moved back, pulls the lock tooth back against compression spring 733 (further compressing it). When the user releases the button after positioning the arm to the desired angle to allow the arm angle to be locked, the compression spring pushes or drives the lock tooth towards the teeth of the sagittal gears such that the lock tooth engages onto the teeth of the sagittal gears. In some embodiments, the ball lock mechanism described above provides a secondary locking mechanism for holding the lock tooth engaged to the teeth of the sagittal gears.

FIG. 13C illustrates an embodiment of a push-down lever control for unlocking arm vertical pivoting. In this example, FIG. 13C illustrates the various components of FIGS. 13A and 13B, with arrows indicating the direction that the components move when the user applies activation force to the lever (e.g., at point 1316 of the lever button 1302, directed toward the central axis of the arm).

As shown in the examples of FIGS. 13A-13B, the linkage 1304 mechanically converts the activation force applied by the user to the lever 1302, which is substantially directed toward the central axis of the arm, into linear force along the arm that pulls on the rod, causing the rod to travel linearly away from the shoulder joint and disengage the locking mechanism from the connecting gear.

The amount of linear travel of the rod that may be achieved for a given angle of rotation of the lever is referred to herein as "travel advantage." The travel advantage of the control (push-down lever) may be adjusted by changing the relationship between fixed axis 1312 and rotation points 1306 and 1310. For example, by placing the axis 1312 closer to pivot point 1306 as compared to pivot point 1310 (e.g., changing the ratio of the distance between rotation point 1306 and fixed axis 1312, and the distance between fixed axis 1312 and rotation point 1310), the more that the lever is rotated, the greater the sweep at point 1310 at the bottom of the linkage.

Further, while the fixed axis and two rotation points of the linkage are shown in a straight line in FIG. 13C, they need not be, as shown in the examples of FIGS. 13A and 13B, where the fixed axis and rotation points are offset relative to each other.

Thus, depending on the relationship among the fixed axis and two rotation points of the linkage, the amount of linear travel that is achieved from the rotation (the "travel advantage" described herein) is changed.

In some embodiments, the relationship between the three points is dictated by the following constraints/thresholds:

- a maximum amount of inward rotation of the lever. That is, the lever should not rotate into the arm beyond a certain point, as it may interfere with the cable running through the arm.
- a minimum amount of linear travel of the rod to disengage the lock. That is, the rod must be pulled back by a minimum amount so that the lock tooth 722 is no longer engaged with the teeth 422 of the sagittal gears.

In some embodiments, the fixed axis and the rotation points of the linkage are designed to maximize the amount of linear travel of the rod for the least amount of rotation of the push-down lever control.

FIG. 14A illustrates an embodiment of an adjustable arm. In this example, a top down view of an arm is shown, where, for example, the body of the trainer is to the left, and the arm has been pivoted down to be parallel to the ground. In this example, the control 1402 is a variant of the control shown in FIGS. 13A and 13B. In this example, the control 1402 is an angled button, where the button is in a raised position in the example of FIG. 14A, indicating that the arm rotation is locked. As shown in this example, a lock tooth 1404 (an example of lock tooth 722) is engaged with the teeth of sagittal gears 1406 and 1408, and the arm rotation is locked. As shown in this example, the control is on an inner side of the arm. As shown in this example, the lock tooth engages onto the teeth of two sagittal gears.

FIG. 14B illustrates an embodiment of a user control. In this example, a detailed section view of control 1402 in the raised state is shown. As shown in this example, the underlying mechanism for engaging/disengaging the lock tooth is similar to that as shown in FIGS. 13A and 13B, and includes a linkage 1410 which, similarly to as described in the example of FIGS. 13A and 13B, translates the angular rotation of the control 1402 (which rotates about fixed point 1412) into a linear travel of the rod.

FIG. 14C illustrates an embodiment of an adjustable arm. In this example, a top down view of the arm is shown, where, for example, the body of the trainer is to the left, and the arm has been pivoted down to be parallel to the ground. In this example, control 1402 is in a lowered state (e.g., because the user is pressing down on the angled lever button). As shown in this example, the linkage 1410 translates the downward rotation of the angled button (which is directed towards the central axis of the arm) into a linear travel of the rod 1414 in a direction away from trainer/sagittal gears, thereby causing the lock tooth 1404 to be pulled back and disengaged from the teeth of sagittal gears 1406 and 1408, where a gap between the sagittal gears and the lock tooth is shown at 1416.

FIG. 14D illustrates an embodiment of a user control. In this example, a detailed section view of control 1402 in the depressed state is shown. As shown in this example, compared to the example of FIG. 14B, due to the linkage 1410 and the relationship between the pivot points 1418 and 1420 and fixed axis 1422 of the linkage, pushing down of button 1402 causes the bottom part of the linkage to be pulled back (to the right as compared to the example of FIG. 14B) at pivot point 1420, thereby causing the rod 1414 to also be pulled back (which pulls back the connected lock tooth and causes the connected lock tooth to be disengaged from the sagittal gears).

Compression Spring Optimization

Reducing Spring Strength

As shown in the examples above, the linkage mechanism described above provides a "travel advantage" in converting the user's activation force, which is directed inwards towards the central axis of the arm, into linear force along the arm that pulls the rod back, thereby disengaging the arm for vertical pivoting.

Increasing the travel advantage may result in a tradeoff, where there is a decrease in mechanical advantage of the unlocking mechanism (where the user would need to apply a greater amount of activation force to pull back the rod 1308).

For example, the distance between rotation point 1306 and fixed axis 1312 forms a first lever arm, while the distance between the fixed axis 1312 and rotation point 1310 forms a second lever arm, where the first lever arm is a torque arm for rotating the linkage (and causing the rod to move back).

Designing the linkage 1304 such that the first lever arm is much longer than the second lever arm would result in a less travel advantage, where greater rotation of the lever 1302 would be needed to achieve the desired linear travel. However, as the first lever arm, which is the torque arm, is much larger than the second lever arm, this configuration provides higher mechanical advantage, and less activation force is needed by the user to move the rod and further compress the compression spring 733 when unlocking the arm vertical pivoting.

In contrast, the travel advantage may be increased by designing the linkage 1304 such that the lever arm between rotation point 1306 and fixed axis 1312 is much smaller than the lever arm between fixed axis 1312 and rotation point 1310 of the linkage, where for each degree of rotation, there is a larger amount of linear travel. However, mechanical advantage is lost, as the torque lever arm (between rotation point 1306 and fixed axis 1312) is short compared to the second lever arm (between the fixed axis 1312 and the rotation point 1310 connected to the rod).

As described above, in some embodiments, in order to prevent the push down lever button from interfering with the rope in the arm, there is a maximum allowed angular rotation of the lever. There is also a minimum amount of linear travel needed for the rod to disengage the lock tooth. In some embodiments, the linkage is designed for the desired amount of linear travel given the maximum allowed angular rotation, as described above (e.g., by adjusting the relationship between the rotation points and the fixed axis). This results in a certain mechanical advantage provided to pull the rod and shuttle against the compression spring 733

(where movement of the rod causes the shuttle to further compress the compression spring).

As will be described in further detail below, to provide a good user experience for the user (where they do not need to apply a burdensome amount of activation force), the compression spring force may be optimized. For example, as will be described in further detail below, a lighter compression spring 733 may be used if a ball lock mechanism as described above is used.

In some embodiments, compression spring 733 is used to hold the lock tooth 722 to the teeth 422 of the sagittal gear (because the compression spring drives the lock tooth toward the sagittal gear). Described above is an embodiment of a ball-lock system to lock the engagement of the sagittal tooth 722 to the teeth 422 of the sagittal gears. The ball lock system provides a secondary lock on the sagittal tooth to prevent it from becoming disengaged (e.g., prevents the lock tooth from being driven backwards, away from the teeth of the sagittal gears due to the motion of the exercise machine when the user is performing exercise).

In some embodiments, to reduce the activation force required by the user to activate the control (push down lever) and disengage the locking mechanism (lock tooth 722) from the connecting gear (the sagittal gears), the spring strength of the compression spring 733 is reduced (where the compression spring strength can be reduced because it is no longer the only mechanism keeping the lock tooth engaged-once the lock tooth is seated, the ball lock mechanism described above also keeps the lock tooth seated). In this way, by using the ball lock mechanism described above, a lighter spring may be used, which makes it easier for the user to press down on the push-down lever (as compared to, for example, a locking mechanism without the ball locks described above, and that relies only on the compression spring to keep the arm pivoting locked—in this case, a higher strength spring may be used, which may require more user activation force to compress the compression spring further when disengaging the lock tooth from the sagittal gear teeth).

Thus, by optimizing the design of the linkage, in conjunction with optimizing the strength of the spring (which can be lowered if the ball lock mechanism described above is used), a single-handed control for unlocking arm vertical pivoting is achieved that not only results in the needed linear travel of the rod (for disengaging the lock tooth) with a minimum amount of angular rotation of the push down lever (so as not to interfere with the cable running through the arm), but also without requiring an overly burdensome amount of activation force needed to be applied by the user in order for the rod to pull the shuttle back against the compression spring.

Adjusting the Delta in Spring Force

As described above, the ball lock mechanism described above allows the use of a lighter compression spring 733. This reduces the overall activation force required by the user to be able to move the rod back in a direction away from the trainer.

As described above, when the user pushes down on the lever button, the user's activation force is translated or converted into linear travel of the rod. In some embodiments, the linear travel of the rod pulls back on an internal shuttle that pulls back the lock tooth, disengaging it from the teeth of the sagittal gear. When the internal shuttle is pulled back, this motion acts against compression spring 733, causing the compression spring to compress. In order to disengage the lock tooth, the lock tooth must be moved back a certain amount of distance. The compression spring is compressed by this amount. The spring force, which is a function of the spring deflection, varies by the amount the compression spring is compressed, and therefore increases across the distance or deflection that the spring is compressed. That is, the spring force that the user acts against increases as they push down further on the button.

FIG. 14E illustrates an embodiment of an arm vertical pivoting locking mechanism. Over the course of applying an activation force on the user control to unlock the arm vertical pivoting, the rod 1308, which is connected to internal shuttle 1460 (an example of the internal shuttle described above in conjunction with FIG. 7E), pulls the internal shuttle back, away from the trainer. In this example, there is a washer at the end of the shuttle 1460, between the shuttle and compression spring 733. When the shuttle 1460 is moved back away from the sagittal gears, the washer compresses the compression spring over a distance (where the amount that the spring is compressed by is the linear travel needed to pull the lock tooth away from the teeth of the sagittal gears). Over the linear distance traveled by the rod, the compression spring is compressed by that linear distance, and the counter force applied by the spring against that compression increases over that distance (as the deflection increases). That is, as the further back the rod travels, the spring deflection of the compression spring also changes, and the greater force that the compression spring resists the compression caused by the rod and shuttle. Here, the activation force required by the user to move the rod changes over the course of pushing down on the lever button (because the spring deflection also changes). Thus, there is a delta between the activation force needed by the user when they first start to press down on the control, and the activation force needed when the button is pressed further down (where the activation force needed increases). If there is a large difference or delta in activation force needed from the time the user starts pushing down on the lever button to when the lever button is pushed further inwards, this may lead to a potentially uncomfortable user experience. That is, the spring force the user experiences when they start to push down on the button will be different from what they experience when the button is fully depressed (because the compression spring 733 will have also experienced a larger spring deflection). If the change in spring force is too great during the disengagement action, then this may be uncomfortable to the user.

Described below are techniques for reducing or minimizing the change in spring force during disengagement of the lock tooth from the teeth of the sagittal gears. Using the techniques described herein, the change or delta in the force of the compression spring over the spring deflection corresponding to the linear travel of the rod when disengaging the lock tooth from the sagittal gears is reduced or minimized.

In one embodiment, a longer compression spring is used with a larger amount of pre-compression in its preload state. During the linear travel of the rod, the amount of spring deflection will be a smaller percentage of the overall length of the spring, thereby reducing the delta in spring force experienced by the user. For example, when the compression spring is included in the assembly shown in the example of FIG. 14E, it is initially compressed by a certain amount (e.g., 50%). Based on the spring rate, the compression spring will have a certain force for a certain deformation/deflection of the spring. When the user pushes the lever button to unlock arm vertical pivoting, the compression spring is further compressed from its initial compressed state. However, the deflection over the disengagement distance is a relatively small proportion of the length of the compression spring (e.g., $1/10^{th}$), in which case there is a relatively small spring deflection, and thus a relatively small delta in spring force of the compression spring across the disengagement distance. That is, the amount of travel (compression of the spring) compared to its original length is relatively small (the deflection of the spring during activation of the control is small relative to its initial deflection). In this way, the user experiences a spring force that only increases by a small amount, such that the activation force required by the user through the course of activating the control feels relatively constant. This provides a more consistent force throughout activation of the vertical pivot control.

The techniques for minimizing the change in spring force across the activation of the control described above (to make the spring force more constant through the action) may be used independently and/or in combination with the above techniques for reducing the overall spring force.

Placement of Push Down Lever Button

The push-down lever control described above for unlocking an arm for vertical pivoting may be placed on various locations of the arm.

Interior of the Arm

In some embodiments, the control is placed on a side of the arm. FIG. 15A illustrates an embodiment of a control on the arm for unlocking vertical rotation. In this example, an embodiment of a side profile view of a left arm of the strength trainer (the arm on the left when facing the trainer) is shown. In this example, the control lever 1302 is shown on the side of the arm facing inwards, towards the right arm (where the controls shown in the examples of FIGS. 13A and 13B are rotated 90 degrees clockwise to their orientation in those figures). This is also shown in the examples of FIGS. 14A and 14C. In some embodiments, the control is a distal control, where distal refers to the side of the arm that is away from the sagittal gear. An embodiment of the rod 1308 is also shown in this example. Sagittal gears at the shoulder of the joint, as described above, are shown at 1502. In this example, linkage 1304 (which is inside the arm) is connected to the arm.

As shown in this example, the cable 1504 that the user pulls on exits the wrist 1506 at the distal end of the arm (away from the trainer), and in the center of the arm. In this example, the cable does not travel on/is parallel to the central axis of the arm (where the central axis is exemplified by dotted line 1508 running through the center of the arm). Rather, the cable angles downward through the arm.

As the cable is slightly off center to the low side where the cable crosses the canoe 1510 (where the push down lever is seated), the linkage 1304 and other components of the push-down lever control described above are placed such that they do not interfere with the cable.

FIG. 15B illustrates an embodiment of an interior view of an arm. In this example a cross-section view of a right arm of an exercise machine (when facing a trainer) is shown. In this example, a variation of the control that is raised when unactivated is shown. In this example, as in the example of FIG. 15A, the control 1520 is oriented on the side of the arm, facing towards the other arm. An example of a linkage such as linkage 1304 is shown at 1522, and an example of a cable running through the arm is shown at 1524.

Top of the Arm

The following is an embodiment of placing the arm adjustment control on the top of the arm. FIG. 16A illustrates an embodiment of a control on the top of the arm. In this example, a variation of the push down lever button that is raised is shown at 1602 (e.g., a type of control with a design as shown in the examples of FIG. 14A-14D).

FIGS. 16B and 16C illustrate embodiments of components for a control on the top of an arm for translating activation force to linear force. In this example, to avoid interference with the cable running through the arm (1612 in FIG. 16B) and to provide sufficient clearance for the cable, the control 1602 is connected to balanced linkages 1604 and 1606, where each may be an instance of linkage 1304 described above. In this example, the pivot points 1608 and 1610 of linkages 1604 and 1606, respectively, are connected to a "tuning fork" or "pitch fork" shaped rod, as shown in the example of FIG. 16C. As shown in this example, the linkages do not interfere with the cable, and the cable is able to travel in the space between the two balanced linkages.

FIG. 16C illustrates an embodiment of a split rod. In this example, a top down view of the inside of an arm is shown. As shown in this example, one end of the split rod 1620 is connected to an internal shuttle such as shuttle 1460. Here, in the example of FIG. 16C, the rod comes out of the shuttle and then splits into two, where the two ends are connected to the balanced linkages at 1608 and 1610, as described above. As one example, the split rod is implemented as two pieces that are combined together (e.g., two stamped pieces of sheetmetal that have a bend coming out). The split rod may also be manufactured as a single piece.

As described above, in some embodiments, the cable (e.g., cable 1612, represented by dotted line 1612 in FIG. 16C) is angled downwards in the arm. In some embodiments, the splitting point of the split rod 1620 of FIG. 16C is chosen at a point where the cable is below the rod. Thus, using the split rod 1620 and balanced linkages 1608 and 1610, the control for unlocking arm vertical pivoting does not interfere with the cable running through the arm.

Design Variants

When the arm is locked (and the control is not being activated by a user), the lever button may be flush with the arm (as shown in the example of FIG. 13A) or raised out of the arm (e.g., angled upwards as in FIG. 14B, where the portion that is angled upwards is where the user applies activation force to push down on the lever). In the example of FIG. 13A, the lever is flush with the surface of the arm when not engaged by the user, and rotates into the arm when activated by the user. In the example of FIG. 14A, the angled button is level with the surface of the arm when pressed down. By raising the button, there are more degrees of rotation available to the lever to move through. The travel advantage mechanisms described herein may be variously adapted to accommodate any type of control design.

Additional Force Translation Embodiments

The following are alternative embodiments of mechanisms usable to translate angular rotation of a user control such as the push-down lever and angled lever button described above to linear travel of a rod.

Cable Over a Bearing

FIGS. 17A and 17B illustrate embodiments of cable over bearing mechanisms for mechanical conversion of lever rotation to linear travel of a locking mechanism. FIG. 17A illustrates an embodiment of a block and tackle-based mechanism for mechanical conversion of lever rotation to linear travel of a rod. In FIG. 17A, a portion of a "canoe," where the lever and the button sit, is shown. In this example, using the block and tackle, double the linear motion is achieved, although there may be increased manufacturing complexity to include the rollers and wires.

FIG. 17B illustrates an embodiment of a cable over bearing mechanism for mechanical conversion of lever rotation to linear travel of a locking mechanism. In this example, a portion of the lever is connected to one end of a cable at 1702, where the cable is routed over bearing 1704. The other end of the cable is coupled to the lock tooth. When the user pushes down on the lever control, this causes the lever to rotate inwards (about a pivot point) toward the central axis of the arm. This motion in turn causes portion 1702 of the lever to move towards the trainer (where the trainer is to the right in the example of FIG. 17B). When portion 1702 of the lever moves towards the trainer, this causes the cable, which is routed over the bearing, to be pulled, which in turn pulls the lock tooth back, thereby disengaging the lock tooth from the teeth of the sagittal gear.

Gear

FIG. 17C illustrates an embodiment of a gear-based mechanism for mechanical conversion of lever rotation to linear travel of a locking mechanism. As shown in this example, lever control 1720 includes, or is attached to, a first gear 1722. The gear 1722 of the lever is in turn coupled with a second gear 1724. In some embodiments, the teeth of gear 1724 are enmeshed with the teeth of gear 1722. In this example, gear 1724 is connected to a bar/arm 1726. In some embodiments, bar 1726 is connected to a rod 1728 that is connected to the locking mechanism (e.g., lock tooth, where in this example, the trainer is to the right). In this example, when the lever (which is attached to gear 1722) is pressed down, the second gear 1724 is caused to rotate. The arm 1726 attached to the gear 1724 rotates together with the gear, pulling the lock tooth out.

Rotating Linkage

FIG. 17D illustrate an embodiment of a rotating linkage mechanism for mechanical conversion of lever rotation to linear travel of a locking mechanism. In this example, the lever 1732 is attached to a linkage 1734 that is connected to a second arm 1736. When the lever 1732 is pressed down, as shown in this example, the lever rotates, which in turn rotates the linkage 1734. The linkage rotates the second arm 1736, pulling the lock tooth out (in this example, the second arm pulls back a rod 1738 that is connected to the lock tooth, where the trainer is to the right in this example figure).

Squeeze/Push Down Button

In the above examples of the lever buttons, the user control rotated inwards, where the angular rotation of the lever was translated into linear travel of the rod. The following are embodiments of user controls in which a user activates a one-handed control by pressing downwards, toward the center axis of the arm, where the lock tooth is then disengaged from the sagittal gears. Here, the user's activation force is directed towards the central axis of the arm. Using the travel advantage mechanisms described below, the user's activation force is translated orthogonally, to cause the rod connected to the sagittal tooth to travel linearly in a direction perpendicular to the direction that the control travels in response to a user's activation force.

FIG. 18 illustrates an embodiment of a squeeze control button. In this example, the user activates the vertical pivot control by squeezing down on the button 1802 (e.g., with their palm or fingers). The following are examples of linkages that may be used with such a squeeze control button to translate the linear travel of the button into linear travel of the rod, such as that described above for disengaging the lock tooth from the sagittal gears. In the following examples, the user presses straight into the arm, and the mechanisms described below translate the user activation force by 90 degrees to cause the rod to be pulled back. In some embodiments, the mechanisms described herein include using gears, ramps with cam followers, etc.

Wedge

FIG. 19A illustrates an embodiment of a wedge mechanism for force translation. In this example, the sagittal gears are to the right. When the user pushes on button 1902 (e.g., an example of button 1802 of FIG. 18), this causes angled component 1904 (which is connected to a rod such as rod 1308) to move to the side, pulling the lock tooth out and disengaging it from the teeth of the sagittal gears.

Gear

FIG. 19B illustrates an embodiment of a gear-based mechanism for force translation. In this example, the sagittal gears are to the right. In this example, the button 1910 which has teeth on its side, pushes downwards, rotating a gear 1912 clockwise, to the left, where the gear has an extension arm 1914 that is connected to a rod such as rod 1308. This causes the lock tooth to be pulled out. In some embodiments, the amount of travel advantage (e.g., amount of linear travel of the rod that is achieved given an amount of linear travel of a user's activation force) may be varied by adjusting the gear ratios.

Linkage

FIG. 19C illustrates an embodiment of a linkage-based mechanism for force translation. In this example, the sagittal gears are to the right. In this example, the button 1920 is connected to a linkage 1922, which is in turn connected to a bar 1924 that is connected to the locking tooth (e.g., via a rod). When the button is pressed down, the linkage pushes the bar, causing it to rotate/sweep clockwise, to the left. The rotating bar pulls the rod back, pulling the lock tooth out. In some embodiments, the amount of travel advantage (e.g., amount of linear travel of the rod that is achieved given an amount of linear travel of a user's activation force) may be varied by adjusting the relationship between the various rotation/pivot points.

Scissor

FIG. 19D illustrates an embodiment of a scissor mechanism for force translation. In this example, the sagittal gears are to the left. In this example, points 1932 and 1934 are fixed. When button 1936 is pressed down, component 1938, which is for example connected to a rod such as rod 1308, moves to the right, causing the lock tooth to be disengaged from the teeth of the sagittal gear. In this way, the linear force applied by the user down into the arm is translated into an orthogonal force directed to the right in this example image.

Cable Wrapped Over Bearing

FIG. 19E illustrates an embodiment of a cable-based mechanism for force translation. In this example, the sagittal gears are to the right. In this example, cable 1942 (separate from the cable used by the user to perform exercise) is wrapped over a bearing 1944. Cable 1942 is connected, for example, to the shuttle in the lock tooth. When the button 1946 is pushed downwards, into the arm, this causes the cable to be pulled to the left, which in turn disengages the lock tooth from the teeth of the sagittal gears, unlocking vertical pivoting of the arm.

Ramp with Cam Follower

FIGS. 19F and 19G illustrate embodiments of a cam follower-based mechanism for force translation. In this example, the sagittal gears are to the right. FIG. 19F illustrates a view of the mechanism when facing down into the arm. FIG. 19G illustrates a side profile view of the mechanism shown in FIG. 19F. In this example, the button 1950 is limited to travelling straight down into the arm. In the wall of the button 1950 is a ramp 1956. The fixed portion 1952/1954 includes a horizontal ramp 1958. When the button is pushed down, this forces the pin 1960, which is connected to a rod such as rod 1308, to move to the left, thereby disengaging the lock tooth from the teeth of the sagittal gears. In some embodiments, the rod is over the center of the pin.

Sleeve

In an alternative embodiment, the control for unlocking arm vertical pivot is implemented as a sleeve. FIGS. 20A and 20B illustrate embodiments of sleeve-based controls for arm adjustment.

Sleeve Pull Down

FIGS. 20A and 20B illustrate embodiments of a sleeve-based control. In the examples of FIGS. 20A and 20B, the sleeves (e.g., sleeve 2002 and sleeve 2004) are connected to a rod such as rod 1308. When the user grips the sleeve and slides the sleeve away from the sagittal gears in the shoulder of the trainer, this causes the rod to pull the lock tooth back, disengaging the lock tooth from the teeth of the sagittal gears. In this example, the user's activation force for activating the sleeve control is directed along the length of the arm.

Sleeve Rotation

In an alternative embodiment, a user activates the control by twisting the sleeve. In this example, when the user grips the sleeve and rotates/twists it, the torque applied by the user is translated into, for example, a linear travel of a rod such as rod 1308, causing the lock tooth to be pulled back, thereby disengaging the lock tooth from the teeth of the sagittal gears.

FIG. 20C illustrates an embodiment of a rotating sleeve-based control. As shown in this example at 2010, to move the rod (2012) connected to the locking mechanism (e.g., lock tooth), the user grips the sleeve 2014 and rotates it (about the central axis of the arm 2016). As shown in this example, in order for the rotation of the sleeve around the arm tube 2016 to be converted into linear travel of the rod 2012, a rod 2018 travels through twisting helical grooves on the inside of the sleeve. Each end of the rod 2018 is driven by a helical groove. In some embodiments, two helical grooves are on the inside of the sleeve, forming a double helix, where each end of the rod 2018 is driven by a respective helical groove in the sleeve (for illustrative purposes, a single helical groove is shown). In this example, as the user twists the sleeve (where the trainer is to the right in the example of FIG. 20C), the rod 2018 travels through the twisting helical groove on the inside of sleeve, while also being constrained to linear travel by slot 2020 in the wall of the arm tube (where each end of the rod 2018 is constrained by a respective slot in the wall of the arm tube). Thus, when the user twists the sleeve, the combination of the helical grooves and the slots in the walls of the arm tube causes the rod 2018 to be driven away from the trainer and toward the user. As the rod 2012 is also connected to rod 2018, this in turn causes linear travel of rod 2012, thereby disengaging the locking mechanism (e.g., disengaging the lock tooth from the teeth of the sagittal gears), unlocking arm adjustment. As shown in this example, hard stops for the sleeve are also included on the arm tube at both ends of the sleeve.

Additional Lever Control Embodiments

In the above examples of lever controls shown in FIGS. 13A-14D, linkages or other intermediary mechanisms were used to provide travel advantage when converting the user's activation force to a linear force to disengage a lock tooth from the sagittal gears.

The following are embodiments of single-handed lever controls that directly disengage the lock tooth from the gear, without the use of an intermediary linkage. In these examples, the rod connected to the lock tooth is coupled to the lever control, where movement of the rod is managed based on the placement of the rod/lever connection point and the fixed axis of the lever (about which the lever rotates)

FIG. 21 illustrates an embodiment of a control. In this example, a lever control 2102 is shown with a portion of an arm. In this example, the fixed axis 2104 (about which the lever rotates) is towards the trainer (which is to the right in this example figure), and the end of the lever that is towards the user (away from the trainer) is the moving end. In this example, the point at which the rod connects to the lever control (at 2106) is above the fixed axis. In this way, when the moving end is pressed downwards (towards the central axis of the arm), the rotation of the lever about the fixed axis causes the rod to be pulled away from the trainer.

FIG. 22A illustrates an embodiment of a control. In this example, a lever control 2202 is shown with a portion of an arm. In this example, the fixed axis 2204 is away from the trainer (and closer to the user), and the moving end of the lever is away from the user (and towards the trainer). As shown in this example, the point at which the rod connects to the lever control (at 2206) is below the fixed axis. In this way, when the moving end is pressed downwards (towards the central axis of the arm), the rotation of the lever about the fixed axis causes the rod to be pulled away from the trainer.

FIG. 22B illustrates embodiments of a control. In this example, a variation of the lever control of FIG. 22A is shown, with a different relative placement of the fixed axis and rod connection point. In this example, two views of a one-handed control for arm adjustment are shown. In this example, the trainer is to the left. In this example, the user presses down on the lever, allowing for a one-handed action to unlock the lock tooth from the sagittal gears.

FIG. 22C illustrates embodiments of a control. In this example, embodiments of the lever control example of FIG. 22B are shown in an arm. In the examples of FIG. 22C, the trainer is to the left. In this example, a one-handed action is demonstrated, in which a hand is wrapped around the arm behind the lever while pressing in the lever with a thumb.

In the above examples of FIGS. 21 and 22A-22C, without a linkage, there is no intermediary mechanism providing travel advantage. In this case without travel advantage, it would be beneficial if the lever control were able to rotate sufficiently to cause the rod to disengage the lock tooth, but without rotating so much into the arm as to interfere with the cable inside the arm. The following are embodiments of control designs that minimize the amount that the lever control needs to rotate into the arm to unlock arm angle adjustment. As one example, the lever control is raised, as shown in the example of FIG. 14A. This allows for more lever rotation before the moving end of the lever interferes with the cable. As another example, the linear travel required to disengage the lock tooth may be reduced. For example, the gear teeth and/or lock tooth may be shortened. This reduces the amount of rotation of the lever control needed to disengage the lock tooth from the sagittal gears. The relationship between the fixed axis of the lever and where the rod is attached to the lever control may also be adjusted. The raising of the lever and reduction of required travel for disengaging the lock tooth may be done independently or in combination.

Unlocking Multiple Degrees of Freedom

Described above are embodiments of user controls for single-handed adjustment of the arm vertical pivoting. In various embodiments, the user controls described above may be adapted to accommodate single-handed adjustment and unlocking of multiple degrees of freedom of the arm. In some embodiments, the control is a multi-stage control where, for example, activating the control to a first stage unlocks a first degree of freedom, and further activation of the control to a second stage unlocks a second degree of freedom. For example, the push down lever described above may be adapted to have two stages, where the lever may be pressed down through two points, where beyond a first rotation point, the first DOF is unlocked, and when the lever swings beyond a second rotation point (because the user has pushed further), the second DOF is unlocked.

The following are embodiments of mechanisms for facilitating unlocking of multiple degrees of freedom through activation of a single control.

Wireless Connection for Unlocking Second DOF

As one example, the arm includes a PCB (printed circuit board) that includes Bluetooth for unlocking column rotation (for horizontal pivoting of the arms, as described above). In some embodiments, the control (e.g., push down lever) for unlocking the vertical pivoting of the arm is adapted to also be coupled to the PCB such that activation of the control not only disengages the lock tooth from the sagittal gear as described above, but also activates Bluetooth, sending a signal to also unlock rotation of the column. For example, the Bluetooth signal activates a solenoid for unlocking rotation of the columns described above and allowing for arm horizontal pivot. In this way, the user is able to, with one hand, unlock both vertical and horizontal pivoting of the arm.

Physical Connection for Unlocking Second DOF

As another example, as described above, the trainer includes sliders 401 and 403 for allowing the arms to slide vertically on tracks. In some embodiments, a single-handed control is adapted to unlock both the arm vertical pivoting, as well as the vertical slide/translation of the arm. As described above, in some embodiments, a pin is used to lock the vertical sliding of the arm. In some embodiments, to unlock both degrees of freedom from the single control, the rod for unlocking the arm vertical pivot is further physically connected to the pin used to lock the slider (e.g., pin 404). For example, the rod is connected to the pin 404 using a push-pull cable. In some embodiments, when the rod is pulled back, the push-pull cable between the rod and the pin 404 causes the pin 404 to be pulled back as well, unlocking the vertical translation of the arms.

In some embodiments, a single control may be used to unlock all three degrees of freedom at once (e.g., by having a control that is connected to the rod 1308 used to unlock arm vertical pivot, that is coupled to the wireless connection described above for unlocking arm horizontal pivot, and that is also physically connected as described above to a pin for unlocking vertical sliding of the arm).

FIG. 23 illustrates an embodiment of an exercise machine with one-handed arm adjustment. In this example, multiple degrees of freedom may be unlocked with a single action or from a single touch point. In this example of FIG. 23, pressing the lever in with one hand moves the lock tooth which releases the arm angle (using the arm angle adjustment controls described above), as well as the shoulder height movement (e.g., by using the push-pull cable described above), while the lever movement activates a wireless connection such as Bluetooth, as described above, to allow the column to rotate.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise device, comprising:

a resistance unit having a connecting gear;

a cable; and an arm that routes the cable to an actuator, wherein the arm is rotatable relative to the resistance unit about the connecting gear, the arm having a central axis;

wherein the arm includes a control that mechanically disengages a locking mechanism from the connecting gear;

wherein the control is activated by an activation force substantially directed either toward the central axis of the arm, along a length of the arm, or about the central axis;

wherein the control comprises a button, wherein the button is activated by pressing down on the button with the activation force substantially directed toward the central axis of the arm;

wherein the activation force is mechanically converted into a linear force along the arm via a wedge coupled to the locking mechanism, and wherein activation of the button causes the wedge to travel in a direction that causes the locking mechanism to disengage from the connecting gear; and wherein the activation force is mechanically converted into the linear force along the arm that disengages the locking mechanism from the connecting gear.

2. The exercise device of claim 1, wherein the control is located on a side or a top of the arm.

3. An exercise device, comprising:

a resistance unit having a connecting gear;

a cable; and an arm that routes the cable to an actuator, wherein the arm is rotatable relative to the resistance unit about the connecting gear, the arm having a central axis;

wherein the arm includes a control that mechanically disengages a locking mechanism from the connecting gear;

wherein the control is activated by an activation force substantially directed either toward the central axis of the arm, along a length of the arm, or about the central axis;

wherein the control comprises a button, where in the button is activated by pressing down on the button with the activation force substantially directed toward the central axis of the arm;

wherein the activation force is mechanically converted into a linear force along the arm that disengages the locking mechanism from the connecting gear;

wherein the activation force is mechanically converted into the linear force along the arm via a gear;

wherein an extension arm is coupled to the gear;

wherein the locking mechanism is coupled to the extension arm; and wherein activation of the button causes the gear to rotate, disengaging the locking mechanism from the connecting gear.

* * * * *